US008862002B2

(12) United States Patent
Igarashi et al.

(10) Patent No.: US 8,862,002 B2
(45) Date of Patent: Oct. 14, 2014

(54) IMAGE FORMING APPARATUS AND METHOD

(75) Inventors: Norikazu Igarashi, Kanagawa (JP); Naruhiro Masui, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 224 days.

(21) Appl. No.: 13/609,737

(22) Filed: Sep. 11, 2012

(65) Prior Publication Data

US 2013/0064580 A1 Mar. 14, 2013

(30) Foreign Application Priority Data

Sep. 14, 2011 (JP) ..... 2011-200800
Aug. 6, 2012 (JP) ..... 2012-174354

(51) Int. Cl.
*G03G 15/00* (2006.01)
*G03G 15/01* (2006.01)

(52) U.S. Cl.
CPC ..... *G03G 15/0189* (2013.01); *G03G 15/5058* (2013.01); *G03G 2215/0161* (2013.01)
USPC ..... 399/49; 399/301

(58) Field of Classification Search
USPC ..... 399/49, 301
See application file for complete search history.

(56) References Cited

U.S. PATENT DOCUMENTS

2004/0041896 A1 3/2004 Shinohara

FOREIGN PATENT DOCUMENTS

| | | |
|---|---|---|
| JP | 8-85236 | 4/1996 |
| JP | 2000-181171 | 6/2000 |
| JP | 2004-101567 | 4/2004 |
| JP | 2005-274919 | 10/2005 |
| JP | 2008-42438 | 2/2008 |
| JP | 2012-063499 | 3/2012 |
| JP | 2012-118166 | 6/2012 |

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

An image forming apparatus reduces superimposing misalignment due to skew difference and registration difference and superimposing misalignment of visible image due to periodic position error generated on a plurality of latent image carriers respectively by correcting image information. A controller of the image forming apparatus has a deviation amount storing unit store data of magnification error in the sub-scanning direction e, executes rotation posture determining process that sets writing rotation posture as rotation angle posture at the time of starting writing latent image on photoconductors for Y, M, C, and K respectively, and has an image data correcting unit correct the image information based on the determined writing rotation posture and various error data (including magnification error in the sub-scanning direction e).

14 Claims, 24 Drawing Sheets

IMAGE FORMING APPARATUS AND METHOD

CROSS-REFERENCE TO RELATED APPLICATIONS

This patent application is based on and claims priority pursuant to 35 U.S.C. §119 to Japanese Patent Application No. 2011-200800, filed on Sep. 14, 2011, and Japanese Patent Application No. 2012-174354, filed on Aug. 6, 2012, the entire disclosure of which is hereby incorporated by reference herein.

BACKGROUND OF THE INVENTION

1. Field of the Invention

The present invention relates to an image forming apparatus and method, and more particularly to an image forming apparatus and method that transfers visible images carried by each of a plurality of latent image carriers to a recording sheet after superimposing those visible images on a surface of an endless moving belt, or superimposes visible images carried by each of a plurality of latent image carriers on a recording sheet held on the surface of the endless moving belt.

2. Description of the Related Art

Known image forming apparatuses move an endless intermediate transfer belt as a surface endless moving member tensioned by a plurality of tension rollers. Four first transfer nips are formed on the front surface of the intermediate transfer belt by contacting four photoconductors, yellow (Y), magenta (M), cyan (C), and black (K) that form toner images of each color. After superimposing Y, M, C, and K toner images formed on the surface of each photoconductor on the intermediate transfer belt at each of Y, M, C, and K first transfer nip, the image forming apparatus transfers the superimposed toner image to the recording sheet en bloc. Accordingly, a full color image is formed on the recording sheet.

Alternatively, the image forming apparatus may use a transfer belt that transfers a recording sheet held on its surface that moves endlessly instead of using the intermediate transfer belt. This type of image forming apparatus transfers Y, M, C, and K toner images formed on each of Y, M, C, and K photoconductor to the recording sheet on the transfer belt directly, and produces a full color image.

Like these image forming apparatuses described above, a type that transfers toner images formed on each of a plurality of photoconductors to a surface of an endless moving member like a belt or a recording sheet held on the surface of the endless moving member is called a tandem type. Tandem-type image forming apparatuses have an advantage in that productivity (number of sheets of recording paper that can be printed per unit time) is improved substantially. By contrast, tandem type image forming apparatuses have a disadvantage in that color misalignment (registration misalignment), a phenomenon in which toner images of each color are transferred in misaligned position with each other due to positional misalignment and dimensional tolerances of photoconductors and optical writing units, etc., in image forming units for each color, is caused easily. Consequently, it is necessary to execute color misalignment correcting control (in other words, registration control) to correct the color misalignment.

The following process for color misalignment correcting control is well-known. First, a test pattern image that includes test toner patterns for each color for detecting color misalignment is formed on an intermediate transferring belt. Subsequently, amount of color misalignment (amount of registration misalignment) is calculated based on results of detecting positions of test toner images for each color in the test pattern image by sensors. Lastly, optical paths in optical systems for each color, image writing positions for each color, and pixel clock frequency are corrected based on calculated amount of color misalignment (amount of registration misalignment).

However, the color misalignment correcting control described above has two main issues. First issue is that it is necessary to adjust positions of optical paths in optical system for each color with each other by moving a mirror in an optical path and part of optical system including a light source and a f-θ lens mechanically in order to correct optical paths in the optical system, and that drives up cost since it is necessary to provide precision moving parts to do that. Furthermore, it is impossible to correct color misalignment in a short time interval since it takes a relatively long time to finish adjusting positions of optical paths after starting color misalignment correcting control.

Second issue is that it is difficult to maintain high-quality imaging just after finishing color misalignment control for a long period of time since sometimes the amount of color misalignment (amount of registration misalignment) changes with time because of a deformation in the optical system and supporting parts due to a change of internal temperature.

A well-known image forming apparatus can resolve the first issue described above (e.g., JP-H8-85236-A). This image forming apparatus transfers toner images of photoconductors for each color on a recording sheet held on a transferring belt that moves endlessly. The image forming apparatus executes following the processes at predefined timing, including transferring a test pattern image that includes test toner images for each color on the transferring belt and acquiring information on forming coordinates of test toner images for each color based on results of detecting test toner images for each color in the test pattern image by sensor. Subsequently, the image forming apparatus converts automatically output coordinate positions of image data for each color into output coordinate positions with corrected registration misalignment based on the amount of registration misalignment decided by the information on forming coordinates and pre-stored standard position coordinates.

Another image forming apparatus that can resolve the first issue is also well-known (e.g., JP-2005-274919-A). This image forming apparatus corrects positions in a main scanning direction and a sub-scanning direction of image data for each color in output coordinates based on results of detecting positions of test toner images for each color in a registration alignment detecting pattern formed on an intermediate transferring belt. Furthermore, one or more of scale in main scanning direction in output coordinate, partial scale in main scanning direction, scale in sub-scanning direction, partial scale in sub-scanning direction, lead skew, side skew, lead linearity, and side linearity are variable.

Also, a well-known image forming apparatus that can resolve the second issue described above executes color misalignment correcting control in case internal temperature changes at a certain amount and executes color misalignment correcting control repeatedly after elapse of a certain amount of time.

However, although this image forming apparatus can form high-quality image just after executing color misalignment correcting control, the image forming apparatus does not take into account amount of color misalignment that changes over time. Also, this image forming apparatus cannot reduce color misalignment due to positional error in direction of movement of photoconductor surface generating in a single rotation cycle of photoconductor at the optical writing position (periodic positional error). More particularly, there is a slight eccentricity in the rotation axis of the photoconductor and a photoconductor gear that rotates with the rotation axis. Due to this eccentricity, linear velocity fluctuates in a sine carve of one period for one rotation of the photoconductor at the optical writing position where optical writing is executed on the photoconductor. Due to this linear velocity fluctuation, periodic positional error is generated in a sine curve of one period for one rotation of photoconductor (periodic positional deviation fluctuation curve) at the optical writing position. If amplitude of positional fluctuation curve (=amount of eccentricity) that characterizes periodic positional error is different from each other or phase differences of positional fluctuation curve do not match for Y, M, C, and K photoconductors, relative position deviation is generated on toner images for each color due to periodic positional error and color misalignment is generated. Therefore, the image forming apparatus cannot form high-quality images.

BRIEF SUMMARY OF THE INVENTION

The present invention provides a novel image forming apparatus and method that facilitates forming high-quality images by taking into account changes in an amount of color misalignment over time and reducing color misalignment due to periodic positional error.

More specifically, the present invention provides an image forming apparatus that includes an image information acquiring unit that acquires image information, a plurality of latent image carriers that rotate and carry latent images on their surface, a plurality of latent image writing units that write latent image on a plurality of latent image carriers respectively, a plurality of developing units that develop latent image on the plurality of latent image carriers respectively, an endless moving member that moves its surface endlessly going through opposed positions against the plurality of latent image carriers sequentially, a transferring unit that superimposes visible images developed on the plurality of latent image carriers respectively on the surface of the endless moving member and transfers the superimposed visible images to a recording sheet or superimposes the visible images on a recording sheet held on the surface of the endless moving member, a data storing unit that stores deviation amount data that indicates superimposing deviation of the visible images on the surface of the endless moving member or the recording sheet, an image detecting unit that detects images formed on the surface of the endless moving member, and a controller that executes a latent image writing process that writes latent images on the plurality of latent image carriers, respectively, and controlling the driving of the latent image writing unit based on corrected image information after executing an image information correcting process that corrects image information acquired by the image information acquiring unit based on deviation amount data stored in the data storing unit to reduce superimposing deviation for latent images to be written on the plurality of latent image carriers, and executes deviation amount data updating process that updates the deviation amount data stored in the data storing unit at a predefined timing based on the result detected by detecting a position detecting image by the image detecting unit after forming a position shift detecting pattern by transferring a predefined position detecting image formed on the surface of the plurality of latent image carriers respectively to the surface of the endless moving member. The image forming apparatus stores periodic fluctuation characteristic data that shows fluctuation characteristic of latent image writing position shift in a direction of movement of the surface of the latent image carrier generated during one rotation period of the latent image carrier at a predefined latent image writing position in the circumferential direction on the surface of the latent image carrier for a plurality of latent image carriers respectively, executes a rotation posture determining process that predetermines rotation posture at writing at the time of starting writing latent image for the plurality of latent image carriers, respectively, and executes an image information correcting process based on the determined rotation posture at writing for the plurality of latent image carriers, respectively, and the deviation amount data and the periodic fluctuation characteristic data stored in the data storing unit.

The present invention can form high-quality images by taking into account changes in color misalignment over time and reducing color misalignment due to factors such as skew difference, registration difference, and periodic positional error by correcting image information.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in conjunction with the accompanying drawings.

DETAILED DESCRIPTION OF THE PREFERRED EMBODIMENTS

Figure 1:
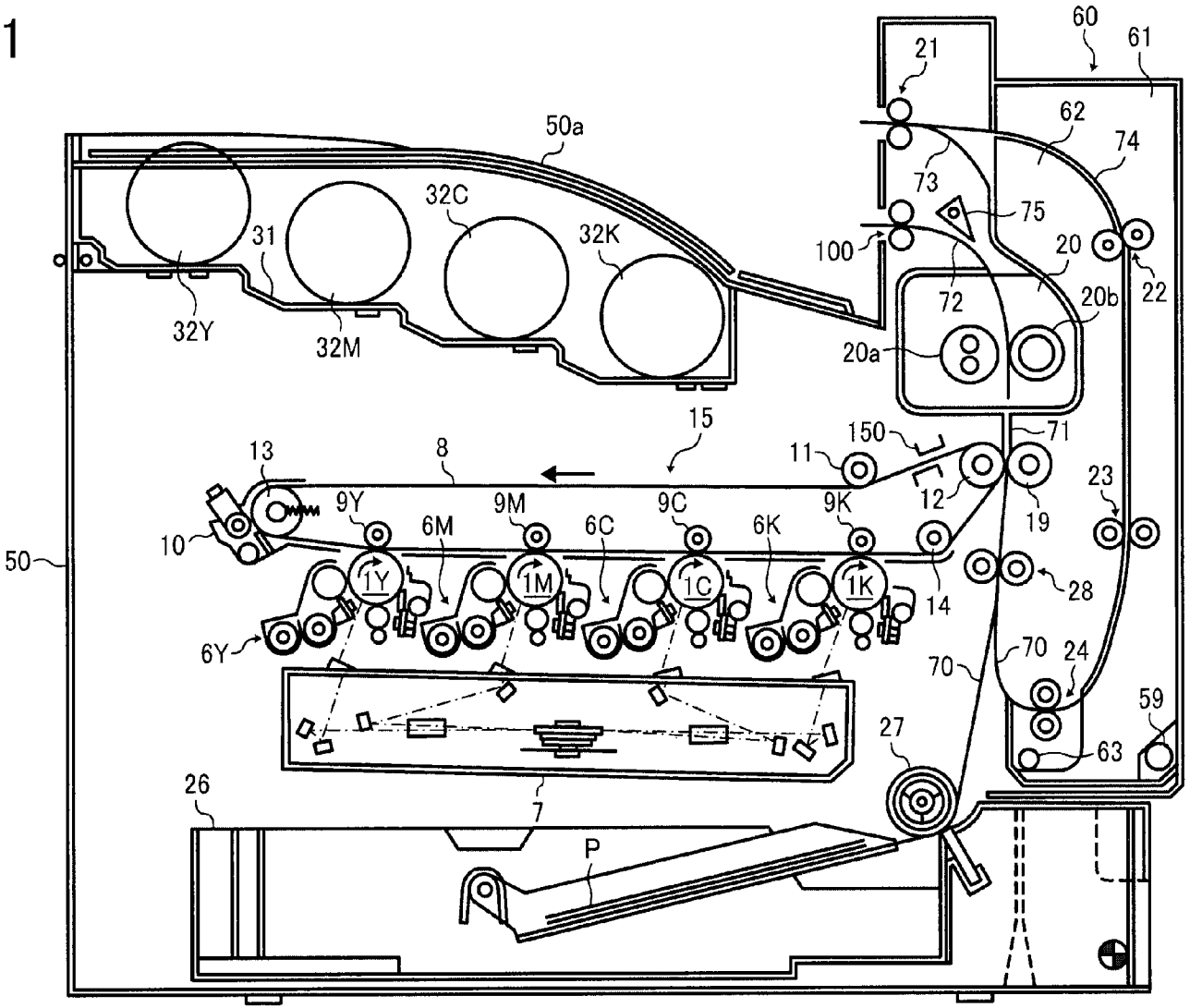
FIG. 1 is a schematic diagram illustrating a mechanism of an image forming apparatus as an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

An embodiment of the present invention will be described in detail below with reference to the drawings. In this embodiment, a description is given of an example of an electrophotographic image forming apparatus.

Figure 2:
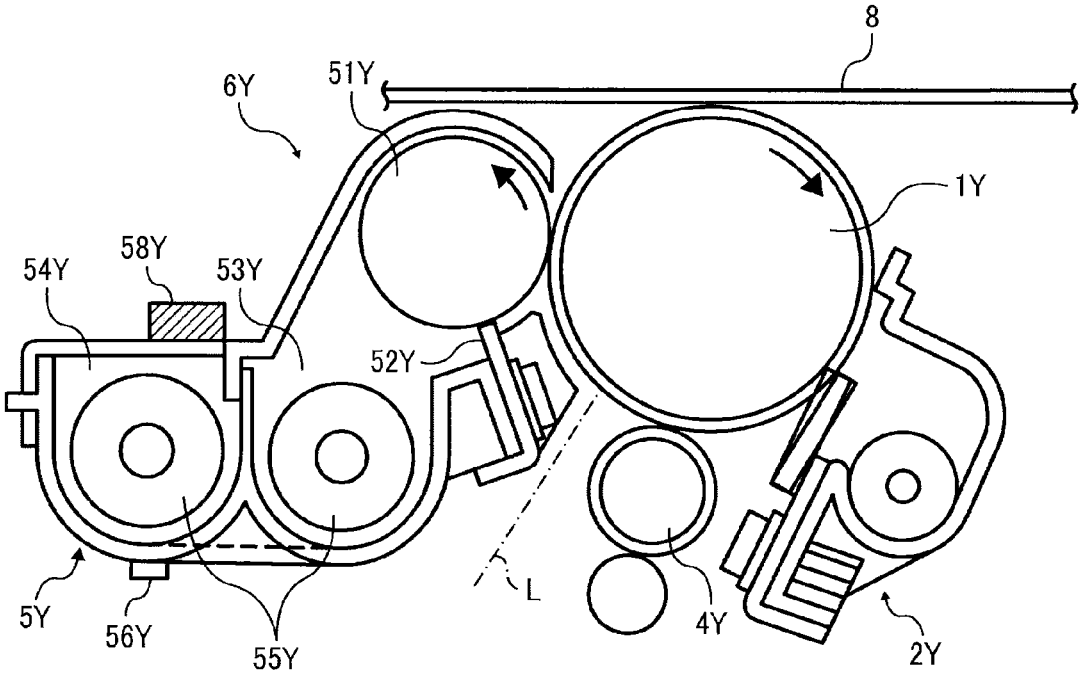
FIG. 2 is an enlarged view illustrating a mechanism of an imaging unit for Y of the image forming apparatus as an embodiment of the present invention

First, a basic configuration of an image forming apparatus is described. A schematic diagram illustrating a mechanism of an image forming apparatus is shown in FIG. 1. The image forming apparatus in FIG. 1 includes four image forming units 6Y, 6M, 6C, and 6K that generates toner image yellow (Y), magenta (M), cyan (C), and black (K) respectively. These image forming units have the same configuration except using toner in different color as color material, and are exchanged at the end of their lives. Taking the image forming unit 6Y that forms Y toner image as an example, it includes a photoconductor drum 1Y as a latent image carrier, a drum cleaning unit 2Y, a neutralizing unit (not shown), a charging unit 4Y, a developing unit 5Y etc. as shown in FIG. 2. The image forming unit 6Y as imaging method is set and unset in the main unit of the image forming apparatus in unit shape.

The charging unit 4Y charges the surface of the photoconductor drum 1Y rotated clockwise by a driving unit (not shown.) The surface of the charged photoconductor drum 1Y holds electrostatic latent image for Y after exposure scanning by laser light L. This electrostatic latent image for Y becomes Y toner image after developed by the developing unit 5Y using Y developer that includes Y toner and magnetic carrier. Subsequently, the Y toner image is transferred primary on an intermediate transferring belt 8 described later. The drum cleaning unit 2Y removes residual toner on the surface of the photoconductor drum 1Y after the primary transferring. Also, the neutralizing unit described above neutralizes the photoconductor drum 1Y after the cleaning. This neutralization initializes the surface of the photoconductor drum 1Y, and the photoconductor drum is prepared for forming the next image. At other image forming units (6M, 6C, and 6K), M, C, and K toner image is formed on the photoconductor drum 1M, 1C, and 1K respectively, and transferred primary on the intermediate transferring belt 8.

The developing unit 5Y includes a developing roller 51Y exposed partially from the aperture of its casing, two carrying screws 55Y layout parallel, a doctor blade 52Y, and a toner concentration sensor 56Y etc.

Y developer that includes magnetic carrier and Y toner (not shown) is contained in the casing of the developing unit 5Y. This Y developer is agitated and carried by two carrying screws 55Y while being charged frictionally, and held on the surface of the developing roller 51Y. After regulating the layer thickness by the doctor blade and being carried to the development area opposed to the photoconductor drum 1Y for Y, Y toner is attached to the electrostatic latent image on the photoconductor drum 1Y, and this forms Y toner image on the photoconductor drum 1Y. The Y developer consumes Y toner by developing at the developing unit 5Y, and is returned to the inside of the casing along with the rotation of the developing roller 51Y.

There is a partitioning wall between two carrying screws 55Y. This partitioning wall divides a first supplying unit 53Y that contains the developing roller 51Y and the right carrying screw 55Y etc., and a second supplying unit 54Y that contains the left carrying screw 55Y inside the casing. The right carrying screw 55Y rotates driven by a driving unit (not shown) and supplies Y developer to the developing roller 51Y with carrying the Y developer from front to back. After being carried to the end of the first supplying unit 53Y by the right carrying screw 55Y, the Y developer goes into the second supplying unit 54Y through aperture (not shown). The left carrying screw 55Y rotates driven by a driving unit (not shown) and carries the Y developer sent from the first supplying unit 53Y to the opposite direction of the right carrying screw 55Y. After being carried to the end of the second supplying unit 54Y by the left carrying screw 55Y, the Y developer goes back to the first supplying unit 53Y through another aperture (not shown) on the partitioning wall.

The toner concentration sensor 56Y that constitutes of a magnetic permeability sensor is set on a bottom wall of the second supplying unit 54Y, and outputs a voltage value in response to the magnetic permeability of Y developer that passes above the toner concentration sensor 56Y. Since the magnetic permeability of binary developer that includes toner and magnetic carrier correlates well with toner concentration, the toner concentration sensor 56Y outputs a voltage value that corresponds to Y toner concentration. This output voltage value is sent to a controller (not shown.) This controller includes RAM that stores target value of output voltage from the toner concentration sensor 56Y, Vtref for Y. This RAM also stores target values of output voltage from other toner concentration sensors (not shown), Vtref for M, Vtref for C, and Vtref for K. The Vtref for Y is used to control driving of toner carrying unit for Y described later. Specifically, the controller described above controls driving of a toner carrying unit for Y (not shown) so that it brings output voltage value from the toner concentration sensor 56Y close to Vtref for Y, and supplies Y toner to inside of the second supplying unit 54Y. This keeps Y toner concentration in Y developer contained in the developer 5Y within predefined range. The same kind of supply controlling is executed in other developers that uses toner carrying unit for M, C, and K respectively.

In FIG. 1, there is an optical writing unit 7 under the image forming unit 6Y, 6M, 6C and 6K. As latent image forming unit, the optical writing unit 7 executes light scanning on photoconductors in the image forming unit 6Y, 6M, 6C, and 6K respectively by laser beam L generated based on image information. By this light scanning, electrostatic latent images for Y, M, C, and K on the photoconductors 1Y, 1M, 1C, and 1K respectively. It should be noted that the optical writing unit 7 illuminates laser beam (L) generated by a laser source on photoconductor through a plurality of optical lenses and mirrors scanning by polygon mirror rotated and driven by a motor.

There is a sheet containing unit that includes a sheet containing cassette 26 and a built-in feeding roller 27 under the optical writing unit 7. The sheet containing cassette 26 contains a plurality of stacked recording sheets P as sheet-like recording media, and the feeding roller 27 contacts the top recording sheet P. When driving unit (not shown) rotates the feeding roller 27 anticlockwise, the top recording sheet P is sent toward a sheet supplying route 70.

There is a pair of registration rollers 28 around the end of the sheet supplying route 70. The pair of registration rollers 28 rotates, pinching the recording sheet P and then pausing. Subsequently, the pair of registration rollers 28 rotates again at appropriate timing and sends the recording sheet to secondary transferring nip described later.

There is a transferring unit 15 that stretches the intermediate transferring belt 8 and moves it endlessly above the image forming unit 6Y, 6M, 6C, and 6K in FIG. 1. The transferring unit 15 also includes a secondary transferring bias roller 19, a cleaning unit 10, four primary transferring bias rollers 9Y, 9M, 9C, and 9K, a driving roller 12, a cleaning backup roller 13, and a secondary transferring nip entrance roller 14. The intermediate transferring belt 8 is hung on these seven rollers and moved endlessly rotating anticlockwise driven by the driving roller 12.

The primary transferring bias roller 9Y, 9M, 9C, and 9K forms primary transferring nip between the intermediate transferring belt 8 moving endlessly and the photoconductors 1Y, 1M, 1C, and 1K respectively. Primary transferring bias negative to toner (e.g., plus) applied on these primary transferring bias rollers. All rollers except the primary transferring bias roller 9Y, 9M, 9C, and 9K are grounded electrically.

As the intermediate transferring belt 8 goes through primary transferring nip for Y, M, C, and K sequentially, Y, M, C, and K toner image on the photoconductor 1Y, 1M, 1C, and 1K respectively is imposed and primary transferred on the intermediate transferring belt 8. A four-colors-imposed toner image (four colors toner image hereinafter) is formed on the intermediate transferring belt 8 by these processes.

The driving roller 12 forms a secondary transferring nip between a secondary transferring bias roller 19 and the intermediate transferring belt 8. The four colors toner image formed on the intermediate transferring belt 8 is transferred to the recording sheet P at this secondary transferring nip, and this process produces a full color toner image in cooperation with the white color of the recording sheet P.

After going through the secondary transferring nip, there is residual toner not transferred to the recording sheet P on the intermediate transferring belt 8. The cleaning unit 10 cleans the intermediate transferring belt 8 of the residual toner. After the four colors toner image is transferred secondary en bloc at the secondary transferring nip, the recording sheet P is sent to a fixing unit 20 via post transfer carrying route 71.

The fixing unit 20 forms a fixing nip between a fixing roller 20*a* that includes a heat source such as a halogen lamp and a pressure roller 20*b* that rotates contacting with the fixing roller 20*a* at a predefined pressure. After being sent to the fixing unit 20, the recording sheet P is wedged between the fixing nip pressing its unfixed toner image holding side to the fixing roller 20*a*. Subsequently, the full color image is fixed by softening toner in the toner image affected by heating and pressing.

After fixing the full color image in the fixing unit 20 and going out of the fixing unit 20, the recording sheet P gets to an interchange point to an ejecting route 72 and a carrying route before reversing 73. There is a swingable first switching hook 75 at the interchange point, and the first switching hook 75 switches the course of the recording sheet P by swinging. Specifically, the recording sheet P proceeds to the ejecting route 72 by moving the tip of the hook toward the carrying route before reversing 73. By contrast, the recording sheet P proceeds to the carrying route before reversing 73 by moving the tip of the hook away from the carrying route before reversing 73.

If the course toward the ejecting route 72 is selected by the first switching hook 75, the recording sheet P is ejected to the outside of the image forming apparatus and stacked on a stacking unit 50*a* on top of the image forming apparatus case. By contrast, if the course toward the carrying route before reversing 73 is selected by the first switching hook 75, the recording sheet P goes into nip between a pair of reversing rollers 21. The pair of reversing rollers 21 carry the recording sheet P sandwiched in the rollers toward the stacking unit 50*a*, and reverse the rollers just before entering rear-end of the recording sheet P into the nip. The recording sheet P is carried backward by this reversing, and the rear-end of the recording sheet enters into a reverse carrying route 74.

The reverse carrying route 74 curves downward, and includes a pair of first reverse carrying rollers 22, a pair of second carrying rollers 23, and a pair of third carrying rollers 24 inside the route. The recording sheet P is turned upside down by being carried going through those nips between the pair of rollers. After being turned upside down, the recording sheet P returns to the sheet supplying route 70 described above and gets to the secondary transferring nip again. This time the recording sheet P enters into the secondary transferring nip pressing its no image holding side to the intermediate transferring belt 8, and the second four colors toner image on the intermediate transferring belt 8 is secondary transferred to the no image holding side en bloc. Subsequently, the recording sheet P goes through a post transfer carrying route 71, the fixing unit 20, the ejecting route 72, and a pair of ejecting rollers 100, and is stacked on the stacking unit 50*a* outside the image forming apparatus. The full color image is formed on both sides of the recording sheet P by going through these reverse carrying.

There is a bottle supporting unit 31 between the transferring unit 15 and the stacking unit 50*a*. This bottle supporting unit 21 includes toner bottles 32Y, 32M, 32C, and 32K that contains Y, M, C, and K toner respectively. Y, M, C, and K toner in the toner bottles 32Y, 32M, 32C, and 32K is supplied to developing unit in the image forming unit 6Y, 6M, 6C, and 6K accordingly. These toner bottles 32Y, 32M, 32C, and 32K are mountable and unmountable independently from the image unite 6Y, 6M, 6C, and 6K.

Figure 3:
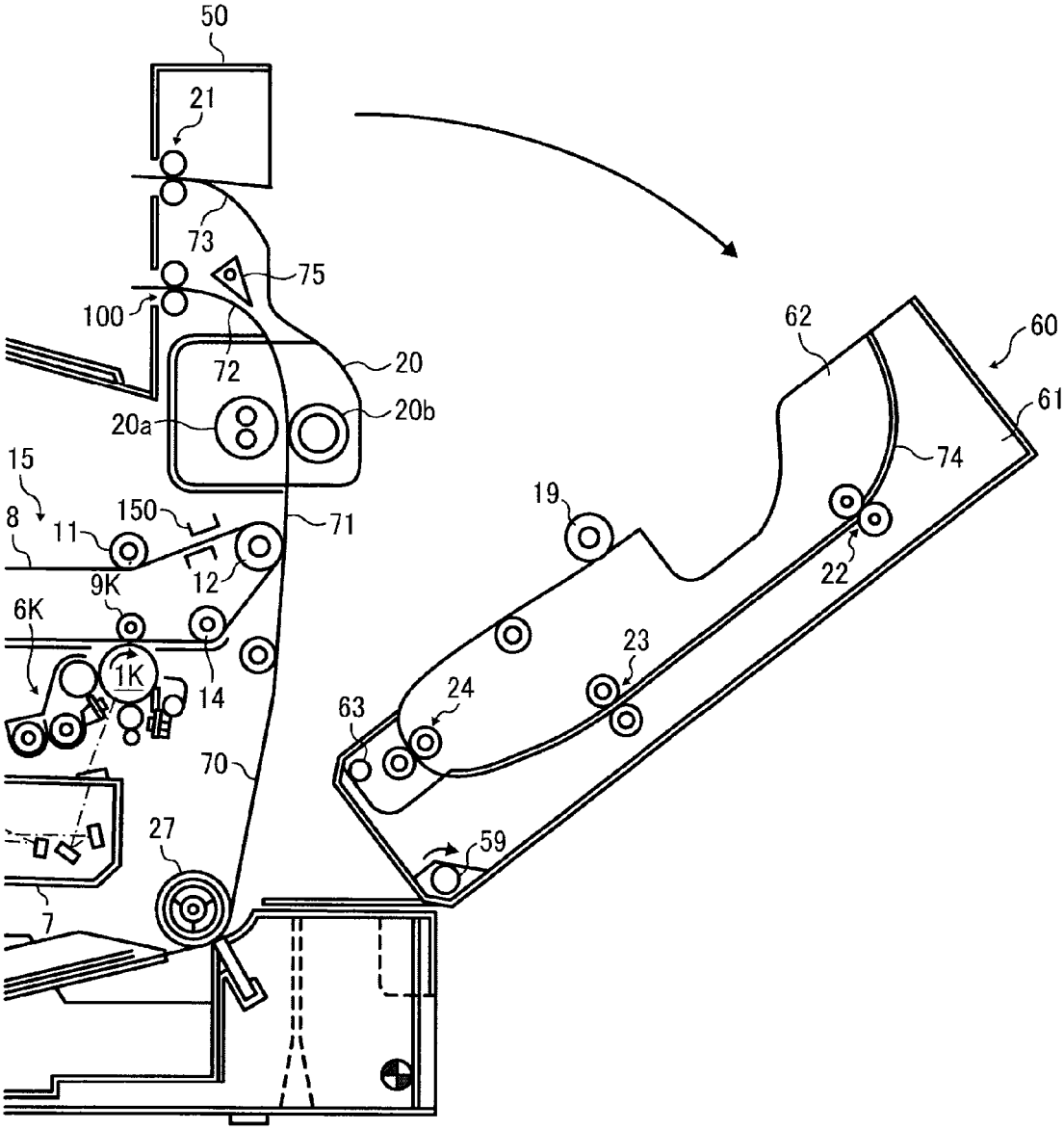
FIG. 3 is a partial diagram illustrating a movement of opening and closing a cover of the image forming apparatus as an embodiment of the present invention.

The reverse carrying route 74 is formed inside an opening and closing door, and this opening and closing door includes an outer cover 61 and a swing supporting unit 62. Specifically, the outer cover 61 of the opening and closing door is supported so that it turns around a first turning axis 59 in the case 50 of the image forming apparatus. By this turning, the outer cover 61 opens and closes aperture (not shown) of the case 50. Also, as shown in FIG. 3, the swing supporting unit 62 exposes to outside by opening the outer cover 61, and is supported by the outer cover so that it turns around a second turning axis 63 on the outer cover 61. By this turning, the reverse carrying route 74 is exposed by swinging the swing supporting unit 62 against the outer cover opened from the body 50 and separating the outer cover 61 and the swing supporting unit 62. Jammed sheet in the reverse carrying route 74 is removed easily by exposing the reverse carrying route 74 as described above.

Figure 4:
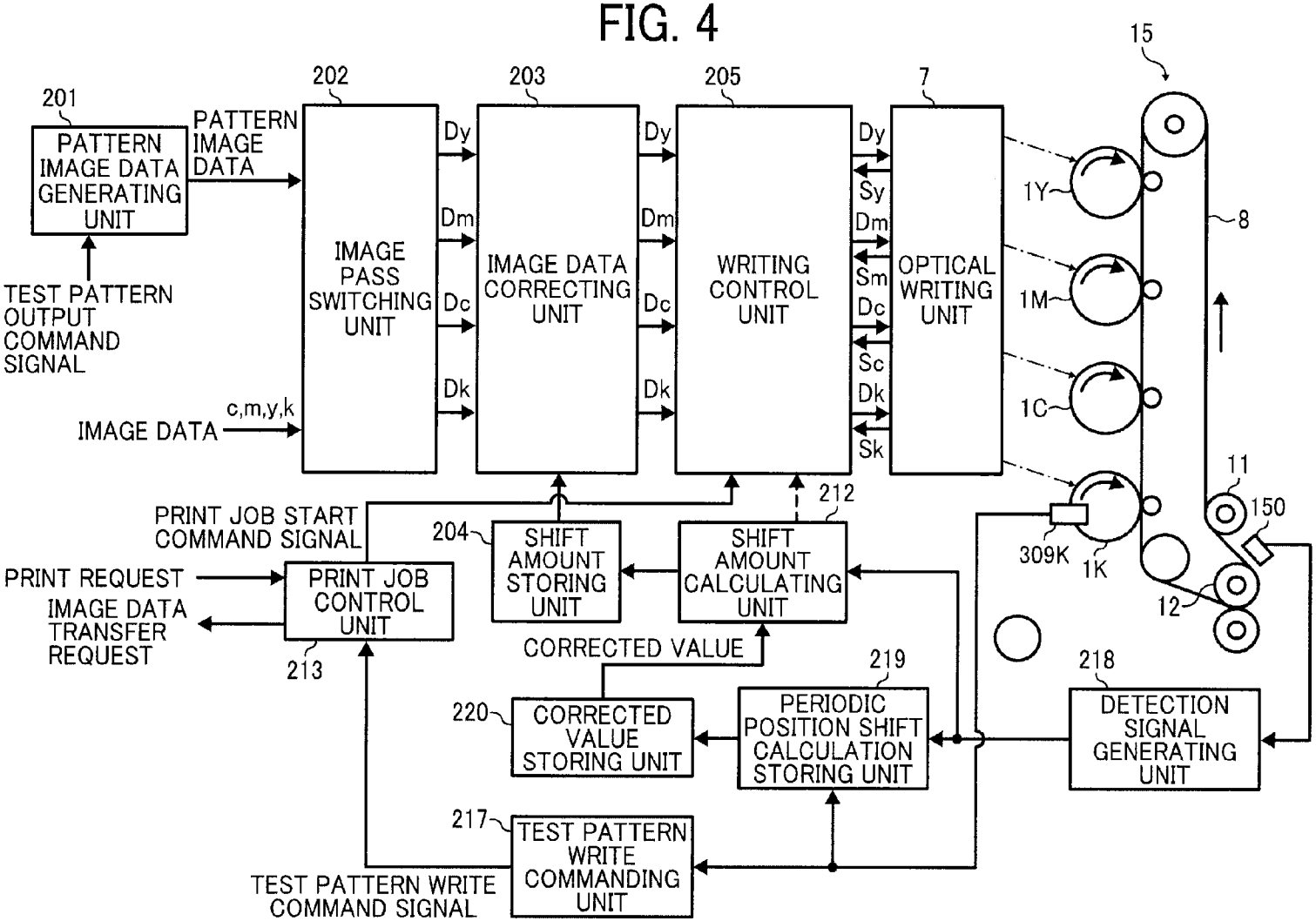
FIG. 4 is a diagram illustrating photoconductors and transferring units for Y, M, C, and K with a part of electrical circuit of the image forming apparatus as an embodiment of the present invention.

FIG. 4 is a diagram illustrating the photoconductors 1Y, 1M, 1C, and 1K and the transferring units 15 for Y, M, C, and K with a part of electrical circuit. This image forming apparatus includes controller that constitutes of a pattern image data generating unit 201, an image pass switching unit 201, an image data correcting unit 203, a deviation amount storing unit 204, a writing control unit 205, a deviation amount calculating unit 212, a print job controller 213, a test pattern writing supporting unit 217, a detection signal generating unit 218, a periodic position shift calculation storing unit 219, and a correcting value storing unit 220.

After receiving a test pattern output command signal (described later), the pattern image data generating unit 1 sends pattern image data for forming test pattern image to the image pass switching unit 202. The test pattern image is pattern image for detecting position shift (described later) or liner velocity variation detecting pattern image.

The image path switching unit 202 switches color image data sent from external devices such as personal computers and scanners (not shown) and pattern image data sent from the pattern image data generating unit 201, and outputs it. The image path switching unit 202 separates the received image data into color separation image data for Y, M, C, and K and outputs it instead of transferring the received image data as is.

If the color separation image data Y, M, C, and K sent to the image data correcting unit 203 from the image path switching unit 202 is made from color image data sent from an external device, the image data correcting unit 203 executes image information correcting process to reduce registration difference and skew difference (described later), and outputs the corrected color separation image data for Y, M, C, and K to the writing control unit 205. The image information correcting process is executed based on data on registration difference amount and skew difference amount stored in the deviation amount storing unit 204 (described above). By contrast, if the color separation image data Y, M, C, and K is made from the pattern image data, the image data correcting unit 203 corrects those color separation image data as normal image data, corrects those color separation image data in different way from normal image data, or does not correct, and outputs it. These correcting processes are described in detail later.

The optical writing unit 7 includes a synchronizing signal generating unit that generates first scanning synchronizing signal for Y, M, C, and K, and outputs it at the timing of detecting laser beam for Y, M, C, and K at one end position in the direction of first scanning respectively.

The print job controller 213 outputs a print job starting command signal for instructing starting forming image for each page and test pattern image to the writing control unit 205. It should be noted that an operation to output image for one recording sheet and test pattern image is called a print job in this embodiment.

The optical writing unit 7 includes a synchronizing signal generating circuit (not shown) that generates slow scanning synchronizing signal for Y, M, C, and K based on writing time-lag among each color determined by the distance between photoconductors and linear velocity of the intermediate transferring belt 8 on the basis of receiving timing of print job starting command signal sent from the print job controller 213. The optical writing unit 7 also includes a pixel clock generating unit (not shown.) Accordingly, the optical writing unit 7 executes optical writing on photoconductors 1Y, 1M, 1C, and 1K for Y, M, C, and K respectively on pixel line in direction of first scanning by optical writing necessary dots on the pixel line by generating modulating signal for laser diode based on pixel clock at the timing of synchronizing with first scanning and slow scanning. By executing optical writing described above, electrostatic latent image for forming color image and test pattern image is written on the photoconductors 1Y, 1M, 1C, and 1K for Y, M, C, and K respectively.

Figure 5:
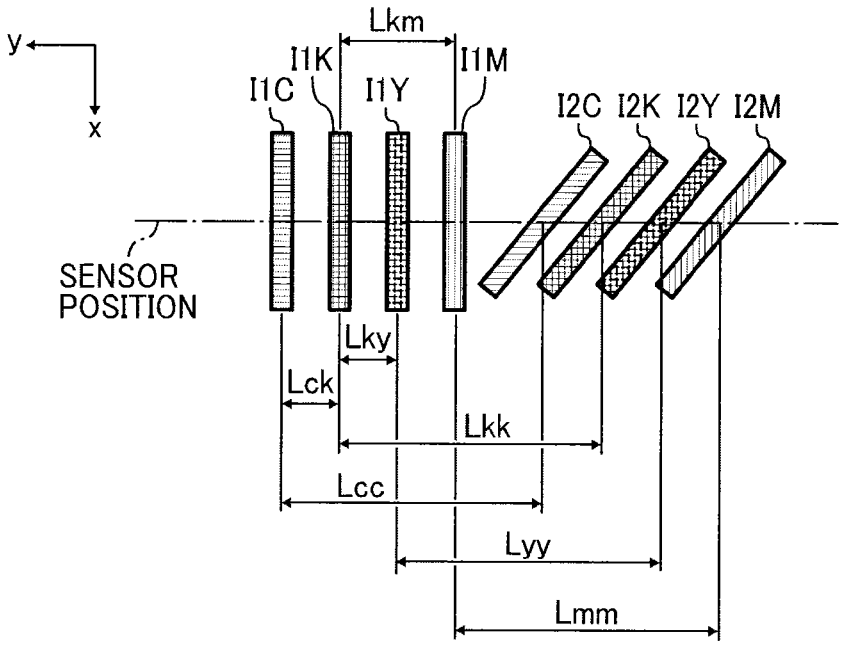
FIG. 5 is an enlarged view illustrating a pattern image for detecting position shift as an embodiment of the present invention.

The controller executes deviation amount data updating process at predefined periodic timing. In this deviation amount data updating process, the controller forms pattern image for detecting position shift shown in FIG. 5 on one end, center and the other end of the intermediate transferring belt 8 in the sub-scanning direction. Each pattern image for detecting position shift includes first position detecting images I1C, I1K, I1Y, and I1M, and second position detecting images I2C, I2K, I2Y, and I2M laid out at predefined interval in the sub-scanning direction. In FIG. 5, arrow x direction is the main scanning direction (photoconductor axis direction), and arrow y direction is the sub-scanning direction (photoconductor surface direction of movement.) While the first position detecting images I1C, I1K, I1Y, and I1M are formed extending in the main scanning direction x, the second position detecting images I2C, I2K, I2Y, and I2M are formed in the tilted position for 45 degrees from the main scanning direction x.

In FIG. 4, an optical sensor unit 150 is placed opposite an area between the driving roller 12 and the pressing roller 11 on the outer surface of the intermediate transferring belt 8. This optical sensor 150 includes a first optical sensor opposite one end of the intermediate transferring belt 8 in the main scanning direction, a second optical sensor opposite the center of the intermediate transferring belt 8 in the main scanning direction, and a third optical sensor opposite the other end of the intermediate transferring belt 8 in the main scanning direction.

Figure 6:
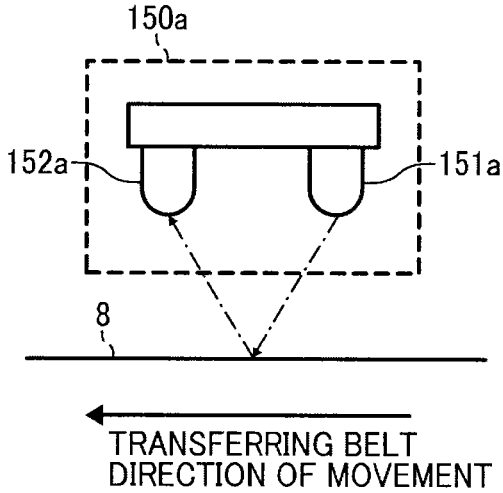
FIG. 6 is an enlarged view illustrating a first optical sensor of the image forming apparatus as an embodiment of the present invention.

FIG. 6 is an enlarged view illustrating the first optical sensor 150*a*. The first optical sensor 150*a* includes an emitting unit 151*a* that emits light onto the outer surface of the intermediate transferring belt 8, and a photodetector 152*a* that receives reflection from the outer surface of the belt and outputs signal that corresponds to the amount of received light. Relatively much light is reflected from the area where the position detecting image is not formed (i.e. toner is not attached) on the outer surface of the intermediate transferring belt 8. By contrast, reflection is reduced from the area where the position detecting image is formed (i.e. toner is attached). Accordingly, the position detecting images are detected based on reduced reflection. It should be noted that the first optical sensor 150*a* can also detect a plurality of test images included in linear velocity variation pattern (described later) other than detecting the position detecting images described above.

The second optical sensor and the third optical sensor are also configured in the same way as the first optical sensor. Output signals from each optical sensor are sent to the detection signal generating unit 218. The detection signal generating unit includes an analog-digital converter that converts analog signal sent from the photodetector to digital signal, and detects the position detecting images and test images based on result that the converted digital value falls below the predefined threshold value. Subsequently, the detection signal generating unit 218 outputs a detection signal immediately to the registration difference amount calculating unit 212 and the periodic position shift calculating and storing unit 219.

As examples of position shift of images for each color, skew difference due to tinting posture of Y, M, and C toner image against criterial color K toner image, registration difference in the sub-scanning direction due to deviating forming position of Y, M, and C toner image in the sub-scanning direction en bloc against forming position of K toner image, deviation due to whole magnification error in the main scanning direction, registration difference in the main scanning direction, and position shift in the sub-scanning direction due to periodic position error at optical writing position on the photoconductors 1Y, 1M, 1C and 1K (hereinafter sub-scanning direction periodic position shift). Registration difference in the sub-scanning direction is a phenomenon in which forming position of whole toner image deviates from regular position in the sub-scanning direction. Even if registration difference occurs, relationship of relative position in toner image among each pixel that constitutes the toner image remains relationship of regular position. By contrast, sub-scanning direction periodic position shift is a phenomenon in which relation of relative position in toner image among each pixel that constitutes the toner image deviates from relationship of regular position due to periodic position error of photoconductors. Even if whole toner image is formed on regular position without occurring registration difference, relationship of relative position in toner image among each pixel that constitute the toner image deviates from relationship of regular position due to periodic position error in case periodic position error of photoconductors occurs. It should be noted that the method to calculate deviation amount described above based on timing of detecting each position detecting image of pattern image for detecting position shift is explained in other documents in detail (e.g., JP-2004-101567-A.)

$L_{ck}$ is a symbol that shows CK distance between the C first position detecting image I1C and the K first position detecting image I1K. Likewise, $L_{ky}$ is KY distance between the K first position detecting image I1K and the Y first position detecting image I1Y, and $L_{km}$ is KM distance between the K first position detecting image I1K and the M first position detecting image I1M (not shown).

$L_{kk}$ is a symbol that shows KK distance between the K first position detecting image I1K and the K second position detecting image I2K. Also, $L_{cc}$ is a symbol that shows CC distance between the C first position detecting image I1C and the C second position detecting image I2C. Likewise, $L_{yy}$ is YY distance between the Y first position detecting image I1Y and the Y second position detecting image I2Y, and $L_{mm}$, is MM distance between the M first position detecting image I1M and the M second position detecting image I2M (not shown).

The deviation amount calculating unit 212 calculates CK distance $L_{ck}$, KY distance $L_{ky}$, KM distance $L_{km}$, CC distance $L_{cc}$, KK distance $L_{kk}$, YY distance $L_{yy}$, and MM distance $L_{mm}$ based on the timing of sending detection signals on various position detecting images from the detection signal generating unit 218.

Hereinafter, design value of CK distance $L_{ck}$ is referred to as a first standard distance $L_{1ref}$. Design value of KY distance $L_{ky}$ is also the first standard distance $L_{1ref}$ just like CK distance $L_{ck}$. Also, design value of KM distance $L_{km}$ is twice as long as the first standard distance $L_{1ref}$.

If subscript "$_a$" is added to a distance symbol below, it shows that symbol is a number related to image detected by the first optical sensor 150*a* located at one end in the horizontal direction of the belt among the three optical sensors described above. If subscript "$_b$" is added to a distance symbol below, it shows that symbol is a number related to image detected by the second optical sensor located at the center in the horizontal direction of the belt among the three optical sensors described above. If subscript "$_c$" is added to a distance symbol below, it shows that symbol is a number related to image detected by the third optical sensor located at the other end in the horizontal direction of the belt among the three optical sensors described above.

C skew difference against K $d_c$ can be obtained from the following equation:

$$d_c=(L_{ck_c}-L_{ck_a})/L_{ac}$$

It should be noted that $L_{ac}$ is distance between the first optical sensor and the third optical sensor in the main scanning direction. Likewise, Y skew difference against K $d_y$ can be obtained from the following equation:

$$d_y=(L_{ky_c}-L_{ky_a})/L_{ac}$$

Also, M skew difference against K $d_m$ can be obtained from the following equation:

$$d_m=(L_{km_c}-L_{km_a})/L_{ac}$$

C registration difference in the sub-scanning direction against K $f_c$ can be obtained from the following equation:

$$f_c=\{(0.25L_{ck_a}+0.5L_{ck_b}+0.25L_{ck_c})-L_{1ref}\}K$$

It should be noted that K is coefficient that converts distance unit mm to pixel unit dot. For example, if resolution is 1200 dpi, 1200 divided by 25.4 is K. Likewise, Y registration difference against K $f_y$ can be obtained from the following equation:

$$f_y=\{(0.25L_{ky_a}+0.5L_{ky_b}+0.25L_{ky_c})-L_{1ref}\}K$$

Also, M registration difference against K $f_m$ can be obtained from the following equation:

$$f_m=\{(0.25L_{km_a}+0.5L_{km_b}+0.25L_{km_c})-2L_{1ref}\}K$$

It should be noted that in case optical sensors are located only at areas outside of the image forming area, distance related to the second optical sensor can be omitted from the equation, and distance coefficients related to the first optical sensor and the third optical sensor need to be changed from 0.25 to 0.5. That is, C registration difference against K $f_c$ can be obtained from the following equation:

$$f_c=\{(0.5L_{ck_a}+0.5L_{ck_c})-L_{1ref}\}K$$

C whole magnification error deviation against K in the main scanning direction $a_c$ can be obtained from the following equation:

$$a_c=\{(L_{cc_c}-L_{kk_c})-(L_{cc_a}-L_{kk_a})\}/L_{ac}$$

Y whole magnification error deviation against K in the main scanning direction $a_y$ can be obtained from the following equation:

$$a_y=\{(L_{yy_c}-L_{kk_c})-(L_{yy_a}-L_{kk_a})\}/L_{ac}$$

M whole magnification error deviation against K in the main scanning direction $a_m$ can be obtained from the following equation:

$$a_m=\{(L_{mm_c}-L_{kk_c})-(L_{mm_a}-L_{kk_a})\}/L_{ac}$$

C registration difference in the main scanning direction against K $c_c$ can be obtained from the following equation:

$$c_c=\{(L_{cc_a}L_{kk_a})\}K$$

It should be noted that $L_{bd}$ is distance between a detecting unit that detects first scanning synchronizing signal and the first optical sensor in the main scanning direction. Term $L_{bd}*a_c$ is position shift generated by whole magnification error in the horizontal direction in time that scanning light moves from the detecting unit to the position of the first optical sensor.

Y registration difference in the main scanning direction against K $c_y$ can be obtained from the following equation:

$$c_y=\{(L_{yy_a}-L_{kk13\,a})-L_{bd}*a_y)\}K$$

M registration difference in the main scanning direction against K $c_m$ can be obtained from the following equation:

$$c_m=\{(L_{mm_a}-L_{kk_a})-L_{bd}*a_m)\}K$$

The image forming apparatus of this embodiment corrects superimposing deviation of each color by not mechanical method such as face tangle error correction of optical system mirror but image information correcting process. In image information correcting process, based on various deviation amount data stored in the deviation amount storing unit 204, shape and position of the image is corrected so that those deviation amount are canceled. The image forming apparatus of this embodiment adopts a method that uses image data of pattern image for detecting position shift to form pattern after correcting just like normal image data.

In the method that uses image data of pattern image for detecting position shift to form pattern after correcting just like normal image data, the image data correcting unit 203 substitutes a' (main scanning direction magnification error), c (main scanning direction registration difference), d (skew difference), f (sub-scanning direction registration difference), and e (sub-scanning direction magnification error) in equation 2 (described later) and calculates inverse matrix $A^{-1}$. By multiplying sub-scanning direction magnification error e due to periodic position error, coordinates in the sub-scanning direction is converted to position that can cancel periodic position error. By coordinate conversion based on the inverse matrix $A^{-1}$, four color separation image data in the image data of position shift detecting pattern can be corrected respectively. While various deviation of pattern image for detecting position shift formed based on color separation image data after the correction are corrected basically, new deviation is generated in the pattern image for detecting position shift if temperature variation occurs with time. Parameters a' (main scanning direction magnification error), c (main scanning direction registration difference), d (skew difference), and f (sub-scanning direction registration difference) detected based on the timing of detecting various position detecting image with the pattern image for detecting position shift have been generated newly even after correcting the image data based on values stored in the deviation amount storing unit 204. That is, those parameters are shift variation amounts. Consequently, parameters a' (main scanning direction magnification error), c (main scanning direction registration difference), d (skew difference), and f (sub-scanning direction registration difference) can be updated by adding newly detected parameters a' (main scanning direction magnification error), c (main scanning direction registration difference), d (skew difference), and f (sub-scanning direction registration difference) to values stored in the deviation amount storing unit 204 respectively.

(x,y) indicates coordinate system of respective pixels in color separation image data input in the image data correcting unit 203 hereinafter. (x',y') indicates coordinate system of respective pixels in color separation image data corrected by the image data correcting unit 203 hereinafter. (x",y") indicates coordinate system of respective pixels in image transferred to the surface of the intermediate transferring belt 8.

Based on each element of various deviation amount of C, Y, and M against K, deviation generated in downstream of processing flow than the writing controller 208 is denoted by the following coordinate converting equation respectively:

$$\begin{pmatrix} x'' \\ y'' \\ 1 \end{pmatrix} = A \cdot \begin{pmatrix} x' \\ y' \\ 1 \end{pmatrix} \quad \text{[Equation 1]}$$

Matrix A in above equation is calculated by the following equation:

$$A = \begin{pmatrix} a' & 0 & c \\ d & e & f \\ 0 & 0 & 1 \end{pmatrix} \quad \text{[Equation 2]}$$

It should be noted that whole magnification error deviation $a_c$, $a_y$, and $a_m$ are due to whole magnification error in the main scanning direction, and whole magnification in the main scanning direction are $a'_c=1+a_c$, $a'_y=1+a_y$, and $a'_m=1+a_m$ respectively. The image data correcting unit 203 calculates inverse matrix $A^{-1}$ (hereinafter referred to as color misalignment correcting matrix) of matrix A (hereinafter color misalignment converting matrix) in equation 1 referring to various deviation amount for each color, and executes following coordinate converting:

$$\begin{pmatrix} x' \\ y' \\ 1 \end{pmatrix} = A^{-1} \cdot \begin{pmatrix} x \\ y \\ 1 \end{pmatrix} \quad \text{[Equation 3]}$$

$$\begin{pmatrix} x'' \\ y'' \\ 1 \end{pmatrix} = A \cdot A^{-1} \cdot \begin{pmatrix} x \\ y \\ 1 \end{pmatrix} \quad \text{[Equation 4]}$$

$$\begin{pmatrix} x'' \\ y'' \\ 1 \end{pmatrix} = \begin{pmatrix} x \\ y \\ 1 \end{pmatrix} \quad \text{[Equation 5]}$$

Figure 7:
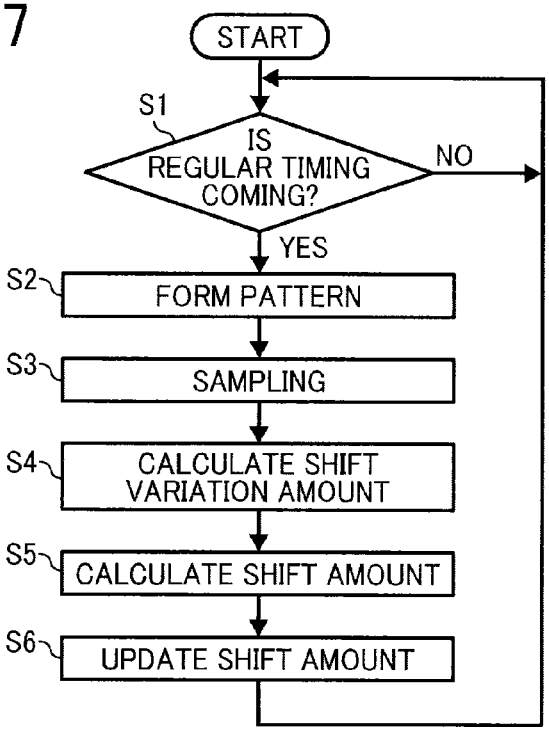
FIG. 7 is a flowchart illustrating deviation amount data updating process executed by controller of the image forming apparatus as an embodiment of the present invention.

FIG. 7 is a flowchart illustrating a deviation amount data updating process. It is assumed that, to execute this process, a' (main scanning direction magnification error), c (main scanning direction registration difference), d (skew difference), f (sub-scanning direction registration difference), and e (sub-scanning direction magnification error) are stored in the deviation amount storing unit 204. First, the controller determines whether or not regular timing as trigger to execute deviation amount data updating process such as number of output sheets in consecutive print jobs has come (S1). Subsequently, the controller executes processes below S2 only if regular timing has come(Y in S1).

After regular timing has come, firstly pattern image for detecting position shift is formed (S2). In this process, various image for detecting position is formed using color separation image data for Y, M, C, and K corrected by the image data correcting unit 203 based on a' (main scanning direction magnification error), c (main scanning direction registration difference), d (skew difference), f (sub-scanning direction registration difference), and e (sub-scanning direction magnification error) stored in the deviation amount storing unit 204. After forming pattern image for detecting position shift, various deviation amount values ($d_c$, $d_y$, $d_m$, $f_c$, $f_y$, $f_m$, $a_c$, $a_y$, $a_m$, $c_c$, $c_y$, and $c_m$) are calculated based on sampling result (S4) after sampling the timing of detecting various images for detecting position in the pattern by the optical sensor (S3). While basically various deviation amount data stored in the deviation amount storing unit 204 can be updated by adding shift variation amount respectively, it is possible that just adding those values makes the data inappropriate since sensing error (noise) of the optical sensor could be included in deviation amount calculated based on one pattern image for detecting position shift.

In deviation amount updating process (S5, S6), for example, whole magnification error deviation $a_c$, $a_y$, and $a_m$ can be corrected by using following equation:

$$a_{(n)}=a_{(n-1)}+K_p\times\Delta a_{(n)}$$

In the equation above, $a_{(n)}$ is the updated whole magnification error deviation ($a_c$, $a_y$, and $a_m$). Also, $a_{(n-1)}$ is data stored in the deviation amount storing unit 204. $\Delta a_{(n)}$ is newly detected whole magnification error deviation (shift variation amount) based on the result of detecting pattern image for detecting position shift by the optical sensor. Thus, noise can be limited by adding predefined coefficient $K_p$ to shift variation amount ($\Delta a_{(n)}$).

Instead of using the equation described above, whole magnification error deviation ($a_c$, $a_y$, and $a_m$) can be updated by using proportional-plus-integral control as following equation:

$$a_{(n)}=a_{(n-1)}+K_p\times\Delta a_{(n)}+K_i\times\Sigma\Delta a_{(n)}$$

In the equation above, $\Sigma\Delta a_{(n)}$ is integrated value of shift variation amount $\Delta a_{(n)}$ from 1 to n. Also, $K_p$ is proportional gain coefficient, and $K_i$ is integral gain coefficient. Limiting band is determined by proportional gain coefficient $K_p$ and integral gain coefficient $K_i$, and noise higher frequency than the limiting band is limited. Accordingly, it is not necessary to form a plurality pair of pattern image for detecting position shift and calculate average value from these, and even with one pair of short pattern images for detecting position shift, deviation amount can be calculated with high accuracy. Furthermore, steady-state error can also be reduced by reflecting integral value of shift variation amount $\Delta a_{(n)}$. In the deviation amount data updating process, proportional gain coefficient $K_p$ and integral gain coefficient $K_i$ can be determined so that the determined deviation amount can follow moderate change such as temperature change. For example, if sampling cycle is on the order of several seconds, limiting band is from several tenth part to several hundredth part of the sampling cycle.

If required limiting band for whole magnification error deviation ($a_c$, $a_y$, and $a_m$), skew difference ($d_c$, $d_y$, and $d_m$), sub-scanning direction registration difference ($f_c$, $f_y$, and $f_m$), and main scanning direction registration difference ($c_c$, $c_y$, and $c_m$) are different, (e.g., if some kind of deviation is sensitive to temperature change,) proportional gain coefficient $K_p$ and integral gain coefficient $K_i$ can be different for each deviation.

Regarding skew difference ($d_c$, $d_y$, and $d_m$), sub-scanning direction registration difference ($f_c$, $f_y$, and $f_m$), and main scanning direction registration difference ($c_c$, $c_y$, and $c_m$), data stored in the deviation amount storing unit 204 can also be updated in the same way for whole magnification error deviation ($a_c$, $a_y$, and $a_m$) described above.

Figure 8:
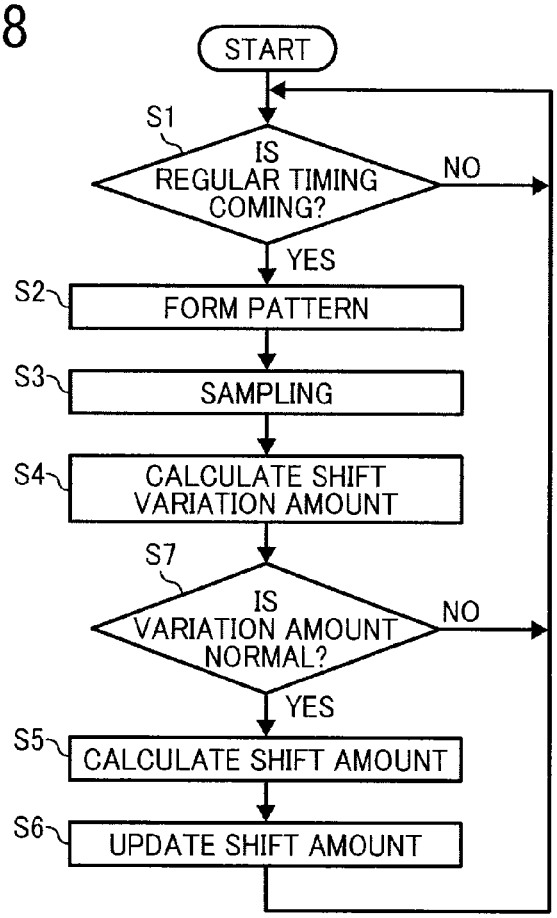
FIG. 8 is a flowchart illustrating another example of the deviation amount data updating process as an embodiment of the present invention.

FIG. 8 is a flowchart illustrating another example of the deviation amount data updating process. In FIG. 8, same step numbers are used as FIG. 7 for same processes as FIG. 7. As shown in FIG. 7 and FIG. 8, executing S7 between S4 and S5 in FIG. 8 is the only difference from FIG. 7. In S7, it is determined whether or not shift variation amount values ($d_c$, $d_y$, $d_m$, $f_c$, $f_y$, $f_m$, $a_c$, $a_y$, $a_m$, $c_c$, $c_y$, and $c_m$) calculated in S4 is normal. If it is normal (Y in S7), it proceeds to S5 and calculates deviation amount. By contrast, if it is not normal (N in S7), control flow goes back to S1. Thus, deviation amount is not updated if the shift variation amount is not normal.

The reason why process S7 is added is described below. If there is a flaw on the surface of the intermediate transferring belt 8, sensor output value gets abnormal when the flaw passes right under the optical sensor. Large amount of detecting error can be generated If there is a flaw where a pattern image for detecting position shift is formed on the belt. In this case, it is determined abnormal in S7, so updating deviation amount with large detecting error can be avoided.

Regarding the image forming apparatus in this embodiment, timing to execute deviation amount data updating process regularly is set to relatively short time interval. In this kind of configuration, shift variation amount calculated in S4 does not get so large value (i.e. deviation amount does not change largely in short period of time), so cases like described above can surely be avoided by setting threshold value to determine whether or not deviation amount is normal to relatively small value (e.g., a few dozen μm).

If one shift variation amount among a plurality of shift variation amount ($d_c$, $d_y$, $d_m$, $f_c$, $f_y$, $f_m$, $a_c$, $a_y$, $a_m$, $c_c$, $c_y$, and $c_m$) is found to be not normal, other shift variation amounts can include large error. Thus, both calculating shift variation amount and determining whether or not the calculation result is normal for various shift variation amount are executed as set, and control flow goes back to S1 as soon as it is determined abnormal. In this case, unnecessary calculation of deviation amount and determining process can be avoided.

Next, a configuration of the image forming apparatus in this embodiment is described below. Regarding various deviations generated on the intermediate transferring belt 8, deviation caused by periodic position error due to linear velocity variation per cycle of the photoconductor is also generated other than the deviations described above. The periodic position error is described below.

Figure 9:
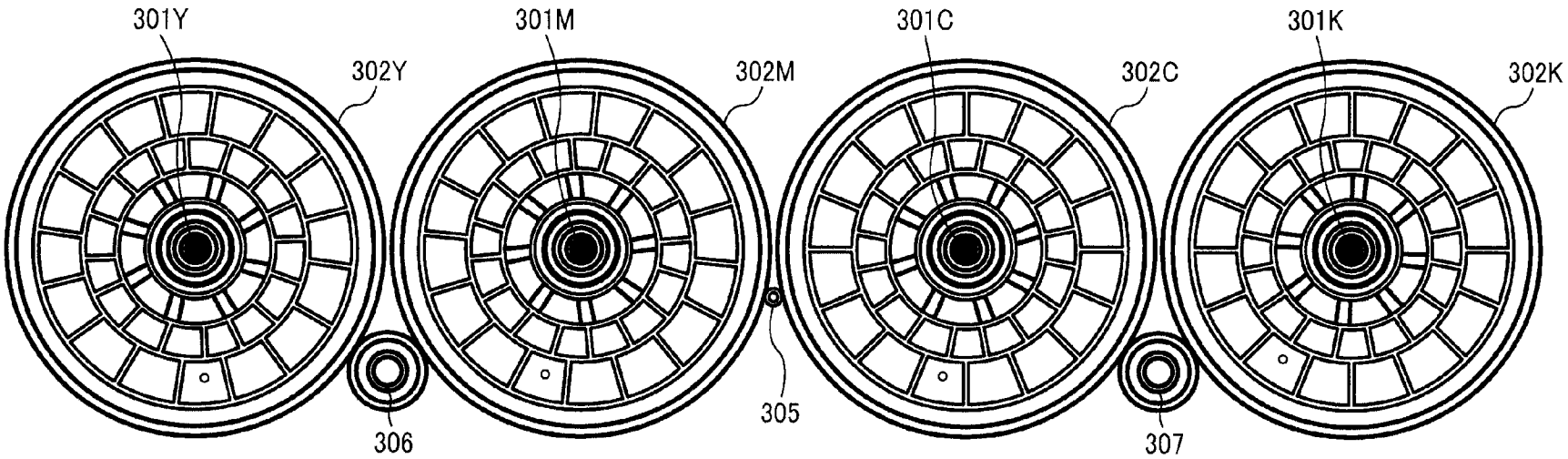
FIG. 9 is an enlarged view illustrating a part of a driving system that rotates photoconductors for Y, M, C, and K as an embodiment of the present invention.

FIG. 9 is an enlarged view illustrating a part of a driving system that rotates photoconductors for Y, M, C, and K. In FIG. 9, photoconductor gears 302Y, 302M, 302C, and 302K convey driving power to photoconductors for Y, M, C, and K (not shown), and they have larger diameter than photoconductors respectively. Image forming units for Y, M, C, and K (not shown) are located on the front side in the direction perpendicular to the figure page, and holds the photoconductors for Y, M, C, and K rotatably. The end of the rotation axis of the photoconductors projects from the casing of image forming units for Y, M, C, and K respectively, and forms coupling. The coupling of the Y photoconductor engages with a coupling 301Y located in the center of the Y photoconductor gear 302Y. Consequently, the rotating driving power of the Y photoconductor gear 302Y is conveyed to the Y photoconductor. Likewise, the couplings of the M, C, and K photoconductor engage with coupling 301M, 301C, and 301K located in the center of the M, C, and K photoconductor gear 302M, 302C, and 302K. Image forming units for Y, M, C, and K are removed from the image forming apparatus main body by being pulled from the rear side to the front side of the figure. In this case, the couplings for Y, M, C, and K are pulled away from the couplings 301Y, 301M, 301C, and 301K.

There is a driving gear 305 fixed to the rotation axis of photoconductor motor between the M photoconductor gear 302M and the C photoconductor gear 302C, and the driving gear 305 engages with the M photoconductor gear 302M and the C photoconductor gear 302C respectively. The rotating driving power of the photoconductor motor is conveyed to the M photoconductor gear 302M and the C photoconductor gear 302C respectively by these engagements.

There is a first relaying gear 306 between the Y photoconductor gear 302Y and the M photoconductor gear 302M, and the first relaying gear 306 engages with the Y photoconductor gear 302Y and the M photoconductor gear 302M respectively. The rotating driving power of the M photoconductor gear 302M is conveyed to the Y photoconductor gear 302Y by this engagement. Also, there is a second relaying gear 307 between the C photoconductor gear 302C and the K photoconductor gear 302K, and the second relaying gear 307 engages with the C photoconductor gear 302C and the K photoconductor gear 302C respectively. The rotating driving power of the C photoconductor gear 302C is conveyed to the K photoconductor gear 302K by this engagement. Subsequently, one photoconductor motor rotates and drives four photoconductors respectively.

Figure 10:
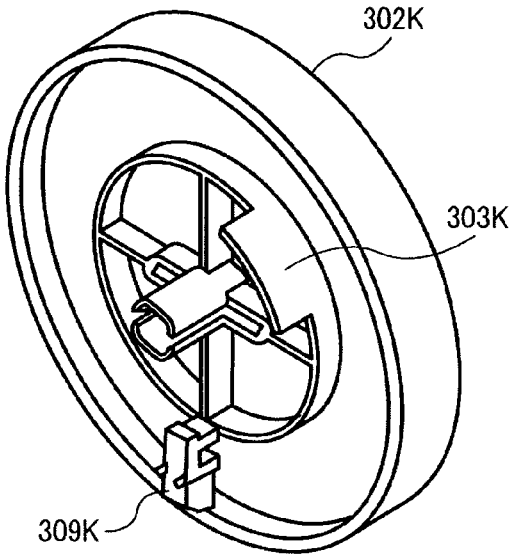
FIG. 10 is a perspective diagram illustrating a gear of the photoconductor for K as an embodiment of the present invention.
Figure 11:
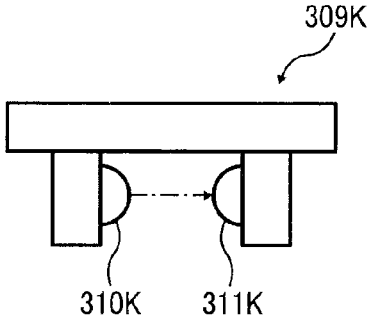
FIG. 11 is an enlarged view illustrating a rotation posture detecting sensor for K of the image forming apparatus as an embodiment of the present invention.

FIG. 10 is a perspective diagram illustrating a K photoconductor gear 302K. FIG. 10 illustrates the K photoconductor gear 302K from the opposite angle of FIG. 9. There is a being detected component 303K at predefined position on the K photoconductor gear 302K in the whole area of rotating direction. Also, a rotation posture detecting sensor 309K is located near the K photoconductor gear 302K (refer to FIG. 4). The rotation posture detecting sensor 309K receives light emitted form the eliminating unit 310K by the transmissive optical receiver 311K opposite the emitting unit in predefined space as shown in FIG. 11. The photodetector 311K outputs a signal that corresponds to the amount of light received. When the K photoconductor gear 302K shown in FIG. 11 takes predefined rotation angle posture, the being detected component 303K of the K photoconductor gear 302K goes into the space of the rotation posture detecting sensor 309K described above. Consequently, light emitted from the emitting unit 310K is blocked by the being detected component 303K, and is not received by the photodetector 311K. Subsequently, output signal from the photodetector 311K becomes low level. The test pattern writing commanding unit 217 and periodic position shift calculation storing unit 219 in FIG. 4 detects this timing that output signal becomes low level from high level as standard posture timing that the photoconductor 1 takes predefined rotation angle posture.

It should be noted that e.g., a rotary encoder can also be used to detect standard posture timing by detecting the being detected component 303Y, 303M, 303C, and 303K instead of using transmissive photosensor described above.

In FIG. 9, the Y, M, C, and K photoconductor gear 302Y, 302M, 302C, and 302K are engaged with each other via the relaying gears 306 and 307 and the driving gear 305, so they rotate in the same angle in sync with each other. Consequently, the relationship of rotating phase between each other is always constant. Subsequently, when standard posture timing is detected by the rotation posture detecting sensor 309K shown in FIG. 10, Y, M, and C photoconductor gear 302Y, 302M, and 302C takes predefined rotation angle posture respectively.

Figure 12:
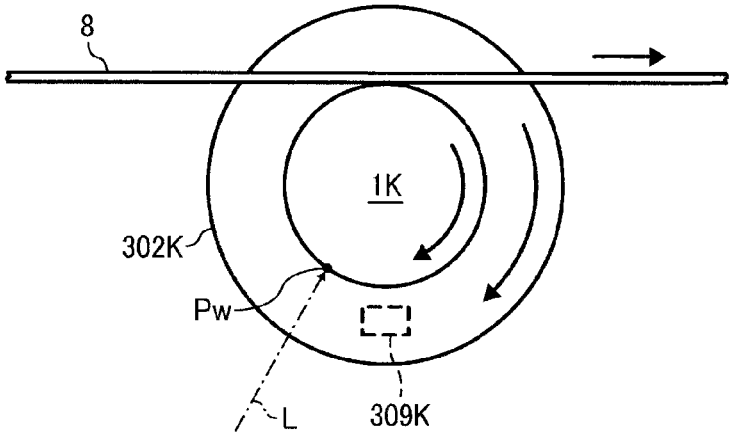
FIG. 12 is an enlarged view illustrating an optical writing position $P_w$ on the photoconductor 1K for K as an embodiment of the present invention.

FIG. 12 is an enlarged view illustrating an optical writing position $P_w$ on the K photoconductor 1K. Latent image is written on the surface of the K photoconductor 1K by laser beam L when the surface moves to predefined rotation angle position. This rotation angle position is the optical writing position $P_w$ as image writing position. The K photoconductor gear 302K is located on the same axis of the photoconductor 1K, and it is connected to the photoconductor 1K by coupling (not shown). Slight eccentricity with the K photoconductor gear 302K cannot be avoided due to limitation of manufacturing precision. Since diameter of the K photoconductor gear 302K is larger than the K photoconductor 1K, that eccentricity affects the behavior of the K photoconductor 1K a lot. Particularly, linear velocity variation having characteristic that draws sine curve for one cycle per cycle of the photoconductor is generated at the optical writing position P. Subsequently, that generates periodic position error having characteristic that draws sine curve for one cycle per cycle of the photoconductor.

Figure 13:
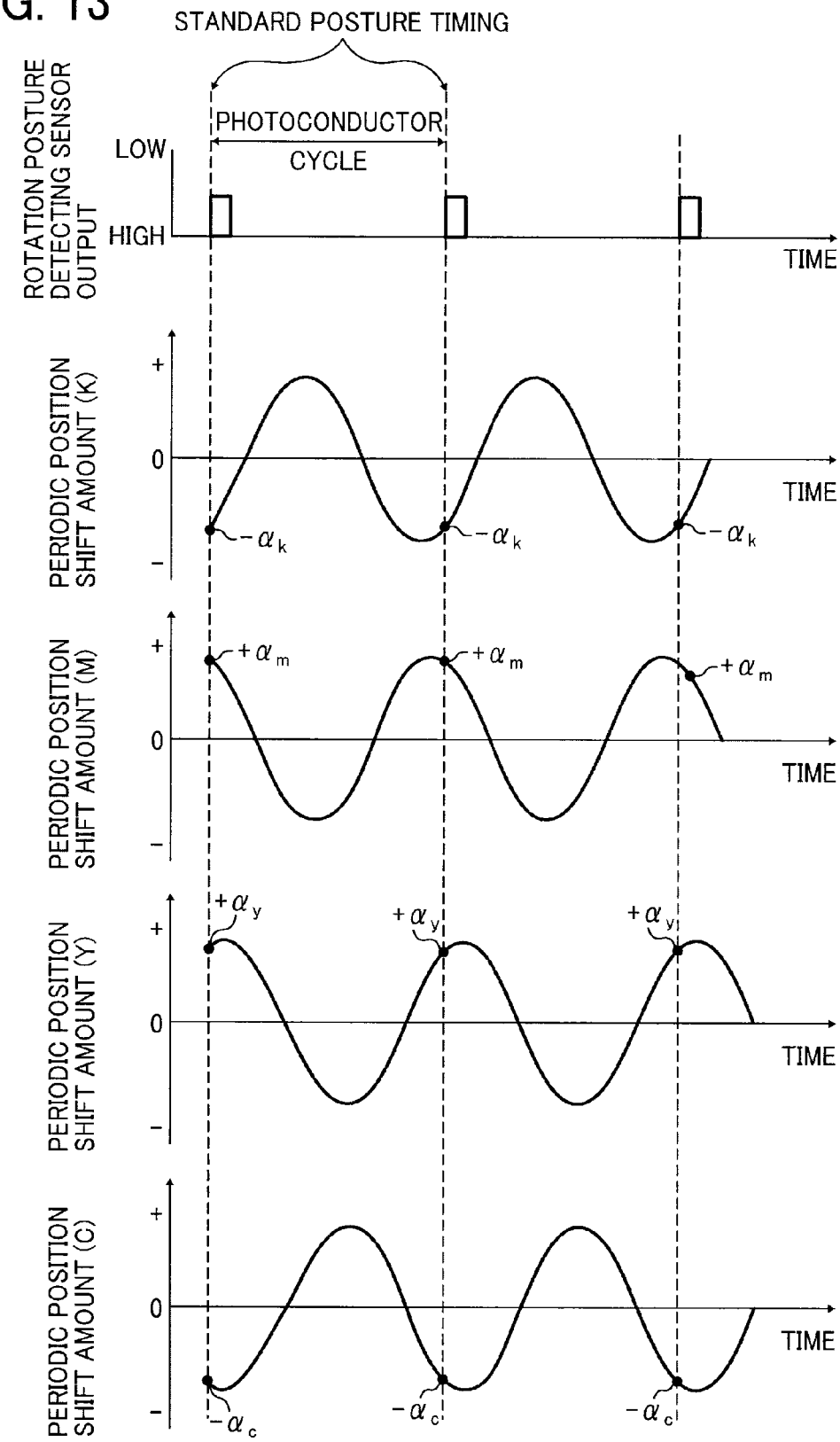
FIG. 13 is a chart illustrating standard posture timing and position shift fluctuating curve at optical writing position $P_w$ on the photoconductors 1Y, 1M, 1C, and 1K as an embodiment of the present invention.

FIG. 13 is a chart illustrating standard posture timing and position shift fluctuating curve at optical writing position $P_w$ on the photoconductors 1Y, 1M, 1C, and 1K. When the K photoconductor 1K and the K photoconductor gear 302K takes predefined rotation angle posture, output signal from the rotation posture detecting sensor 309K becomes low level and standard posture timing is detected as shown in FIG. 13. The Y, M, C, and K photoconductors 1Y, 1M, 1C, and 1K generates position deviation amount variation having characteristic that draws sine curve as shown in FIG. 13 at the optical writing position P. Although each position shift variation curve has characteristic that draws sine curve for on cycle per cycle of the photoconductor 1Y, 1M, 1C, and 1K, their phases are different from each other.

The K photoconductor 1K generates position shift that has value $-\alpha_k$ at the optical writing position $P_w$ at the standard posture timing. It should be noted, in order to distinguish various deviation amount such as whole magnification error deviation in the main scanning direction, skew difference, registration difference in the main scanning direction, and registration difference in the sub-scanning direction with position shift due to gear eccentricity shown in FIG. 13 clearly, the latter position shift due to gear eccentricity is referred to as periodic position shift hereinafter. Also, its amount is called periodic position deviation amount.

In FIG. 13, in case the point on the photoconductor surface that enters to the optical writing position $P_w$ is deviated than design position to the photoconductor surface direction of movement, + sign is added to value of periodic position deviation amount. By contrast, in case the point on the photoconductor surface that enters to the optical writing position $P_w$ is deviated than design position to opposite of the photoconductor surface direction of movement, − sign is added to value of periodic position deviation amount. In given cycle, the periodic position deviation amount of the K photoconductor 1K at the optical writing position $P_w$ is constantly $-\alpha_k$ at the standard posture timing.

By contrast, the M photoconductor 1M generates position shift that has value $-\alpha_m$ at the optical writing position $P_w$ at the standard posture timing. In given cycle, the periodic position deviation amount of the M photoconductor 1M at the optical writing position $P_w$ is constantly $-\alpha_m$ at the standard posture timing.

Also, the Y photoconductor 1Y generates position shift that has value $-\alpha_y$ at the optical writing position $P_w$ at the standard posture timing. In given cycle, the periodic position deviation amount of the Y photoconductor 1Y at the optical writing position $P_w$ is constantly $-\alpha_y$ at the standard posture timing.

Lastly, the C photoconductor 1C generates position shift that has value $-\alpha_c$ at the optical writing position $P_w$ at the standard posture timing. In given cycle, the periodic position deviation amount of the C photoconductor 1C at the optical writing position $P_w$ is constantly $-\alpha_c$ at the standard posture timing.

As described above, periodic position deviation amount for Y, M, C, and K become always constant regardless of the cycle at the standard posture timing. It should be noted that not only at the standard posture timing but also at any given timing, periodic position deviation amount for Y, M, C, and K become constant at the timing.

In FIG. 1, the Y, M, C, and K photoconductor 1Y, 1M, 1C, and 1K are laid out at the same pitch as the circumference of the photoconductor. Subsequently, the distance between the center of the Y primary transferring nip (the center in the direction of movement of belt) and the center of the M primary transferring nip equals to the circumference of the photoconductor. Also, the distance between the center of the M primary transferring nip and the center of the C primary transferring nip, and the distance between the center of the C primary transferring nip and the center of the K primary transferring nip equal to the circumference of the photoconductor. In this configuration, in order to superimpose the same size of Y, M, C, and K toner images without position shift, it is necessary to deviate optical writing starting timing on the Y, M, C, and K photoconductors 1Y, 1M, 1C, and 1K to one cycle of the photoconductor respectively. First, optical writing on the Y photoconductor 1Y is started at predefined timing. Subsequently, optical writing on the M photoconductor 1M is started when one rotating cycle of the photoconductor passes. Likewise, optical writing on the C photoconductor 1C is started when one rotating cycle of the photoconductor passes. Lastly, optical writing on the K photoconductor 1K is started when one rotating cycle of the photoconductor passes.

The periodic position shift calculation storing unit 219 stores data of periodic position shift variation curve for Y, M, C, and K shown in FIG. 13 respectively for at least one cycle of photoconductor. Each periodic position shift variation curve is drawn on the basis of the standard posture timing.

It should be noted that the image forming apparatus of this embodiment starts optical writing on photoconductor in order of Y, M, C, and K. Also, in the image forming apparatus of this embodiment, distance between adjacent photoconductors is set as same as circumference of the photoconductor. Therefore, starting of optical writing on area corresponding to the top of page on the M photoconductor delays for one cycle of the photoconductor from optical writing on area corresponding to the top of page on the Y photoconductor. Also, starting of optical writing on area corresponding to the top of page on the C photoconductor delays for two cycles of the photoconductor from optical writing on area corresponding to the top of page on the Y photoconductor. Lastly, starting of optical writing on area corresponding to the top of page on the K photoconductor delays for one cycle of the photoconductor from optical writing on area corresponding to the top of page on the Y photoconductor.

Figure 14:
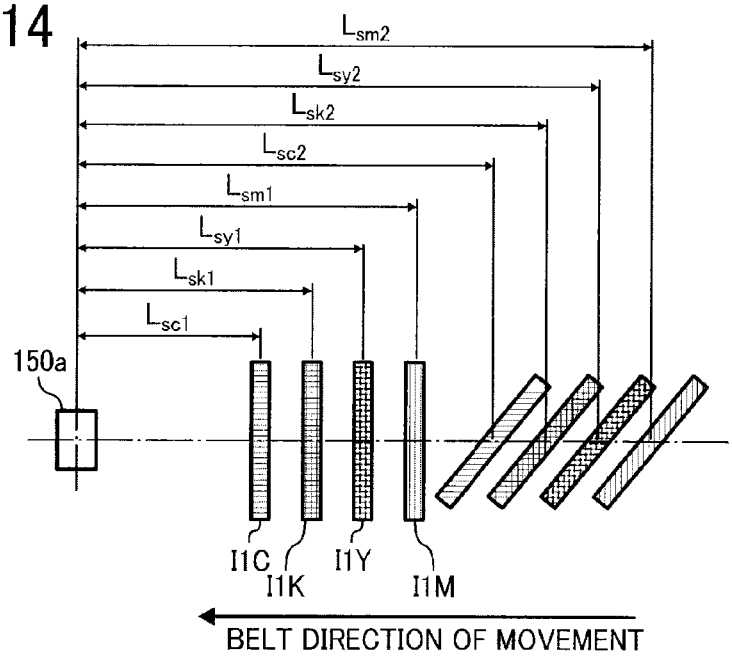
FIG. 14 is a diagram illustrating various standard distances at the time of starting sampling as an embodiment of the present invention.

FIG. 14 is a diagram illustrating various standard distances at the time of starting sampling. After starting optical writing on the Y photoconductor 1Y to form the misalignment detecting pattern image, the controller starts sampling detecting timing of various position detecting images in the pattern at the time predefined time passes. At the time of starting this sampling, the position shift detecting pattern is located upstream of the optical sensor (the first optical sensor 150*a* in FIG. 14) in the direction of movement of the belt as shown in FIG. 14.

In FIG. 14, a first C standard distance $L_{sc1}$ is distance between the optical sensor and the C first position detecting image I1C. The C first position detecting image I1C does not generate periodic position shift due to reasons such as eccentricity of the C photoconductor 1C since position shift detecting pattern image is formed with resolving periodic position shift of toner image for each color by correcting image information based on magnification error in the sub-scanning direction e. Consequently, all position detecting images included in the position shift detecting pattern image in FIG. 14 do not generate periodic position shift due to reasons such as eccentricity of photoconductors. It should be noted that a first K standard distance $L_{sk1}$ is distance between the optical sensor and the K first position detecting image I1K. A first Y standard distance $L_{sy1}$ is distance between the optical sensor and the Y first position detecting image I1Y. A first M standard distance $L_{sm1}$ is distance between the optical sensor and the M first position detecting image I1M. A first C standard distance $L_{sc1}$ is a theoretical value and distance with assuming that the C first position detecting image I1C does not generate not only periodic position shift but also all other position shifts. A first K standard distance $L_{sk1}$ is a theoretical value and distance with assuming that the K first position detecting image I1K does not generate not only periodic position shift but also all other position shifts. A first Y standard distance $L_{sy1}$ is a theoretical value and distance with assuming that the Y first position detecting image I1Y does not generate not only periodic position shift but also all other position shifts. A first M standard distance $L_{sm1}$ is a theoretical value and distance with assuming that the M first position detecting image I1M does not generate not only periodic position shift but also all other position shifts. By contrast, actual measurement values are referred to as a C first actual measurement value $L_{sc1}'$, a K first actual measurement value $L_{sk1}'$, a Y first actual measurement value $L_{sy1}'$, and an M first actual measurement value $L_{sm1}'$ respectively hereinafter.

Also, a second C standard distance $L_{sc2}$ is distance between the optical sensor and the C second position detecting image I2C and is theoretical value too. A second K standard distance $L_{sk2}$ is distance between the optical sensor and the K second position detecting image I2K and is theoretical value too. A second Y standard distance $L_{sy2}$ is distance between the optical sensor and the Y second position detecting image I2Y and is theoretical value too. A second M standard distance $L_{sm2}$ is distance between the optical sensor and the M second position detecting image I2M and is theoretical value too. By contrast, actual measurement values are referred to as a C second actual measurement value $L_{sc2}'$, a K second actual measurement value $L_{sk2}'$, a Y second actual measurement value $L_{sy2}'$, and an M second actual measurement value $L_{sm2}'$ respectively hereinafter.

The controller calculates the CK distance $L_{ck}$, the KY distance $L_{ky}$, the KM distance $L_{km}$, the CC distance $L_{cc}$, the KK distance $L_{kk}$, the YY distance $L_{yy}$, and the MM distance $L_{mm}$ based on the difference between the first C standard distance $L_{sc1}$ and the C first actual measurement value $L_{sc1}'$, the first K standard distance $L_{sk1}$ and the K first actual measurement value $L_{sk1}'$, the first Y standard distance $L_{sy1}$ and the Y first actual measurement value $L_{sy1}'$, the first M standard distance $L_{sm1}$ and the M first actual measurement value $L_{sm1}'$, the second C standard distance $L_{sc2}$ and the C second actual measurement value $L_{sc2}'$, the second K standard distance $L_{sk2}$ and the K second actual measurement value $L_{sk2}'$, the second Y standard distance $L_{sy2}$ and the Y second actual measurement value $L_{sy2}'$, and the second M standard distance $L_{sm2}$ and the M second actual measurement value $L_{sm2}'$.

The method to calculate various deviation amount values based on calculated CK distance $L_{ck}$, KY distance $L_{ky}$, KM distance $L_{km}$, CC distance $L_{cc}$, KK distance $L_{kk}$, YY distance $L_{yy}$, and MM distance $L_{mm}$ had already been described above.

As described above, the image data correcting unit 203 corrects color separation image data based on deviation amount data (skew difference, registration difference in the sub-scanning direction, whole magnification error deviation in the main scanning direction, and registration difference in the main scanning direction) that indicates relative position shift of toner image between units on the basis of result of detecting each position detecting image in misalignment detecting pattern image. In the image forming apparatus of this embodiment, it is greatly unconventional that the image data correcting unit 203 corrects color separation image data based not only on skew difference, registration difference in the sub-scanning direction, whole magnification error deviation in the main scanning direction, and registration difference in the main scanning direction, but also on magnification error in the sub-scanning direction e that reflects periodic position shift variation curve (FIG. 13) for each color as periodic variation characteristic data.

Four photoconductors 1Y, 1M, 1C, and 1K rotates at the state in which sine curve-like periodic position variation curves have predefined phase difference with each other. For example, if plus side peak point of periodic position shift variation curve for the M photoconductor 1M generates with phase difference of +10 degrees against plus side peak point of periodic position shift variation curve for the Y photoconductor 1Y, the phase difference of +10 degrees is always constant. Likewise, the C photoconductor 1C and the K photoconductor 1K also rotate always with constant phase difference. Therefore, regarding output images on a plurality of pages respectively, on a particular page, relationship between coordinates in the sub-scanning direction on pixels in the latent image and periodic position error at each coordinate is fixed on all surface of the photoconductors at the time when timing for starting optical writing on the Y photoconductor 1Y for the page is determined.

More specifically, on the surface of the Y photoconductor 1Y, at the time when optical writing on the Y photoconductor 1Y starts to form image for e.g., page 1, coordinates in the sub-scanning direction of respective pixels in the latent image and periodic position error at each coordinate are fixed. Also, optical writing on the M photoconductor 1M starts at the time when one rotating cycle of the photoconductor passes from starting optical writing on the Y photoconductor 1Y, and rotation angle posture of the M photoconductor 1M at that time is fixed at the time when timing to start optical writing on the Y photoconductor 1Y is determined. Therefore, also on the surface of the M photoconductor 1M, at the time when timing to start optical writing on the Y photoconductor 1Y to form image of page 1 is determined, coordinates in the sub-scanning direction of respective pixels in the latent image and periodic position error at each coordinate are fixed. The situation is the same for the C photoconductor 1C and the K photoconductor 1K. The same is true on page 2 or later.

Consequently, in image information correcting process, the image forming apparatus of this embodiment determines firstly timing of starting optical writing on the photoconductor. Next, on the basis of determined timing of starting optical writing, the image forming apparatus of this embodiment corrects Y, M, C, and K color separation image data respectively based on skew difference, registration difference in the sub-scanning direction, whole magnification error deviation in the main scanning direction, and registration difference in the main scanning direction stored in the deviation amount storing unit 204, and periodic position shift variation curve, so that those deviations are canceled.

In this correcting process, first, timing of starting optical writing for image is specified based on delay time $t_z$. After the timing of starting optical writing, the image forming apparatus can start optical writing based on corrected color separation image data.

More specifically, the image data correcting unit 203 stores predefined N rows of pixel line data in the main scanning direction for Y, M, C, and K sent from the image pass switching unit 202 in its internal buffer. This is because it is necessary to store certain rows of pixel line data in the main scanning direction and capture the image two-dimensionally to correct color separate image data based on two-dimensional coordinate conversion. The image forming apparatus dedicate itself to store data from receiving the first row of pixel line data in the main scanning direction until the Nth row of pixel line data in the main scanning direction since it cannot execute correcting process. The image data correcting unit 203 corrects the first row of pixel line data in the main scanning direction based on from the first to the Nth row of pixel line data in the main scanning direction when it finishes receiving the Nth row of pixel line data in the main scanning direction, and outputs the corrected pixel line data in the main scanning direction to the writing control unit 205.

The delay time $t_z$ is time required from the image data correcting unit 203 sends the corrected first row of pixel line data in the main scanning direction after receiving the first row of pixel line data in the main scanning direction and the writing control unit 205 starts optical writing on the Y photoconductor based on the pixel line data in the main scanning direction.

It should be noted that, after outputting one row of corrected pixel line data in the main scanning direction for Y, M, C, and K respectively to the writing control unit 205, the image data correcting unit 203 corrects the next row of corrected pixel line data in the main scanning direction based on deviated attentional rows of pixel line data for one row after deviating attentional rows of pixel line data for one row respectively. For example, regarding the first row, the image data correcting unit 203 corrects the first row of pixel line data in the main scanning direction based on the two-dimensional image data indicated by the attentional rows of pixel line data in the main scanning direction from the first row to the Nth row as described above. After outputting the corrected pixel line data in the main scanning direction, the image data correcting unit 203 deviates the attentional rows of pixel line data for one row and regards from the second row of pixel line data in the main scanning direction to the Nth+1 row received newly as attentional rows of pixel line data. Subsequently, the image data correcting unit 203 corrects the second row of pixel line data in the main scanning direction based on the attentional rows of pixel line data.

After determining timing to be able to start optical writing for the first row of Y color separation image data as described above, the image data correcting unit 203 determines rotation angle posture at the timing to start optical writing on the Y, M, C, K photoconductor respectively based on the specified result, elapsed time from the adjacent standard posture timing (i.e. current rotation angle posture of the Y photoconductor), and the Y periodic position shift variation curve. Subsequently, it is assumed that optical writing of the first row of pixel line data in the main scanning direction is started with the determined rotation angle posture for Y, M, C, and K photoconductors respectively. That is, the image data correcting unit 203 executes rotation posture determining process that predetermines rotation posture at writing as rotation angle posture at the time of starting optical writing.

The image data correcting unit 302 specifies Y periodic position deviation amount (magnification error in the sub-scanning direction e) at the time when the Y photoconductor 1Y gets the writing rotation posture from the Y periodic position shift variation curve. Subsequently, the image data correcting unit 203 corrects the first row of Y pixel line data in the main scanning direction based on the determined result. Likewise the image data correcting unit 203 corrects the first row of M, C, and K pixel line data in the main scanning direction. Regarding correcting the second row or later of pixel line data in the main scanning direction, the image data correcting unit 203 specifies periodic position deviation amount based on rotation angle variation of the photoconductor during time required from starting optical writing precedent row to succeeding row, and corrects the pixel line data in the main scanning direction based on the specified result. The method to convert coordinate system based on deviation amount was described above.

It should be noted that, regarding the second page or later, writing rotation posture of the Y, M, C, and K photoconductors 1Y, 1M, 1C, and 1K is specified based on the timing of receiving the first row of pixel line data in the main scanning direction, delay time $t_z$, and adjacent standard posture timing. Also, magnification error in the sub-scanning direction e is preliminarily measured using an image forming apparatus at the time of factory shipment and stored in the deviation amount storing unit 204.

As described above, regarding the image forming apparatus of this embodiment, the image data correcting unit 203 executes image information correcting process that corrects Y, M, C, and K color separation image data based on deviation amount data (e.g., registration difference data) stored in the deviation amount storing unit 204. Consequently, superimposing deviation of toner images for each color can be reduced without implementing a special unit to correct optical writing position on the photoconductor.

The image data correcting unit 203 also corrects the Y, M, C, and K color separation image data based on not only deviation amount data such as registration difference and skew difference but also periodic position shift. Consequently, toner images that can reduce superimposing deviation due to periodic position error can be formed on the Y, M, C, and K photoconductors 1Y, 1M, 1C, and 1K respectively. Therefore, superimposing deviation of toner images due to periodic position shift of the Y, M, C, and K photoconductors 1Y, 1M, 1C, and 1K respectively can be reduced without implementing a special unit to correct optical writing position on the photoconductors 1Y, 1M, 1C, and 1K.

It should be noted, regarding the image forming apparatus of this embodiment that one driving motor drives all of the Y, M, C, and K photoconductors 1Y, 1M, 1C, and 1K, rotating phase differences of all photoconductors are kept constant since all photoconductors rotate in synchrony. Therefore, it is not always necessary to determine writing rotation posture of the photoconductors based on information such as delay time $t_z$ etc. in the rotation posture determining process. It is possible to determine predefined rotation angle posture as writing rotation posture instead of determining writing rotation posture based on delay time $t_z$. In this case, the image forming apparatus can start optical writing at the time when the image forming apparatus detects that each photoconductor take predefined writing rotation posture based on the standard posture timing.

Figure 45:
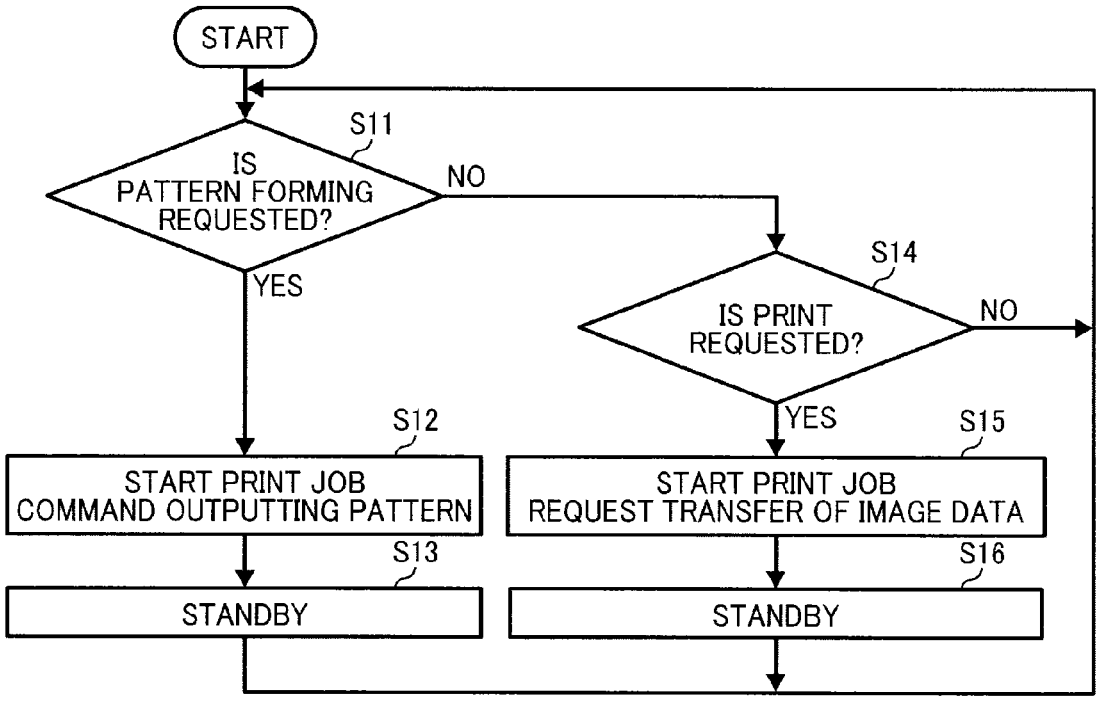
FIG. 45 is a flowchart illustrating a controlling process executed by a print job controller of the image forming apparatus as an embodiment of the present invention.

FIG. 45 is a flowchart illustrating a controlling process executed by the print job controller 213 of the image forming apparatus of this embodiment. First, the print job controller 213 determines whether or not it is requested to form misalignment detecting pattern image (S11). A pattern forming request determining unit (not shown) that receives image data upstream of the print job controller 213 asks this request to form. The pattern forming request determining unit generates a pattern forming request signal e.g., each time receiving times of an image data transfer request signal for each page sent from the print job controller 213 measure up to predefined times. After receiving the pattern forming request signal sent from the pattern forming request determining unit (Y in S11), the print job controller 213 sends a print job start command signal and a test pattern output command signal to the pattern image data generating unit 201. Consequently, the pattern image data generating unit 201 sends misalignment detecting pattern image to the image pass switching unit 202, and deviation amount data updating process is started. Subsequently, misalignment detecting pattern images are formed at corresponding area between sheets on the intermediate transferring belt 8.

It should be noted, if method 1 or method 2 is adopted, the image data correcting unit 203 determines writing rotation posture of each photoconductor at the time of receiving the first row of pixel line data in the main scanning direction, and corrects Y, M, C, and K color separation image data of the misalignment detecting pattern image based on the determined writing rotation posture of each photoconductor. In this process, each pixel of the color separation image data is coordinate converted so that registration difference in the main scanning direction, registration difference in the sub-scanning direction, and skew difference (furthermore, periodic position shift in case of method 1) canceled just like a normal image.

After sending the print job start command signal and the test pattern output command signal to the pattern image data generating unit 201 for executing deviation amount data updating process, the print job controller 213 waits for time required to form misalignment detecting pattern image ($T_{tp}$ in FIG. 17) so that print job to form normal image is not executed during that time (S13). After finishing waiting, controlling flow goes back to S11 described above.

If there is no request to form misalignment detecting pattern image (N in S11), the print job controller 213 determines whether or not a print request for a print job to form a normal image exists (S14). If there is no print request (N in S14), controlling flow goes back to S11. By contrast, if there is a print request (Y in S14), the print job controller 213 sends the print job start command signal and an image data transfer requesting signal (S15). Consequently, image information for the next page is sent to the image pass switching unit 202.

After sending the print job start command signal and image data transfer requesting signal to form a normal image, the print job controller 213 waits for time required to form those images ($T_{print}$ in FIG. 11, different depending on size of recording sheet to be printed) so that a printing job to form the misalignment detecting pattern image or a print job to form other pages is not be executed during that time (S16). After finishing waiting, controlling flow goes back to S11 described above.

When duplex printing mode that forms image on both sides of a recording sheet P, the image data correcting unit 203 executes different process between image for front page and image for back page. More specifically, in duplex printing, while image formed on the front side of the recording sheet P goes through the fixing unit 20 twice, image formed on the back side goes through the fixing unit 20 only once. The recording sheet P evaporates moisture and shrinks a bit when it goes through the fixing unit 20 to fix image on the front page. Image on the back side is transferred on the recording sheet P that shrinks a bit. Therefore, image magnification is different a bit between the front page and the back page.

To cope with this issue, the deviation amount storing unit 204 stores reduction ratio data to reduce the image on the back side in accordance with the reduction ratio of the recording sheet P. A user can set this reduction ratio arbitrary by a user operation. The image data correcting unit 203 corrects magnification in sub-scanning direction of the Y, M, C, and K color separation image data formed on the back page based on the reduction ratio. More specifically, magnification in the sub-scanning direction e is calculated based on the reduction ratio data stored in the deviation amount storing unit 204. The magnification in the sub-scanning direction of the image on the back page e is calculated by following equation:

$$e=(1+ej)\times\lambda^{-1}$$

In the equation above, λ is reduction ratio indicated by the reduction ratio data. After the calculation, the image data correcting unit 203 multiplies whole magnification error deviation values in Equation 2 described above by e. Consequently, the image on the back side is shrunk in accordance with the reduction ratio of the recording sheet.

Figure 15:
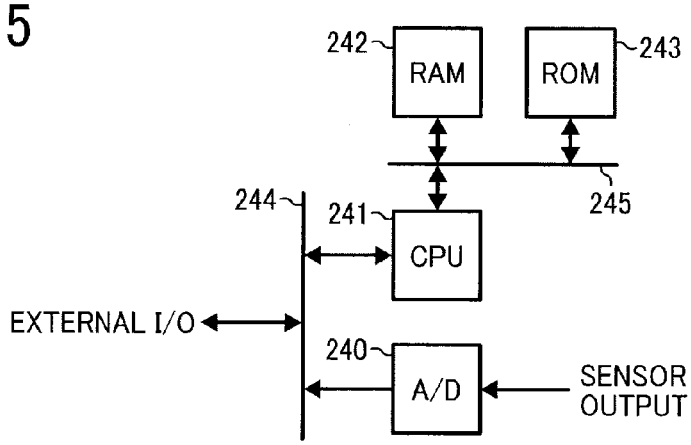
FIG. 15 is a diagram illustrating a circuit configuration of a software executing unit that implements various processes of the controlling apparatus by software as an embodiment of the present invention.

The deviation amount calculating unit 212, the deviation amount storing unit 204, the detection signal generating unit 218, the periodic position shift calculation storing unit 219, the correcting value storing unit 220, the test pattern writing supporting unit 217, and the print job controller 213 can be implemented by not hardware but software. FIG. 15 is a diagram illustrating a circuit configuration of a software executing unit that implements those units above by software. Also, circuit configuration of engine controller that controls operation timing of image forming unit can be used for that purpose.

In FIG. 15, an A/D converter 240 converts analog signals from various sensors into digital signals, and outputs it to an I/O port 244. The A/D converter 240 can also output the digital signals via a signal processing unit (not shown) that executes signal process such as filtering process or a buffer memory (not shown) instead of outputting to the I/O port 244 directly.

The I/O port 244 is connected to the A/D converter 240, a CPU 241, and external units and exchange signals with the CPU 241. Inputting a print request signal, issuing a print job start command signal, and transferring various deviation amount to the image data correcting unit 203 are executed via the I/O port 244.

The CPU 241 executes processes such as calculating various deviation amount and controlling start of a print job exchanging signals with external units via the I/O port 244. Also, the CPU 241 executes data reading/writing process with a RAM 242 and a ROM 243 via a memory bus 245. The ROM 234 stores programs to calculate various deviation amount and control various units.

Figure 16:
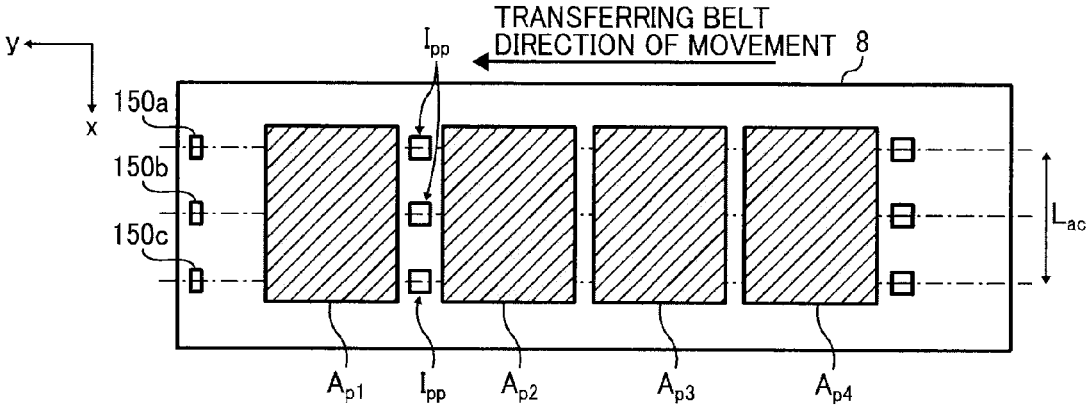
FIG. 16 is a diagram illustrating various areas on the intermediate transferring belt 8 of the image forming apparatus as an embodiment of the present invention.

FIG. 16 is a diagram illustrating various areas on the intermediate transferring belt 8 of the image forming apparatus of this embodiment. In FIG. 16, a first sheet corresponding area $A_{p1}$ is area that corresponds to the first recording sheet in consecutive print jobs (the area that sticks to the recording sheet at the secondary transferring nip) among whole area of the intermediate transferring belt 8. Also, a second sheet corresponding area $A_{p2}$, a third sheet corresponding area $A_{p3}$, and a fourth sheet corresponding area $A_{p4}$ are areas that correspond to the second sheet, the third sheet and the fourth sheet respectively in consecutive print jobs among whole area of the intermediate transferring belt 8. An inter-sheet corresponding area exists between a precedent sheet corresponding area and a succedent sheet corresponding area. The inter-sheet corresponding area does not stick to a recording sheet at the secondary transferring nip in direction of movement of the belt.

In FIG. 16, sheet corresponding areas and inter-sheet corresponding areas on the intermediate transferring belt 8 are explained above. Also, the same sort of sheet corresponding areas and inter-sheet corresponding areas exist on the surface of the Y, M, C, and K photoconductors 1Y, 1M, 1C and 1K. The controller forms an misalignment detecting pattern image $I_{pp}$ detected by the first optical sensor 150*a*, an misalignment detecting pattern image $I_{pp}$ detected by the second optical sensor 150*b*, and an misalignment detecting pattern image $I_{pp}$ detected by the third optical sensor 150*c* on the following areas. That is, the controller forms those images on the inter-sheet corresponding area and yet area within the same position scope of the sheet corresponding area in the main scanning direction.

In FIG. 16, three misalignment detecting pattern images $I_{pp}$ are formed in the inter-sheet corresponding area (referred to as 1-2 inter-sheet corresponding area hereinafter) between the first sheet corresponding area ($A_{p1}$ on the belt) and the second sheet corresponding area ($A_{p2}$ on the belt). In FIG. 16, the misalignment detecting pattern image $I_{pp}$ is not formed in the inter-sheet corresponding area (referred to as 2-3 inter-sheet corresponding area hereinafter) between the second sheet corresponding area ($A_{p2}$ on the belt) and the third sheet corresponding area ($A_{p3}$ on the belt). Comparing the 1-2 inter-sheet corresponding area in which the misalignment detecting pattern images $I_{pp}$ are formed and the 2-3 inter-sheet corresponding area in which the misalignment detecting pattern image $I_{pp}$ is not formed, the length in the sub-scanning direction of the former is linger than that of the latter. This is because the misalignment detecting pattern image $I_{pp}$ does not fit into the normal inter-sheet corresponding area.

The controller determines whether or not it forms the misalignment detecting pattern image $I_{pp}$ by following processes. That is, first, the controller determines the necessity of executing deviation amount data updating process. More specifically, in consecutive print jobs, if number of consecutive printing pages after the previous deviation amount data updating process exceeds threshold value, the controller determines it is necessary to execute deviation amount data updating process. This determination is executed not the actual number of pages transferred image on the recording sheet but at the timing of correcting image data by the image data correcting unit 203. That is, the image data correcting unit 203 determines whether or not consecutive printing exceeds the threshold for color separation image data pages to be corrected. If the number of pages exceeds the threshold value, the controller executes image data process to form three misalignment detecting pattern images $I_{pp}$ in the inter-sheet corresponding area after expanding the inter-sheet corresponding area between the page and the following page. In the example shown in FIG. 16, misalignment detecting pattern images $I_{pp}$ are formed in the inter-sheet corresponding area on the intermediate transferring belt 8 for every three printouts.

Figure 17:
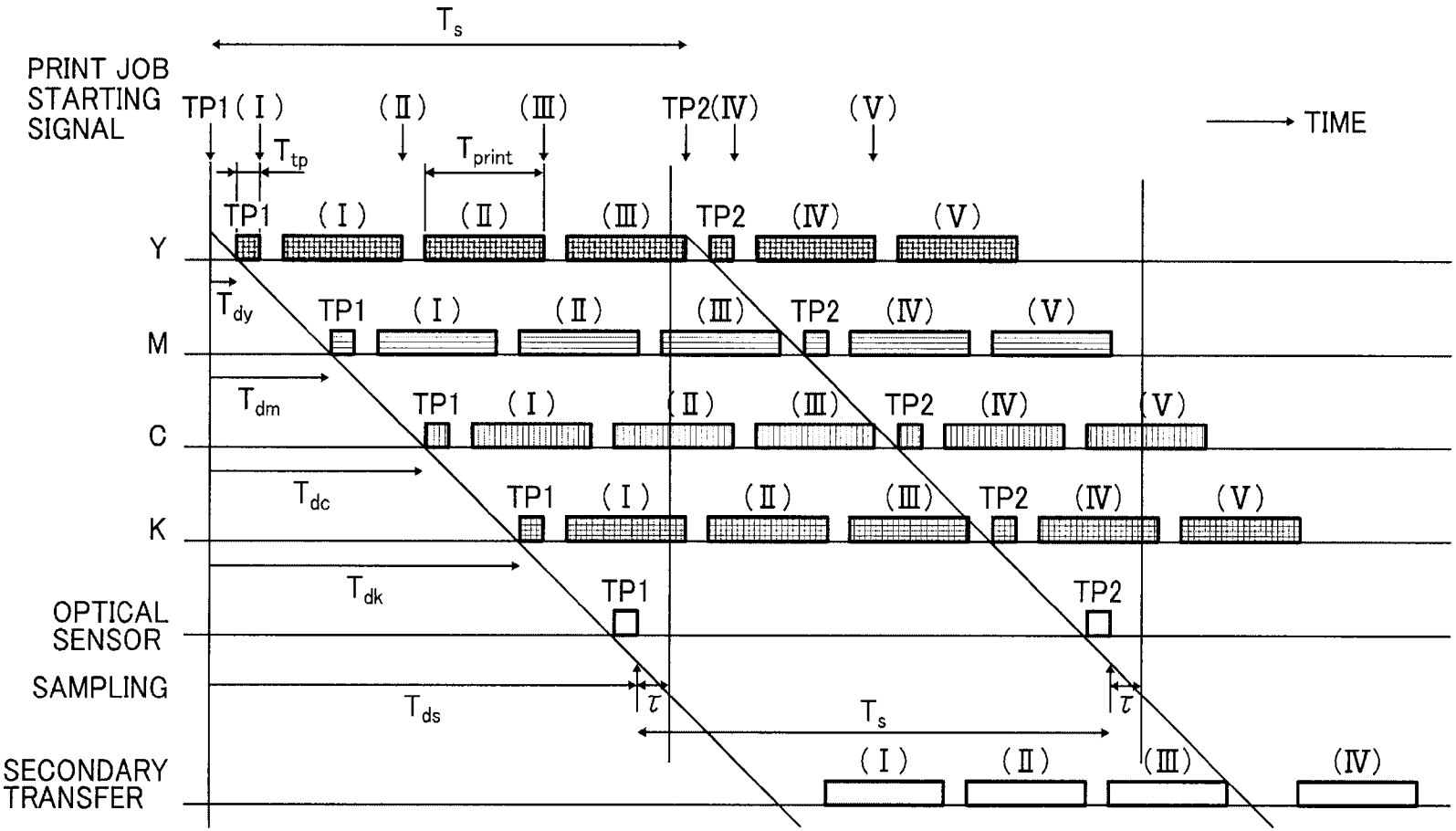
FIG. 17 is a chart illustrating an example of various timing of the image forming apparatus as an embodiment of the present invention.

FIG. 17 is a chart illustrating an example of various timing of the image forming apparatus in this embodiment. In FIG. 17, downward arrows indicate timing to start a printing job. In the first row of the chart, $T_{p1}$ indicates the timing to start the printing job to print the first misalignment detecting pattern image in the sub-scanning direction, and $T_{p2}$ indicates the timing to start the printing job to print the second misalignment detecting pattern image in the sub-scanning direction. Both $T_{p1}$ and $T_{p2}$ are trigger timing. It should be noted that Roman numbers in FIG. 17 indicate number of page, and signals that rise at Roman numbers indicate job executing time on page corresponding area.

The second row of the chart (Y) indicates job timing at the Y primary transferring nip. After generating print job starting signal and time lag $T_{dy}$, The Y first position detecting image I1Y of the first inter-unit misalignment detecting pattern image starts being transferred on the intermediate transferring belt 8 at the Y primary transferring nip.

The third row of the chart (M) indicates job timing at the M primary transferring nip. After generating print job starting signal and time lag $T_{dm}$, The M first position detecting image I1M of the first inter-unit misalignment detecting pattern image starts being transferred on the intermediate transferring belt 8 at the M primary transferring nip The fourth row of the chart (C) indicates job timing at the C primary transferring nip. After generating print job starting signal plus time lag $T_{dc}$, The C first position detecting image I1C of the first inter-unit misalignment detecting pattern image starts being transferred on the intermediate transferring belt 8 at the C primary transferring nip.

The fifth row of the chart (K) indicates job timing at the K primary transferring nip. After generating print job starting signal and time lag $T_{dk}$, The K first position detecting image I1K of the first inter-unit misalignment detecting pattern image starts being transferred on the intermediate transferring belt 8 at the K primary transferring nip.

The sixth row of the cart indicates job timing of detecting an image by the optical sensor (150*a*, 150*b*, and 150*c*). The job start timing corresponds to the traveling distance of the belt from the center of the Y primary transferring nip to directly below the optical sensors. Electricity consumption of the image forming apparatus can be reduced if emission of the optical sensors is turned off further than vicinity of job timing.

The seventh row of the chart indicates timing of finish detecting misalignment detecting pattern image by the optical sensor (finish detecting timing). Time lag from print job starting timing $T_{ds}$ equals to sum of time lag $T_{dy}$ and time required to travel the traveling distance of the belt. After the finish detecting timing plus time required to calculate various deviation amount τ, various deviation amount data stored in the deviation amount storing unit 204 are updated to the calculated values. The updated deviation amount data are referred in the printing job generated after the updating timing (later than $T_{p2}$ in the first row in FIG. 17). Time lag $T_{ds}$ plus required time to calculate deviation amount data τ equals to time between print job starting timing for misalignment detecting pattern image and finishing updating deviation amount data, and that indicates time that blocks prompt updating of data (hereinafter referred to as wasting time). In FIG. 17, time interval to form the misalignment detecting pattern image $T_s$ equals to time between finishing updating deviation amount data after detecting the first misalignment detecting pattern image and standard posture timing after time required for the next deviation amount data updating process (hereinafter referred to as pattern interval standard time). That is, there is no carry-over in FIG. 17. In the image forming apparatus of this embodiment, the pattern interval standard time is set longer than the wasting time.

The major reason for variation of various deviation amounts is temperature variation, so that changes relatively slowly (gradually). For example, that variation is of the order of several minutes. The pattern interval standard time can be shortened in response to that variation velocity, so if the pattern interval standard time is set to several seconds, the position shift detecting pattern is formed for several printed pages in the image forming apparatus that can print 60 pages per minutes. In the example shown in FIG. 16, misalignment detecting pattern images $I_{pp}$ are formed in the inter-sheet corresponding area on the intermediate transferring belt 8 for every three printouts.

The eighth row of the chart indicates job timing of the secondary transferring at the secondary transferring nip. The misalignment detecting pattern image passes through the secondary transferring nip in the state of being kept on the front surface of the belt. To accomplish this, applying the secondary transferring bias is stopped during the time that the misalignment detecting pattern image is going into the secondary transferring nip.

Next, image forming apparatuses of other embodiments added more distinguishing configuration are described below. It should be noted configuration of image forming apparatuses of each embodiment is the same as described above unless otherwise noted.

First Embodiment

Figure 18:
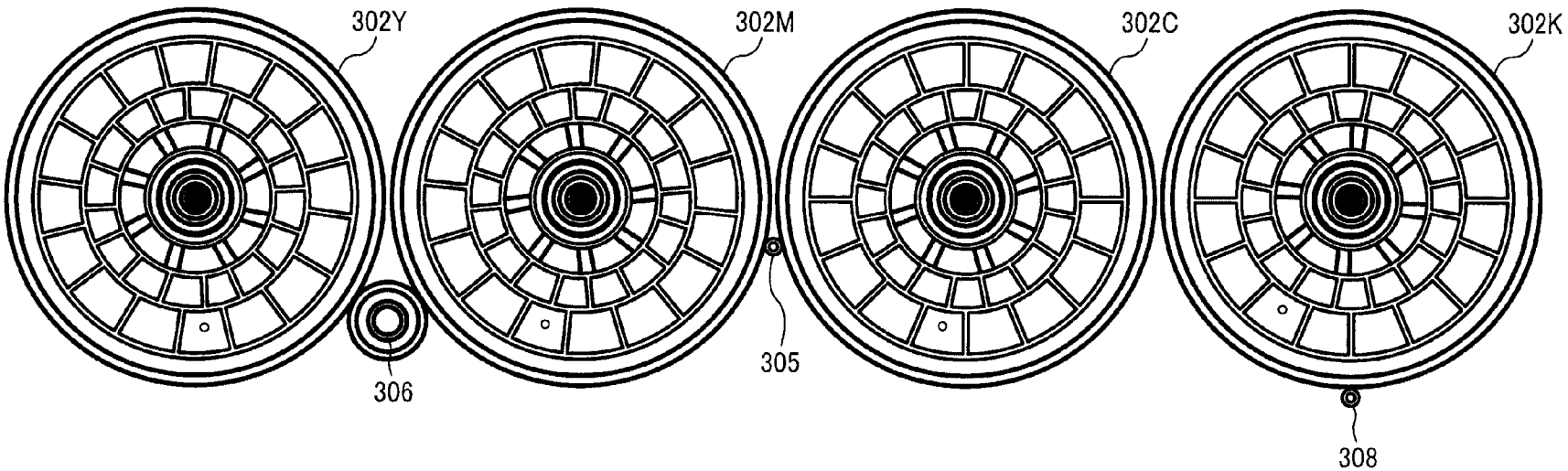
FIG. 18 is an enlarged view illustrating a part of a driving system that rotates photoconductors for 1Y, 1M, 1C, and 1K of the image forming apparatus as the first embodiment of the present invention.

FIG. 18 is an enlarged view illustrating a part of a driving system that rotates photoconductors for 1Y, 1M, 1C, and 1K of the image forming apparatus of the first embodiment. In the image forming apparatus of the first embodiment, there is no relay gear that relays driving between the C photoconductor gear 302C and the K photoconductor gear 302K. So, if the driving gear 305 rotates located between the M photoconductor gear 302M and the C photoconductor gear 302C, that driving force is not conveyed to the K photoconductor gear 302K. The K photoconductor gear 302K engages with a second driving gear 308 that drives the K photoconductor gear 302K dedicatedly, and the second driving gear 308 is fixed to axis of a motor different from the motor connected to the driving gear 305. That is, in the image forming apparatus of the first embodiment, while the Y, M, and C photoconductors 1Y, 1M, and 1C are driven by one motor (hereinafter referred to as color photoconductor motor), the K photoconductor 1K is driven by another motor (hereinafter referred to as K photoconductor motor).

In monochrome mode in which monochrome images are formed, it is not necessary to drive the Y, M, and C image forming units 6Y, 6M, and 6C. Therefore, in monochrome mode, the controller drives solenoid that changes tensing posture of the intermediate transferring belt 8. By changing the tensing posture of the belt, the intermediate transferring belt 8 is removed from the Y, M, and C photoconductors 1Y, 1M, and 1C. In this condition, printing jobs are executed by driving the K photoconductor motor only. It should be noted that no color misalignment is generated in monochrome mode, so deviation amount data updating process and image information correcting process are omitted regardless of number of printing pages.

By executing monochrome mode accordingly, rotating phase difference between the K photoconductor 1K driven by the K photoconductor gear 302K and the Y photoconductor 1Y driven by the Y photoconductor gear 302Y can be different from predefined standard phase difference (rotating phase difference at the time of being manufactured). However, among Y, M, and C, rotating phase difference of photoconductors remains the same as the one at the time of being manufactured since one or two out of three photoconductor gears is not driven separated from other photoconductor gears.

Since the relationship of rotating phase difference between the K photoconductor 1K and the Y, M, and C photoconductors 1Y, 1M, and 1C does not remain constant, it is necessary to monitor the behavior of variation of rotation angle by different sensor from the K rotation posture detecting sensor 309K. Therefore, in the image forming apparatus of the first embodiment, a rotation posture detecting sensor that detects if the Y photoconductor 1Y takes predefined rotation angle posture. Subsequently, standard posture timing of the Y, M, and C photoconductors 1Y, 1M, and 1C is detected based on the detecting result by the Y rotation posture detecting sensor.

It should be noted, after stabilizing rotation velocity of four photoconductors 1Y, 1M, 1C, and 1K in color mode, phase difference of periodic position shift variation curve for the photoconductors 1Y, 1M, 1C and 1K respectively until stopping process for those rotating drive is executed. Consequently, at the time of correcting Y, M, C and K color separation image data, the image data correcting unit 203 firstly figures out phase difference based on result of detecting difference between standard posture timing of the K photoconductor 1K and standard posture timing of the Y, M, and C photoconductor 1Y, 1M, and 1C. Subsequently, based on the figured out phase difference, the image data correcting unit 203 estimates precisely rotation angle posture of the photoconductors 1Y, 1M, 1C, and 1K respectively at the time of start optical writing the first row, and specifies periodic position deviation amount of each pixel in the sub-scanning direction.

Second Embodiment

If any of photoconductor gears 302Y, 302M, 302C, and 302K is replaced, periodic position shift variation curve of the color is different from the one before the replacement, since eccentricity amount and eccentricity position of the replaced gear are different from the previous gear. Nevertheless, if periodic position deviation amount is figured out by using periodic position shift variation curve of the photoconductor gear before the replacement, some error is put out from the actual periodic position deviation amount and it is difficult to reduce color misalignment due to periodic position shift.

To cope with this issue, in the image forming apparatus of the second embodiment, measuring process of periodic position shift to measure periodic position deviation amount after replacement of gear for each color of Y, M, C, and K is executed based on a user's operation.

Figure 19:
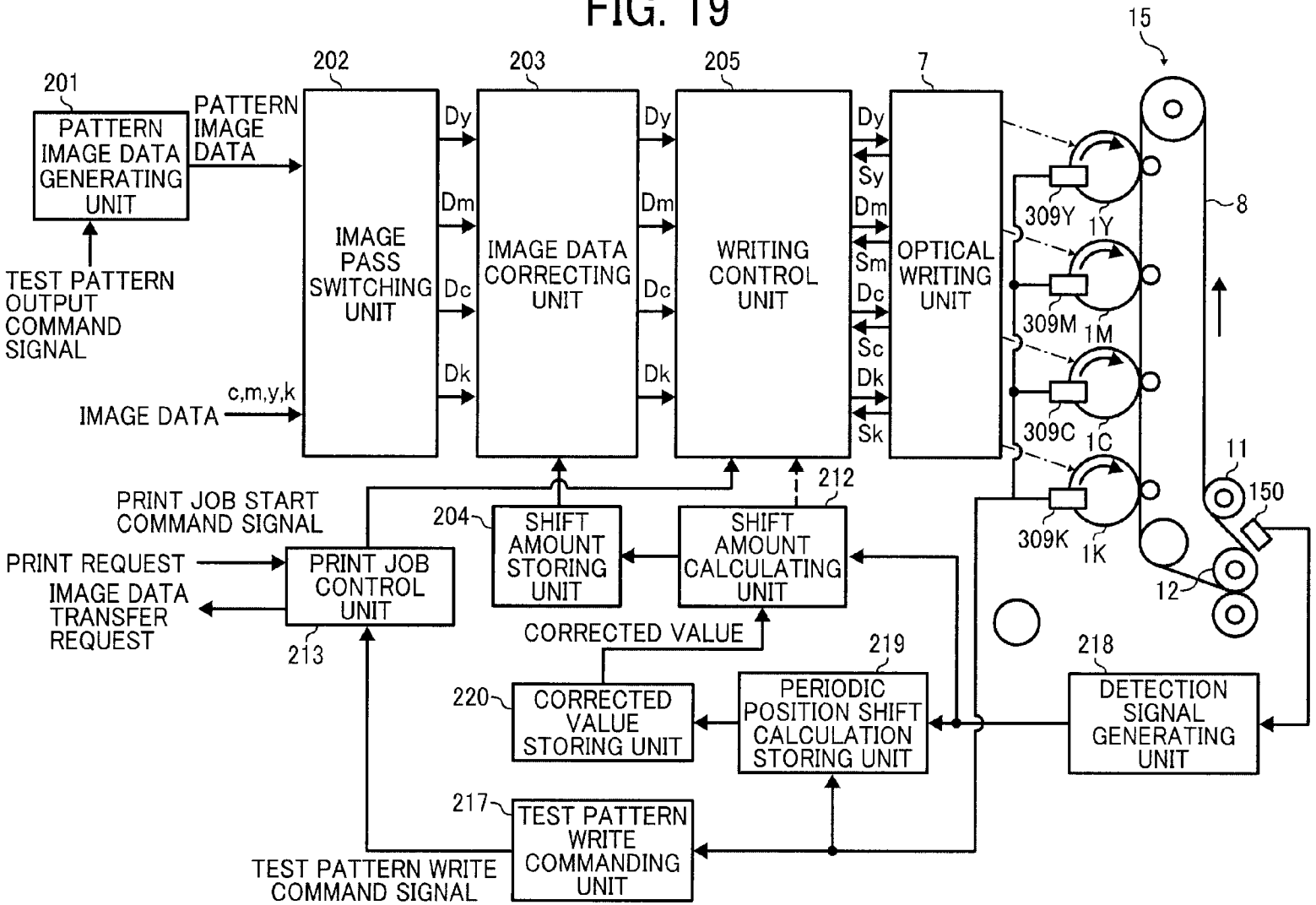
FIG. 19 is a diagram illustrating photoconductors for Y, M, C, and K and a transferring unit with a part of electrical circuit of the image forming apparatus as the second embodiment of the present invention.

FIG. 19 is a diagram illustrating the Y, M, C, and K photoconductors 1Y, 1M, 1C, and 1K and the transferring unit 15 with a part of electrical circuit of the image forming apparatus of the second embodiment. In the image forming apparatus of the second embodiment, Y, M, C, and K rotation posture detecting sensors 309Y, 309M, 309C, and 309K that correspond to the Y, M, C, and K photoconductors 1Y, 1M, 1C, and 1K respectively are set.

Figure 20:
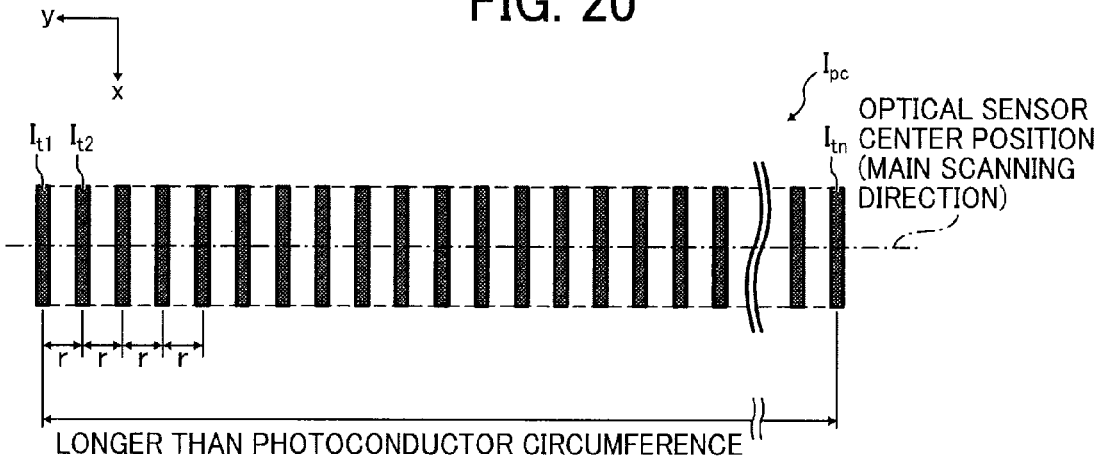
FIG. 20 is a diagram illustrating a periodic shift detecting pattern image formed in a periodic position shift measuring process as an embodiment of the present invention.
Figure 21:
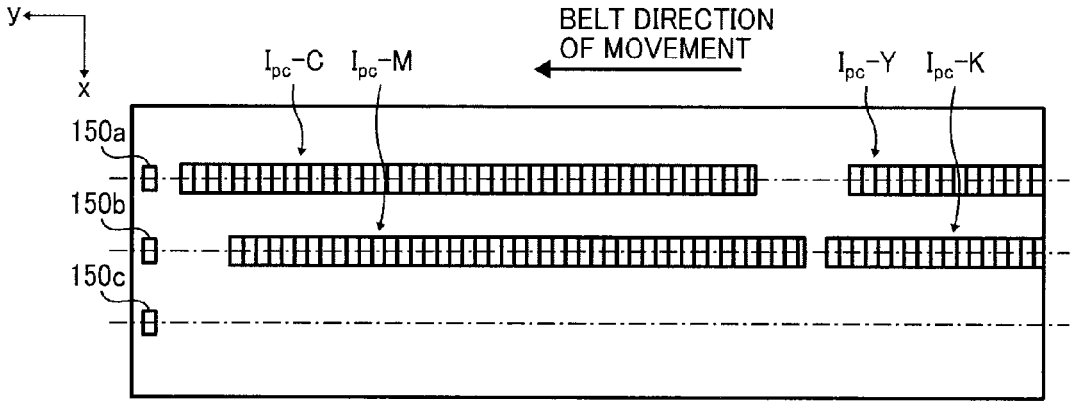
FIG. 21 is an enlarged view illustrating four periodic shift detecting pattern images with the intermediate transferring belt as an embodiment of the present invention.

After receiving a message from a user that says that the photoconductor gear is replaced, the controller executes periodic position shift measuring process. In this periodic position shift measuring process, periodic shift detecting pattern images $I_{pc}$ as shown in FIG. 20 are formed for four colors Y, M, C, and K respectively on the intermediate transferring belt 8. In FIG. 21, the periodic shift detecting pattern image $I_{pc}$ consists of n test images laid out in sequence at predefined space r in the direction of movement of the belt (the sub-scanning direction). The distance between the first test image $I_{t1}$ formed at the top in the direction of movement of the belt (y direction) and the nth test image $I_{tn}$ formed lastly is longer than the circumference of the photoconductor. That is, the length of the periodic shift detecting pattern image $I_{pc}$ in the sub-scanning direction is longer than the circumference of the photoconductor.

In the image forming apparatus of the second embodiment, C periodic shift detecting pattern image $I_{pc}$-C and Y periodic shift detecting pattern image $I_{pc}$-Y are formed sequentially on the area that can be detected by the first optical sensor 150*a* on the intermediate transferring belt 8 as shown in FIG. 21. The first test image of each pattern image is started optical writing at the time of standard posture timing of photoconductor of corresponding color or elapsing predefined time after standard posture timing. That is, the first test image is formed on the area of photoconductor that goes into optical writing position at the time of standard posture timing or elapsing predefined time after standard posture timing.

M periodic shift detecting pattern image $I_{pc}$-M and K periodic shift detecting pattern image $I_{pc}$-K are formed sequentially on the area that can be detected by the second optical sensor 150*b* on the intermediate transferring belt 8. Also, these first test images are started optical writing at the time of standard posture timing of photoconductor of corresponding color or elapsing predefined time after standard posture timing.

Figure 22:
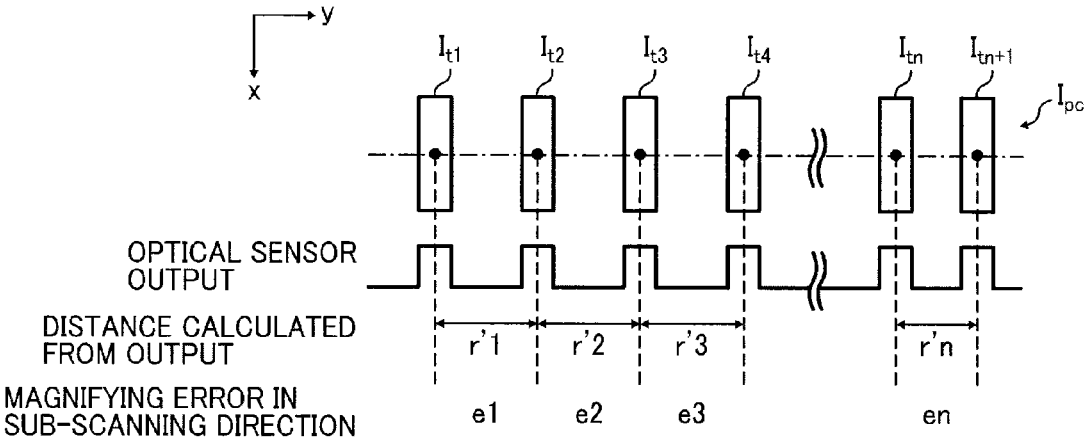
FIG. 22 is an enlarged view illustrating a relationship between each test image in periodic shift detecting pattern image and magnification error in the sub-scanning direction e at the time of starting sampling as an embodiment of the present invention.

FIG. 22 is an enlarged view illustrating a relationship between each test image in periodic shift detecting pattern image $I_{pc}$ and magnification error in the sub-scanning direction e at the time of starting sampling. In FIG. 22, a first measured distance $r'_1$ is actual measured distance between center point of the first test image $I_{t1}$ in periodic shift detecting pattern image $I_{pc}$ in the sub-scanning direction and center point of the second test image $I_{t2}$ in periodic shift detecting pattern image $I_{pc}$ in the sub-scanning direction. A second measured distance $r'_2$ is actual measured distance between center point of the second test image $I_{t2}$ in periodic shift detecting pattern image $I_{pc}$ in the sub-scanning direction and center point of the third test image $I_{t3}$ in periodic shift detecting pattern image $I_{pc}$ in the sub-scanning direction. A third measured distance $r'_3$ is actual measured distance between center point of the third test image $I_{t3}$ in periodic shift detecting pattern image $I_{pc}$ in the sub-scanning direction and center point of the fourth test image $I_{t4}$ in periodic shift detecting pattern image $I_{pc}$ in the sub-scanning direction. A nth measured distance $r'_n$ is actual measured distance between center point of the nth test image $I_{tn}$ in periodic shift detecting pattern image $I_{pc}$ in the sub-scanning direction and center point of the n+1th test image $I_{tn+1}$ in periodic shift detecting pattern image $I_{pc}$ in the sub-scanning direction. Those measured distances are as the same value as standard distance r if there is no magnification error in the sub-scanning direction due to eccentricity of photoconductors etc.

The ratio of each various measured distances ($r'_1$, $r'_2$, $r'_3$, and $r'_n$) shown in FIG. 22 to standard distance r is magnification error in the sub-scanning direction of test image corresponding to each actual measured value. The periodic position shift calculation storing unit 219 calculates various magnification error in the sub-scanning direction $e_1$, $e_2$, $e_3$, and $e_n$ by using following equation:

$$e_1 = r'_1 \div r$$

$$e_2 = r'_2 \div r$$

$$e_3 = r'_3 \div r$$

$$e_n = r'_n \div r$$

These processes to calculate magnification error in the sub-scanning direction are executed for each color of Y, M, C, and K.

The periodic position shift calculation storing unit 219 calculates magnification error in the sub-scanning direction e for one cycle of the photoconductor for each color of Y, M, C, and K respectively and stores the results to the deviation amount storing unit 204.

In this configuration, even if magnification error in the sub-scanning direction e for Y, M, C, and K turn to unreasonable values due to replacement of photoconductor gear, periodic position shift correcting ability can be prevented from deteriorating due to replacement of gear by measuring and storing the new magnification error in the sub-scanning direction e after replacing the gear.

Figure 23:
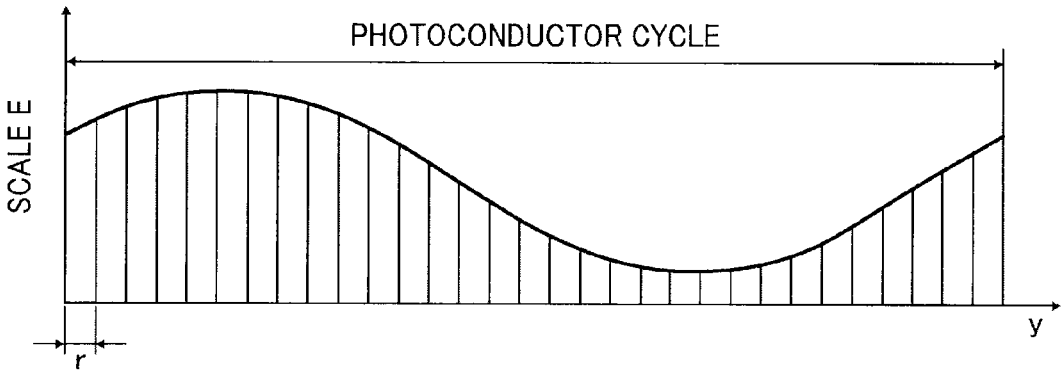
FIG. 23 is a chart illustrating error of magnifications e in the sub-scanning direction due to periodic position error as an embodiment of the present invention.

It should be noted that an example of magnification error in the sub-scanning direction e for one cycle of photoconductor is shown in FIG. 23 for reference.

The controller measures reduction ratio λ of recording sheet based on a user operation. More specifically, first, the K periodic shift detecting pattern image $I_{pc}$-K is formed on the intermediate transferring belt 8. In this process, regarding forming image, after correcting the K color separation image data by the image data correcting unit 203 based on the K periodic position shift variation curve, the controller starts optical writing on the K photoconductor 1K at the timing estimated in the correction. Therefore, each test image of the formed K periodic shift detecting pattern image $I_{pc}$-K is prevented from periodic position shift by image processing.

Next, the controller transfers secondary the formed K periodic shift detecting pattern image $I_{pc}$-K to the front side of the recording sheet P. After sending the recording sheet P to the fixing unit 20, the controller sends the recording sheet to the secondary transferring nip again. Concurrently, the controller forms the K periodic shift detecting pattern image $I_{pc}$-K on the intermediate transferring belt 8 in the same way described above. Subsequently, after transferring the K periodic shift detecting pattern image $I_{pc}$-K to the back side of the recording sheet P, the controller sends the recording sheet to the fixing unit 20.

A duplex scanner (not shown) is connected to the image forming apparatus of the second embodiment, and the controller can communicate with the controller of the double-side scanner. A user sets the recording sheet on which the K periodic shift detecting pattern image $I_{pc}$-K is fixed on both side, and has the scanner scan the K periodic shift detecting pattern images $I_{pc}$-K formed on both side of the recording sheet P. Image data generated by the scanning is sent to the controller of the image forming apparatus.

Figure 24:
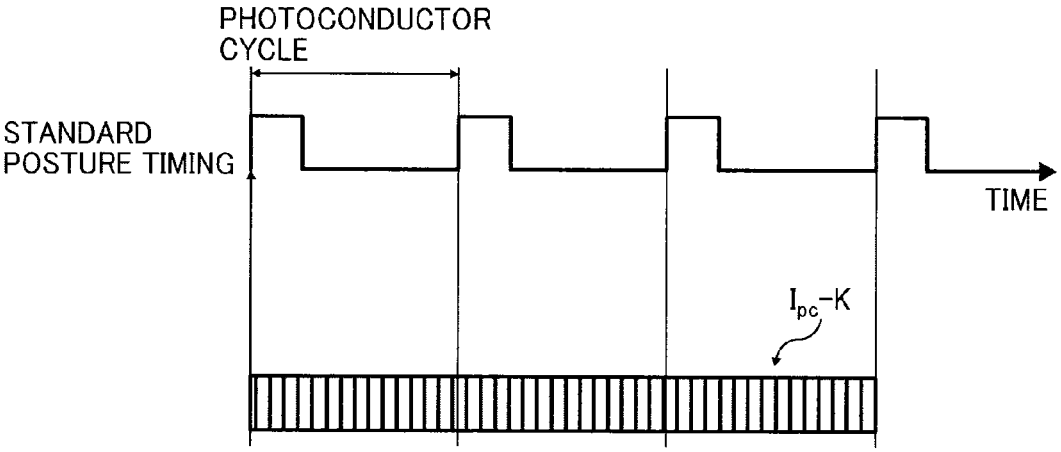
FIG. 24 is a diagram illustrating a relationship between pattern image for detecting K periodic position shift formed in shrinkage ratio measuring process and standard posture timing as an embodiment of the present invention.

In reduction ratio measuring process, three sequential subunit whose length is equal to circumference of the photoconductor in the direction of movement of the belt as the K periodic shift detecting pattern image $I_{pc}$-K is formed as shown in FIG. 24. It should be noted that the length of periodic shift detecting pattern image is not limited to circumference of the photoconductor.

Figure 25:
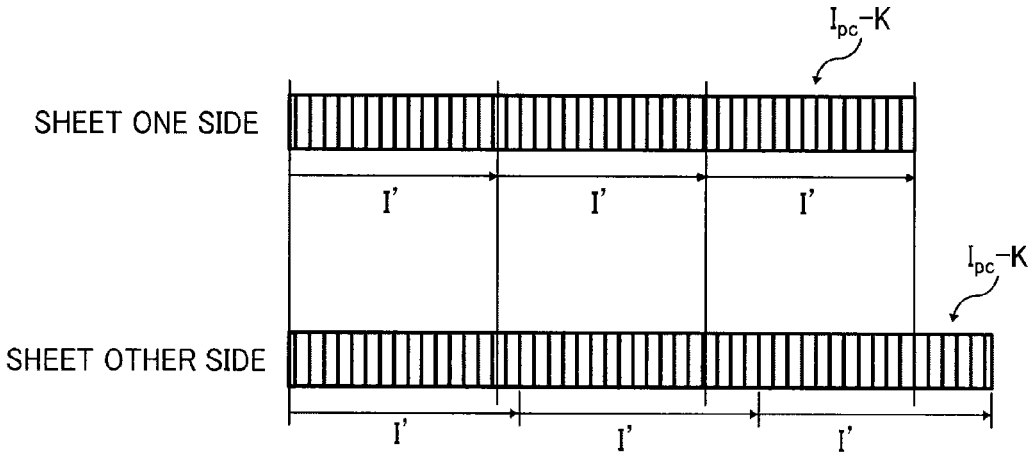
FIG. 25 is a diagram illustrating a relationship between subunit length (I') of pattern image for detecting K periodic position shift formed on the first page of recording sheet and subunit length (I) of pattern image for detecting K periodic position shift formed on the second page of recording sheet as an embodiment of the present invention.

When the recording sheet on which the K periodic shift detecting pattern image $I_{pc}$-K is formed on the front side only is sent to the fixing unit 20, the recording sheet evaporates moisture and shrinks. By contrast, when the recording sheet on which the K periodic shift detecting pattern image $I_{pc}$-K is formed on the back side too is sent to the fixing unit 20, the recording sheet seldom shrinks since most of moisture in the recording sheet evaporated in the first fixing process. Therefore, length of respective three subunits of the K periodic shift detecting pattern image $I_{pc}$-K formed on the back side (hereinafter referred to as back side subunit length I) is nearly equal to circumference of the photoconductor as shown in FIG. 25. By contrast, length of respective three subunits of the K periodic shift detecting pattern image $I_{pc}$-K formed on the front side (hereinafter referred to as front side subunit length I') is shorter than circumference of the photoconductor since the recording sheet shrank in the first fixing process.

The controller divides the front side subunit length I' by the back side subunit length I for three subunits of the K periodic shift detecting pattern image $I_{pc}$-K respectively. Subsequently, the controller calculates reduction ratio λ as average value of the three dividing results, and updates the reduction ratio λ stored in the deviation amount storing unit 204 with the newly calculated value. Or, the controller appends the value into the deviation amount storing unit 204.

The reason why aspect of appending is also included is because reduction ratio λ of recording sheet is different depending on conditions such as sheet material (paper type), sheet thickness, and fixing temperature. Therefore, reduction ratio λ is stored for each combination of conditions such as sheet material, sheet thickness, and fixing temperature. Information on conditions such as sheet material and sheet thickness is provided to the controller by a user operation.

Third Embodiment

In the image forming apparatus of the third embodiment, measuring process of periodic position shift to measure periodic position deviation amount after replacement of gear for each color of Y, M, C, and K is also executed based on a user's operation. The difference from the second embodiment is number of formed periodic shift detecting pattern image $I_{pc}$ formed in the periodic position shift measuring process and formed position for each color.

Figure 26:
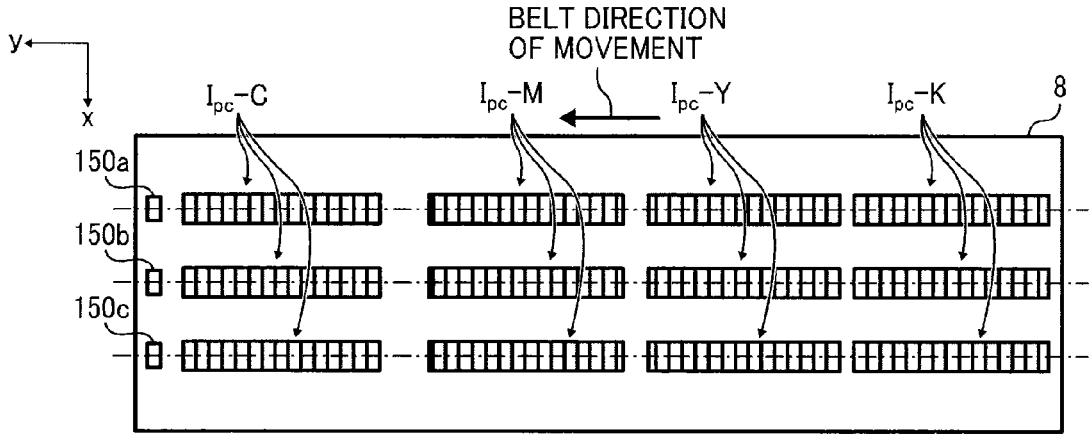
FIG. 26 is a diagram illustrating various periodic shift detecting pattern images formed in a periodic position shift measuring process with the intermediate transferring belt of the image forming apparatus as the third embodiment of the present invention.

FIG. 26 is a diagram illustrating various periodic shift detecting pattern images $I_{pc}$ formed in the periodic position shift measuring process with the intermediate transferring belt 8 in the image forming apparatus of the third embodiment. In the image forming apparatus of the third embodiment, three periodic misalignment detecting pattern images $I_{pc}$ are formed for each color in the periodic position shift measuring process. The three periodic misalignment detecting pattern images $I_{pc}$ for the same color is laid out sequentially in the main scanning direction of the belt so that internal test image is formed at almost the same timing with each other. More specifically, the first periodic misalignment detecting pattern image $I_{pc}$ for the same color is formed around one end in the main scanning direction of the belt so that the first optical sensor 150*a* can detect it. Also, the second periodic misalignment detecting pattern image $I_{pc}$ for the same color is formed around the center in the main scanning direction of the belt so that the second optical sensor 150*b* can detect it. Also, the third periodic misalignment detecting pattern image $I_{pc}$ for the same color is formed around the other end in the main scanning direction of the belt so that the third optical sensor 150*c* can detect it.

The periodic position shift calculating unit 219 calculates the average of periodic position deviation amount of test image for three periodic misalignment detecting pattern images $I_{pc}$ for each color Y, M, C, and K. For example, regarding the Y periodic shift detecting pattern image $I_{pc}$-Y, the periodic position shift calculating unit 219 calculates the average by dividing the total of periodic position deviation amount $\Delta t_1$ of the first test image $I_{t1}$ formed around one end in the main scanning direction of the belt, periodic position deviation amount $\Delta t_1$ of the first test image $I_{t1}$ formed around the center in the main scanning direction of the belt, and periodic position deviation amount $\Delta t_1$ of the first test image $I_{t1}$ formed around the other end in the main scanning direction of the belt by three. Likewise, regarding periodic position deviation amount from $\Delta t_2$ through $\Delta t_n$, the average of values on one end, center, and the other end of the belt is calculated. By calculating average values accordingly, effect of mixing noise can be reduced and periodic position deviation amount can be detected precisely.

Fourth Embodiment

In the configuration by optical writing latent image by the optical writing unit 7, due to optical characteristic of optical parts in the optical writing unit 7, optical writing position error in the main scanning direction on coordinate system of main scanning direction (photoconductor rotation axis direction) is generated. Hereinafter, characteristic of this optical writing position error is referred to as first optical characteristic. Also, due to optical characteristic described above, optical writing position error in the sub-scanning direction on coordinate system of main scanning direction (photoconductor surface direction of movement) is generated. Hereinafter, characteristic of this optical writing position error is referred to as second optical characteristic. The first optical characteristic and the first optical characteristic are indicated by non-linear chart respectively.

Figure 27:
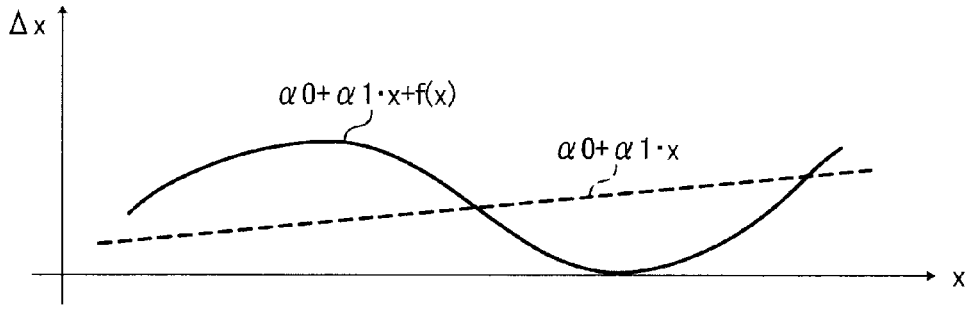
FIG. 27 is a chart illustrating an example of characteristic of optical writing position error in the main scanning direction in the coordinate system of the main scanning direction as an embodiment of the present invention.

FIG. 27 is a chart illustrating an example of characteristic of optical writing position error in the main scanning direction in the coordinate system of the main scanning direction. The chart indicates characteristic that actual optical writing position in the main scanning direction deviates to the vertical axis (Δx) against coordinate system in the main scanning direction indicated by the horizontal axis (x). The characteristic indicated by this chart also includes the first optical characteristic due to optical parts and deviation factors indicated by linear chart such as registration difference in the main scanning direction and whole magnification error deviation in the main scanning direction.

This chart is approximated by following polynomial equation:

$$\Delta x(x)=\alpha_0\alpha_1 x+\alpha_2 x^2+\alpha_3 x^3+\ldots \rightarrow \quad \text{Equation (1)}$$

In the equation (1), the zero-order factor $\alpha_0$ indicates registration difference in the main scanning direction and the first-order factor $\alpha_1$ indicates whole magnification error deviation in the main scanning direction. If f(x) indicates the sum of higher order elements higher than second order indicating non-linear characteristic, equation (1) can be converted to following equation:

$$\Delta x(x)=\alpha_0\alpha_1 x+f(x)\rightarrow \quad \text{Equation (1')}$$

Figure 28:
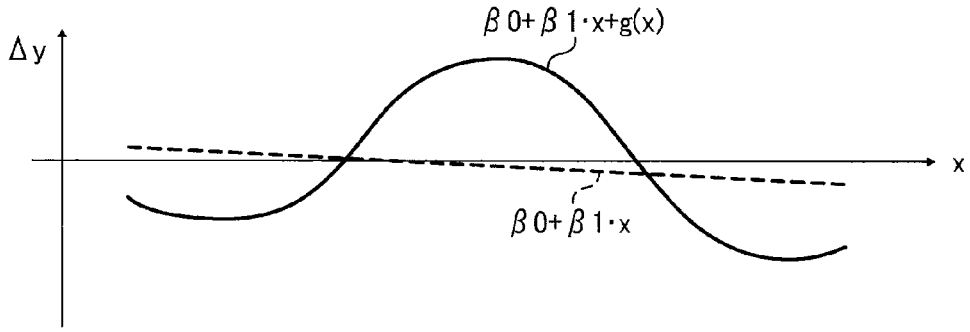
FIG. 28 is a chart illustrating an example of characteristic of optical writing position error in the sub-scanning direction in the coordinate system of the main scanning direction as an embodiment of the present invention.

FIG. 28 is a chart illustrating an example of characteristic of optical writing position error in the sub-scanning direction in the coordinate system of the main scanning direction. The chart indicates characteristic that actual optical writing position in the sub-scanning direction deviates to the vertical axis (Δy) against theoretical y-coordinate corresponding to x-coordinate in coordinate system in the main scanning direction indicated by the horizontal axis (x). The characteristic indicated by this chart also includes the second optical characteristic due to optical parts and deviation factors indicated by linear chart such as registration difference in the sub-scanning direction and skew difference.

This chart is approximated by following polynomial equation:

$$\Delta y(x)=\beta_0+\beta_1 x+\beta_2 c^2+\beta_3 x^3+\ldots\rightarrow \quad \text{Equation (2)}$$

In the equation (2), the zero-order factor $\beta_0$ indicates registration difference in the sub-scanning direction and the first-order factor $\beta_1$ indicates skew difference. If g(x) indicates the sum of higher order elements higher than second order indicating non-linear characteristic, equation (2) can be converted to following equation:

$$\Delta y(x)=\beta_0+\beta_1 x' g(x)\rightarrow \quad \text{Equation (2')}$$

If temperature inside the image forming apparatus changes in consecutive printing, characteristic shown in FIG. 27 and FIG. 28 changes from the illustrated one. However, depending type of optical parts used in the image forming apparatus, while linear characteristic of deviation factors such as registration difference, whole magnification error deviation, and skew difference changes largely in response to change of internal temperature of the image forming apparatus, sometimes function f(x) as non-linear first optical characteristic and function g(x) second optical characteristic do not changes so much. Accordingly, in the image forming apparatus of this embodiment, optical parts that can keep non-linear first optical characteristic and second optical characteristic against change of internal temperature of the image forming apparatus. That is, in the image forming apparatus of this embodiment, non-linear first optical characteristic and second optical characteristic hardly change even if internal temperature of the image forming apparatus changes. It should be noted that zero-order factors $\alpha_0$, $\beta_0$ and first-order factors $\alpha_1$, $\beta_1$ in four equations described above change since linear characteristic changes sensitively against change of internal temperature of the image forming apparatus.

Figure 29:
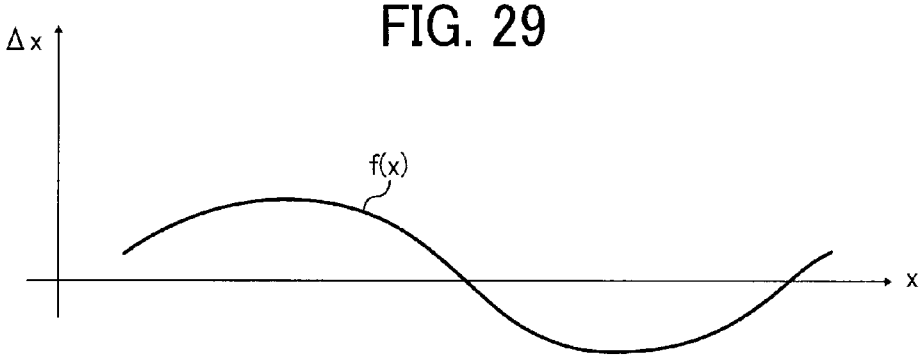
FIG. 29 is a chart illustrating an example of changing the characteristic shown in FIG. 27 by temperature change as an embodiment of the present invention.
Figure 30:
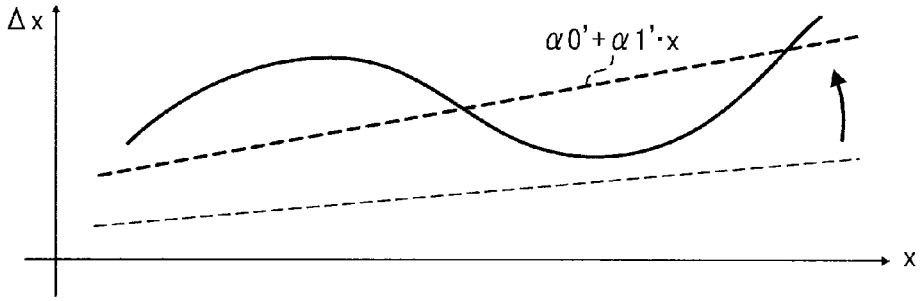
FIG. 30 is a chart illustrating another example of changing the characteristic shown in FIG. 27 by temperature change as an embodiment of the present invention.

The characteristic shown in FIG. 27 sometimes changes to characteristics such as those shown in FIG. 29 and FIG. 30 if temperature changes. In the characteristic shown in FIG. 29, while zero-order factor $\alpha_0$ and first-order factor $\alpha_1$ change largely from the state shown in FIG. 27, function f(x) as non-linear first optical characteristic does not change. Also, in the characteristic shown in FIG. 30, while zero-order factor $\alpha_0$ and first-order factor $\alpha_1$ change largely from the state shown in FIG. 27, function f(x) does not change.

Figure 31:
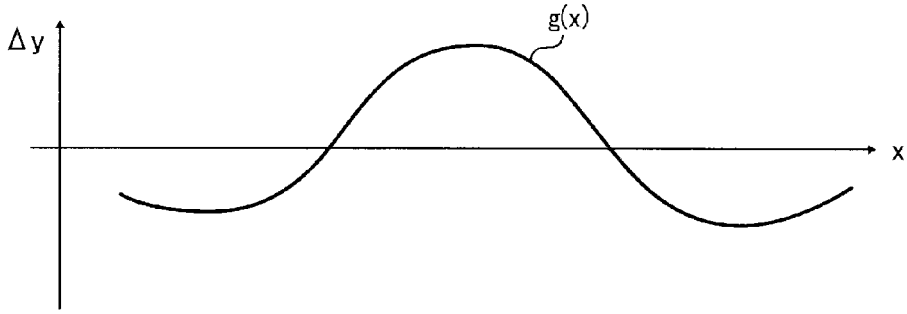
FIG. 31 is a chart illustrating an example of changing the characteristic shown in FIG. 28 is changed by temperature change as an embodiment of the present invention.
Figure 32:
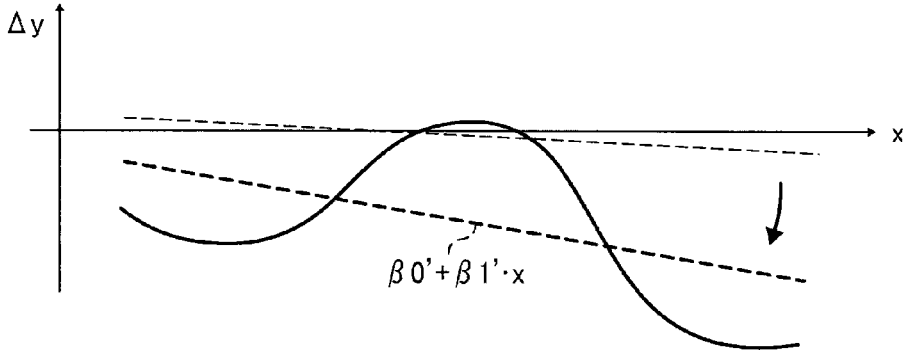
FIG. 32 is a chart illustrating another example of changing the characteristic shown in FIG. 28 by temperature change as an embodiment of the present invention.

Also, the characteristic shown in FIG. 27 sometimes changes to characteristics such as those shown in FIG. 31 and FIG. 32 if temperature changes. In characteristic shown in FIG. 31, while zero-order factor $\beta_0$ and first-order factor $\beta_1$ change largely from the state shown in FIG. 28, function g(x) as non-linear second optical characteristic does not change. Also, in characteristic shown in FIG. 32, while zero-order factor $\beta_0$ and first-order factor $\beta_1$ change largely from the state shown in FIG. 28, function g(x) does not change.

Figure 33:
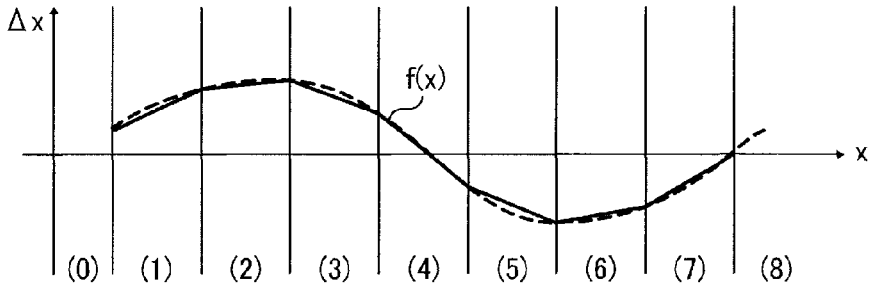
FIG. 33 is a chart illustrating a relationship among the first optical characteristic (function f(x)), divided areas, and approximate linear formula as an embodiment of the present invention.

The deviation amount storing unit 204 partitions optical writing area in the main scanning direction into a plurality of partitioned areas and stores approximate linear data for first optical characteristic (function f(x)) and second optical characteristic (function g(x)) in each partitioned area. For example, regarding first optical characteristic, the deviation amount storing unit 204 partitions scanning feasible area in the main scanning direction into eight partitioned areas from first partitioned area (1) to eighth partitioned area (8) as shown in FIG. 33 and stores approximate linear equation of function f(x) as first optical characteristic data. Also, regarding second optical characteristic, the deviation amount storing unit 204 partitions scanning feasible area in the main scanning direction into eight partitioned areas from first partitioned area (1) to eighth partitioned area (8) as shown in FIG. 34 and stores approximate linear equation of function f(x) as second optical characteristic data.

Accordingly, by partitioning scanning feasible area into a plurality of partitioned areas and storing linear equation as approximation of non-linear expression in each partitioned area, number of areas of color misalignment conversion matrix in image information correcting process can be reduced and calculation in image information correcting process can be simplified. As number of partitioned areas increases, it is possible to improve the precision of linear approximation, calculation in image information correcting process gets complicated by just that much. Each partitioned area does not always have to be equal. For example, maximum and minimum of non-linear curve can be boundary of partitioned areas to minimize the difference between curve and linear approximation.

In FIG. 33, gradient of approximate linear expression in each partitioned area indicates deviation from whole magnification error deviation of magnification error deviation in partitioned area in the main scanning direction ($a_c$, $a_y$, and $a_m$). If i indicates number of partitioned area, the deviation described above is indicated by magnification error $\Delta a_{(i)}$. In each partitioned area, magnification error deviation in the main scanning direction is calculated by adding magnification error $\Delta a_{(i)}$ to whole magnification error deviation in the main scanning direction ($a_c$, $a_y$, and $a_m$). Also, registration difference in the main scanning direction in each partitioned area is calculated by adding first scanning deviation amount at start point of partitioned area $\Delta c_{(i)}$ to registration difference amount in the main scanning direction of whole image whose zero-order factor is $\alpha_0$ ($c_c$, $c_y$, and $c_m$).

Figure 34:
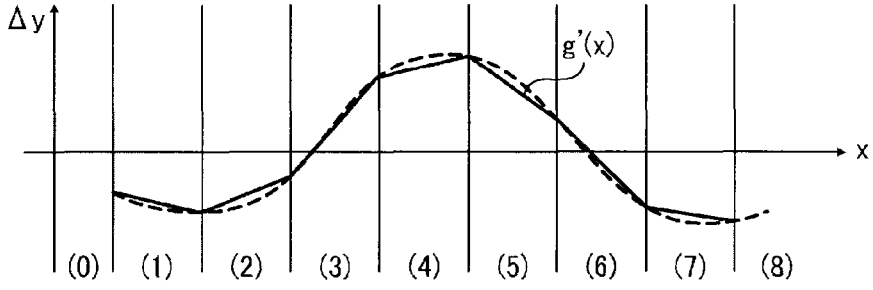
FIG. 34 is a chart illustrating a relationship among the second optical characteristic (function g(x)), divided areas, and approximate linear formula as an embodiment of the present invention.

Also, in FIG. 34, gradient of approximate linear expression in each partitioned area indicates deviation from whole skew in partitioned area. This deviation is indicated by skew deviation $\Delta d_{(i)}$. In each partitioned area, skew difference is calculated by adding skew deviation as gradient of approximate linear expression $\Delta d_{(i)}$ to whole skew difference ($d_c$, $d_y$, and $d_m$). Also, registration difference in the sub-scanning direction in each partitioned area is calculated by adding slow scanning deviation amount at start point of partitioned area $\Delta f_{(i)}$ to registration difference amount in the sub-scanning direction of whole image whose zero-order factor is $\beta_0$ ($f_c$, $f_y$, and $f_m$).

It should be noted that zero-order factors $\alpha_0$, $\beta_0$ and first-order factors $\alpha_1$, $\beta_1$ are calculated based on the timing of detecting respective position detecting images misalignment detecting pattern image in the same way as the embodiment described above.

Figure 35:
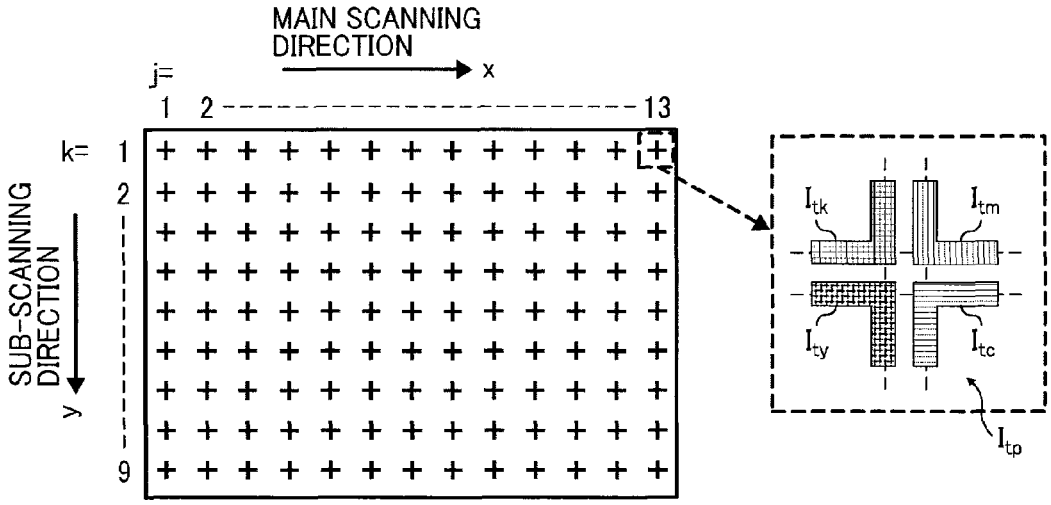
FIG. 35 is a diagram illustrating a test chart image formed in optical characteristic measuring process of the image forming apparatus as the fourth embodiment of the present invention.

The controller executes optical characteristic measuring process that measures first optical characteristic and second optical characteristic based on a user's operation after replacing optical parts. In this optical characteristic measuring process, first, test chart image as shown in FIG. 35 is formed on the recording sheet. A scanner (not shown) is connected to the image forming apparatus of the fourth embodiment, and the controller can communicate with the controller of the scanner. A user sets the recording sheet on which the test chart image is fixed, and has the scanner scan the test chart image formed on the recording sheet P. Image data generated by the scanning is sent to the controller of the image forming apparatus.

Figure 36:
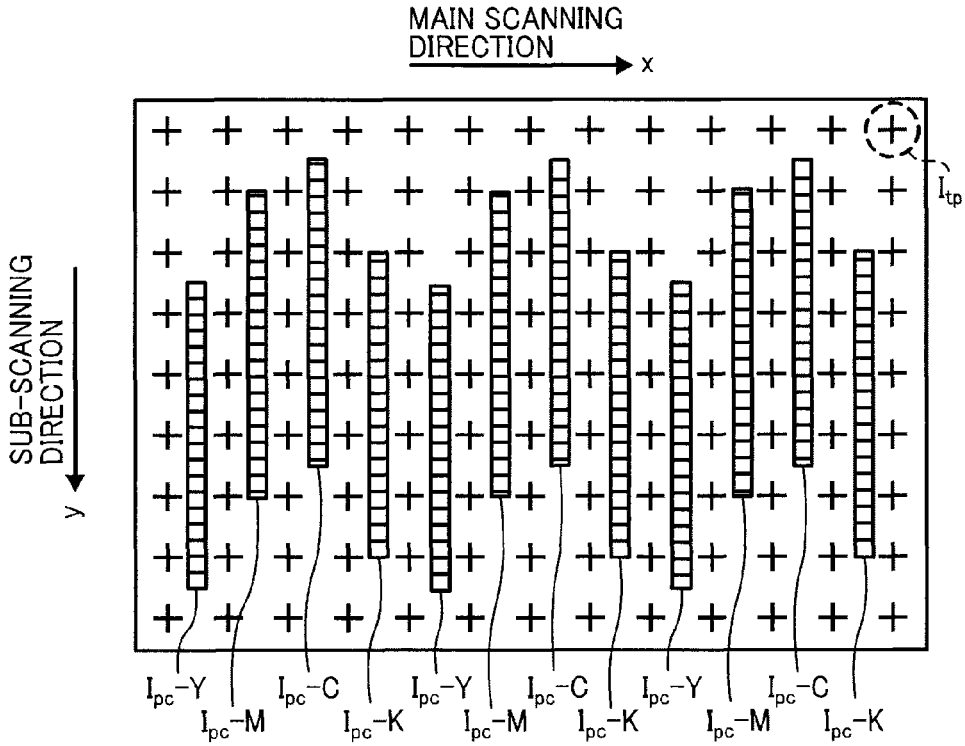
FIG. 36 is a diagram illustrating an example of transformation of the test chart image shown in FIG. 35 as an embodiment of the present invention.

The test chart image consists of a plurality of test pattern images $I_{tp}$ put in a matrix. Each test pattern image $I_{tp}$ includes K test image $I_{tk}$, M test image $I_{tm}$, C test image $I_{tc}$, and Y test image $I_{ty}$ that bend rectangular respectively. The M test image $I_{tm}$ is formed in posture that rotates 90 degrees against the K test image $I_{tk}$.around the rotating point. The C test image $I_{tc}$ is formed in posture that rotates 90 degrees against the M test image $I_{tm}$.around the rotating point. The Y test image $I_{ty}$ is formed in posture that rotates 90 degrees against the C test image $I_{tc}$.around the rotating point. 117 test pattern images $I_{tp}$ are formed in 13 (main scanning direction) by 9 (sub-scanning direction) matrix. It should be noted that the number of test pattern images $I_{tp}$ is not limited to 117. Also, for example as shown in FIG. 36, periodic misalignment detecting pattern image for each color can be formed in test chart image, and periodic position shift variation curve can be built based on scanning result of each position detecting image in the pattern image. In this case, periodic misalignment detecting pattern image is started forming at the predefined timing based on standard posture timing.

The controller obtains coordinate of vertex of each angle for K test image $I_{tk}$, M test image $I_{tm}$, C test image $I_{tc}$, and Y test image $I_{ty}$ for plurality of test pattern images $I_{tp}$ based on image data of test chart image sent from the scanner. Subsequently, the controller calculates deviation from ideal coordinate for each coordinate of vertex, and calculates various deviation amounts for each test pattern image $I_{tp}$.

Deviation amount in the main scanning direction of test pattern image $I_{tp}$ located at column j row k is stored as main scanning direction deviation amount $\Delta x_{jk}$. Also, deviation amount in the sub-scanning direction of test pattern image $I_{tp}$ located at column j row k is stored as sub-scanning direction deviation amount $\Delta y_{jk}$. For column j, the controller calculates the average of main scanning direction deviation amount $\Delta x_j$ and sub-scanning direction deviation amount $\Delta y_j$ respectively for nine test pattern image $I_{tp}$ from k=1 to k=9. Subsequently, main scanning direction deviation amount $\Delta x_j$ and sub-scanning direction deviation amount $\Delta y_j$ are stored respectively from the result of calculation described above. Effect on mixing noise ca be eliminated and deviation amount can be calculated at high precision by calculating the average. It should be noted that the example with the first optical characteristic only in this paragraph.

Next, regarding main scanning direction deviation amount $\Delta x_j$, approximate line between x-coordinate and deviation amount in the main scanning direction coordinate ($\Delta x$ coordinate) in two-dimensional plane with x-axis and y-axis. Subsequently, function f(x) (i.e. first optical characteristic) is calculated by subtracting zero-order factor $\alpha_0$ and first-order factor $\alpha_1$ of the approximate line respectively from functional expression that indicates relationship between x-coordinate and $\Delta x$ coordinate in the two-dimensional coordinate system described above.

Also, regarding sub-scanning direction deviation amount $\Delta y_j$, approximate line between x-coordinate and deviation amount in the sub-scanning direction coordinate ($\Delta y$ coordinate) in two-dimensional plane with x-axis and y-axis. Subsequently, function g(x) (i.e. second optical characteristic) is calculated by subtracting zero-order factor $\beta_0$ and first-order factor $\beta_1$ of the approximate line respectively from functional expression that indicates relationship between x-coordinate and Ay coordinate in the two-dimensional coordinate system described above.

Subsequently, in the scanning feasible area in the main scanning direction, first partition area between the center of test pattern image $I_{tp}$ in column 1 (j=1) in the main scanning direction and the center of test pattern image $I_{tp}$ in column 2 (j=2) in the main scanning direction is specified. Also, second partition area between the center of test pattern image $I_{tp}$ in column 2 in the main scanning direction and the center of test pattern image $I_{tp}$ in column 3 (j=3) in the main scanning direction is specified. Likewise, third partition area (j=3 to 4), fourth partition area (j=4 to 5), fifth partition area (j=5 to 6), sixth partition area (j=6 to 7), seventh partition area (j=7 to 8), eighth partition area (j=8 to 9), ninth partition area (j=9 to 10), tenth partition area (j=10 toll), eleventh partition area (j=11 to 12), and twelfth partition area (j=12 to 13) are specified.

After specifying positions of twelve partition areas, approximate linear expression $f'(x_j)$ and $g'(x_j)$ of function f(x) and g(x) respectively for each partition area. Subsequently, the approximate linear expression $f(x_j)$ and $g'(x_j)$ are stored in the deviation amount storing unit 203. The method to calculate various deviation amount from linear expression $f'(x_j)$ and $g'(x_j)$ was already described above. It should be noted that number of partition areas does not always have to be equal to number of columns of matrix of test pattern image $I_{tp}(j)$.

Test chart image can be formed with image data executed image information correcting process on various deviation amount except periodic position shift by the image data correcting unit 203, or can be formed with image data not executed image information correcting process for various deviation amount. In both cases, test chart image is formed under the condition of specified relationship between line position and position on the photoconductor in the circumferential direction starting optical writing the first line to form test chart image at the predefined timing based on standard posture timing. Subsequently, y-coordinate of vertex of each angle for K test image $I_{tk}$, M test image $I_{tm}$, C test image $I_{tc}$, and Y test image $I_{ty}$ in test pattern image $I_{tp}$ are corrected by using periodic position deviation amount in the sub-scanning direction of corresponding line number (first scanning line). After correcting y-coordinate for all test pattern image $I_{tp}$ in the same way and removing periodic position error from vertex position, main scanning direction deviation amount $\Delta x_j$ and sub-scanning direction deviation amount $\Delta y_j$ are calculated. Subsequently, approximate linear expression f'(x) and $g'(x_j)$ in each partition area by dealing with function f(x) and g(x) calculated based on the result above as first optical characteristic and second optical characteristic as is.

Regarding matrix A for converting color misalignment shown in Equation 2 and equations shown in Equation 3, 4, and 5, those calculations are executed respectively in each partition area. For example, as for matrix A, matrix A, is calculated for respective 13 partition areas for natural number i=1 to 13. Accordingly, superimposing deviation due to first optical characteristic and second optical characteristic can be reduced with high precision in each partition area.

Matrix A, is calculated by the following equation:

$$A_i = \begin{pmatrix} a'_i & 0 & c_i \\ d_i & e & f_i \\ 0 & 0 & 1 \end{pmatrix} \quad \text{[Equation 6]}$$

From x-coordinate in the main scanning direction of targeted pixel, the image data correcting unit 203 specifies matrix $A_i$ in partition area to which the x-coordinate belongs, and execute coordinate converting by using the matrix $A_i$.

Also, the image data correcting unit 203 calculates magnification error deviation in the main scanning direction $a_i$ in partition area i by using the following equation:

$$a'_i = a' + \Delta a_{(i)}$$

In the equation shown above, a' is whole magnification error deviation ($a_c$, $a_y$, and $a_m$) and calculated in the same way as shown above. Magnification error $\Delta a_{(i)}$ is gradient of approximate line between x-coordinate and deviation amount in the main scanning direction coordinate (Δx coordinate) in partition area i on two-dimensional plane with x-axis and y-axis.

Also, the image data correcting unit 203 calculates registration difference in the main scanning direction $c_i$ in partition area i by using the following equation:

$$c_i = c + \Delta c_{(i)}$$

In the equation shown above, c is registration difference of whole image in the main scanning direction ($c_c$, $c_y$, and $c_m$) and calculated in the same way as shown above. Main scanning deviation amount $\Delta c_{(i)}$ is deviation amount in the main scanning direction between x-coordinate and deviation amount in the main scanning direction coordinate (Δx coordinate) at the starting point of partition area i.

Also, the image data correcting unit 203 calculates skew difference $d_i$ in partition area i by using the following equation:

$$d_i = d + \Delta d_{(i)}$$

In the equation shown above, d is whole skew difference ($d_c$, $d_y$, and $d_m$) and calculated in the same way as shown above. Skew deviation $\Delta d_{(i)}$ is gradient of approximate line between x-coordinate and deviation amount in the sub-scanning direction coordinate (Δy coordinate) in partition area i on two-dimensional plane.

Also, the image data correcting unit 203 calculates registration difference in the sub-scanning direction $f_i$ in partition area i by using the following equation:

$$f_i = f + \Delta f_{(i)}$$

In the equation shown above, f is registration difference of whole image in the sub-scanning direction ($f_c$, $f_y$, and $f_m$) and calculated in the same way as shown above. Sub-scanning deviation amount $\Delta f_{(i)}$ is deviation amount in the sub-scanning direction between x-coordinate and deviation amount in the sub-scanning direction coordinate (Δy coordinate) at the starting point of partition area i on two-dimensional plane.

As for periodic position shift, it is calculated based on periodic position shift variation curve stored in the correcting value storing unit 220 in the same way as described above.

Since matrix A for converting color misalignment changes in connection with internal temperature of the image forming apparatus, it is necessary to update matrix A regularly in common with deviation amount data updating process. Accordingly, various deviation amounts can be detected with high precision even if internal temperature of the image forming apparatus changes. It should be noted that non-linear first optical characteristic and second optical characteristic are stable regardless of internal temperature of the image forming apparatus, so same algorithm can be used to calculate them. Also, updating deviation amount can be stopped in case any one of a plurality of deviation amounts is not normal in the same flow as shown in FIG. 8.

Fifth Embodiment

Depending on type of optical parts included in the optical writing unit 7, non-linear first optical characteristic and second optical characteristic can change in accordance with change of internal temperature of the image forming apparatus. In this embodiment, the optical writing unit 7 includes optical parts that change first optical characteristic and second optical characteristic in accordance with change of internal temperature of the image forming apparatus.

Figure 37:
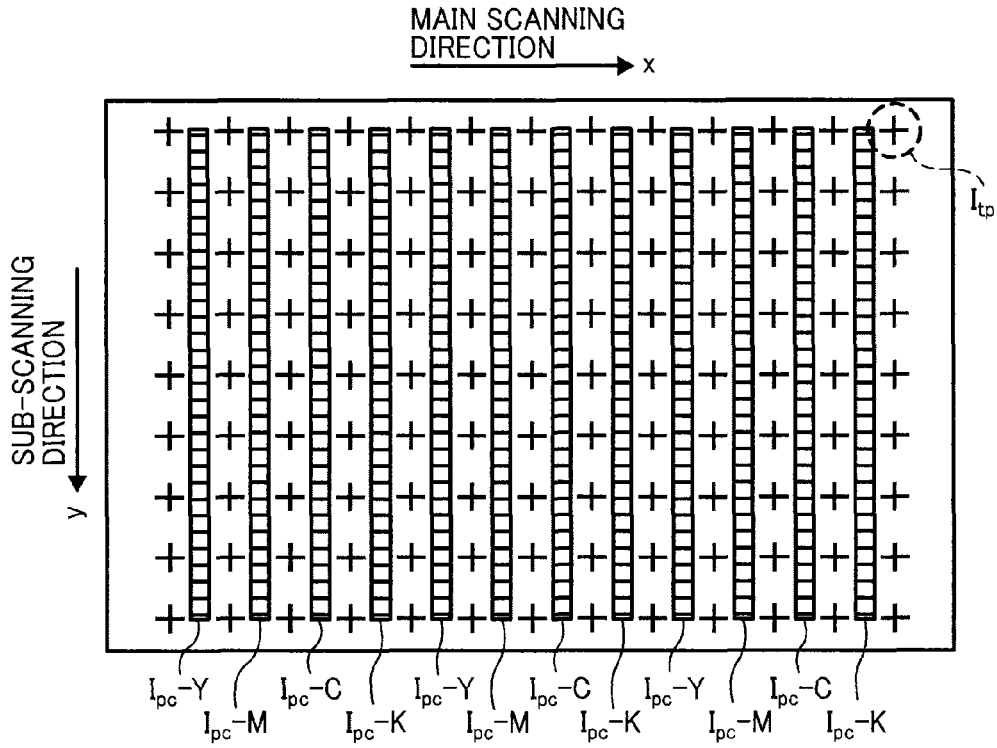
FIG. 37 is a diagram illustrating various areas on the intermediate transferring belt 8 of the image forming apparatus as the fifth embodiment of the present invention.
Figure 38:
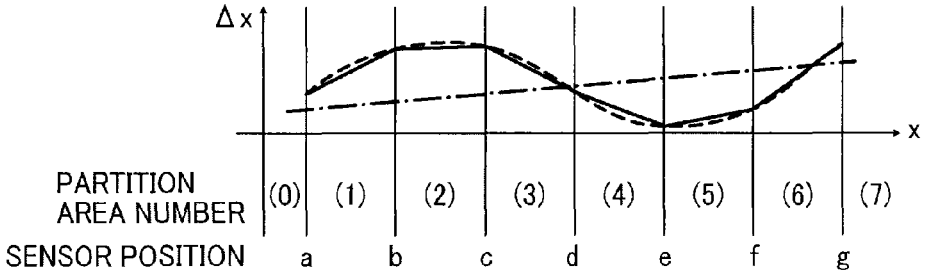
FIG. 38 is a chart illustrating an example of characteristic of optical writing position error in the main scanning direction in the coordinate system of the main scanning direction of the same image forming apparatus as an embodiment of the present invention.

FIG. 37 is a diagram illustrating various areas on the intermediate transferring belt 8 of the image forming apparatus in the fifth embodiment. In FIG. 38, an example of misalignment detecting pattern images $I_{pp}$ are formed in the inter-sheet corresponding area between first sheet corresponding area $A_{p1}$ and second sheet corresponding area $A_{p2}$ on the whole area of the intermediate transferring belt 8.

The image forming apparatus of the fifth embodiment includes seven optical sensors, a first optical sensor 150*a*, a second optical sensor 150*b*, a third optical sensor 150*c*, a fourth optical sensor 150*a*, a fifth optical sensor 150*e*, a sixth optical sensor 150*f*, and a seventh optical sensor 150*g*. While the first optical sensor 150*a* is located so that it corresponds to area around one end of the belt in the same way as the image forming apparatus in the embodiment described above, layout positions of the second optical sensor 150*b* and the third optical sensor 150*c* are different from the embodiment described above.

The seven optical sensors are laid out from one end to the other end in the order of sensor number in the width direction of the belt at predefined pitch. Therefore, the seventh optical sensor 150*g* faces to area around the other end in the width direction of the belt.

In deviation amount data updating process, seven misalignment detecting pattern images $I_{pp}$ that line up at predefined pitch are formed in the inter-sheet corresponding area on the intermediate transferring belt 8. In the width direction of the belt, respective positions where seven misalignment detecting pattern images $I_{pp}$ are formed correspond to seven optical sensors respectively. That is, seven misalignment detecting pattern images $I_{pp}$ are detected by seven optical sensors (150*a*-150*g*) in parallel.

Figure 39:
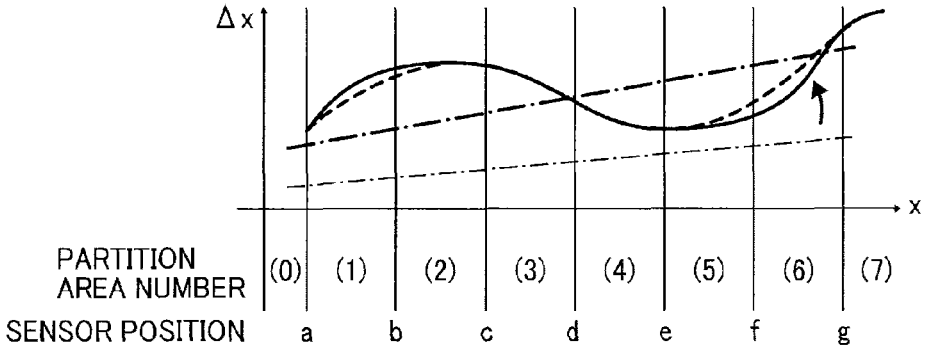
FIG. 39 is a chart illustrating the characteristic shown in FIG. 38 is changed by temperature change as an embodiment of the present invention.

FIG. 38 is a chart illustrating an example of characteristic of optical writing position error in the main scanning direction in the coordinate system of the main scanning direction of the image forming apparatus in this embodiment. In FIG. 39, the dotted curve indicates first optical characteristic. Also, the solid line is approximate line of the dotted curve in each partition area.

FIG. 39 is a chart illustrating the characteristic shown in FIG. 38 is changed by temperature change. In FIG. 39, the solid curve indicates first optical characteristic after changing. Also in FIG. 39, the dotted curve indicates first optical characteristic before changing (the same as in FIG. 38). As shown in FIG. 39, if internal temperature of the image forming apparatus changes, non-linear first optical characteristic also changes in addition to changing linear characteristic (chain line in FIG. 39) indicated by zero-order factor $\alpha_0$ and first-order factor $\alpha_1$. The difference between the dotted curve and the solid curve in FIG. 39 is amount of variation of first optical characteristic in accordance with temperature change.

Figure 40:
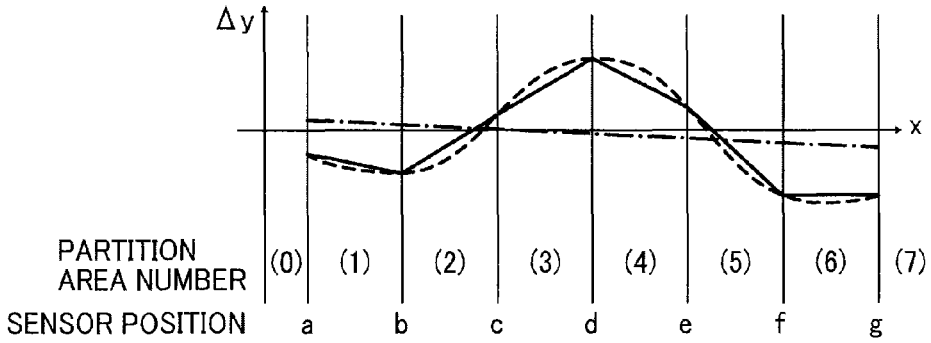
FIG. 40 is a chart illustrating an example of characteristic of optical writing position error in the sub-scanning direction in the coordinate system of the main scanning direction of the same image forming apparatus as an embodiment of the present invention.

FIG. 40 is a chart illustrating an example of characteristic of optical writing position error in the sub-scanning direction in the coordinate system of the main scanning direction of the image forming apparatus in this embodiment. The dotted curve in FIG. 40 indicates second optical characteristic. Also, the solid line is approximate line of the dotted curve in each partition area.

Figure 41:
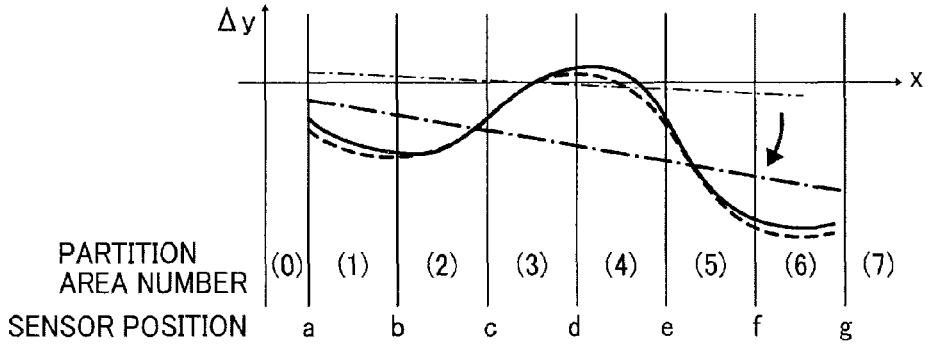
FIG. 41 is a chart illustrating the characteristic shown in FIG. 40 is changed by temperature change as an embodiment of the present invention.

FIG. 41 is a chart illustrating the characteristic shown in FIG. 40 is changed by temperature change. In FIG. 41, the solid curve indicates second optical characteristic after changing. Also in FIG. 41, the dotted curve indicates second optical characteristic before changing (the same as in FIG. 40). As shown in FIG. 41, if internal temperature of the image forming apparatus changes, non-linear second optical characteristic also changes in addition to changing linear characteristic (chain line in FIG. 41) indicated by zero-order factor $\beta_0$ and first-order factor $\beta_1$. The difference between the dotted curve and the solid curve in FIG. 41 is amount of variation of second optical characteristic in accordance with temperature change.

Thus, if first optical characteristic and second optical characteristic changes with time despite optical parts are not replaced, it is impossible to detect various deviation amounts with high precision. Therefore, the controller of the image forming apparatus in this embodiment executes optical characteristic measuring process regularly. While the image forming apparatus in the fourth embodiment executes optical characteristic measuring process only when there is a user operation who replaced optical parts, the image forming apparatus in this embodiment executes optical characteristic measuring process regularly regardless of a user's operation.

Figure 44:
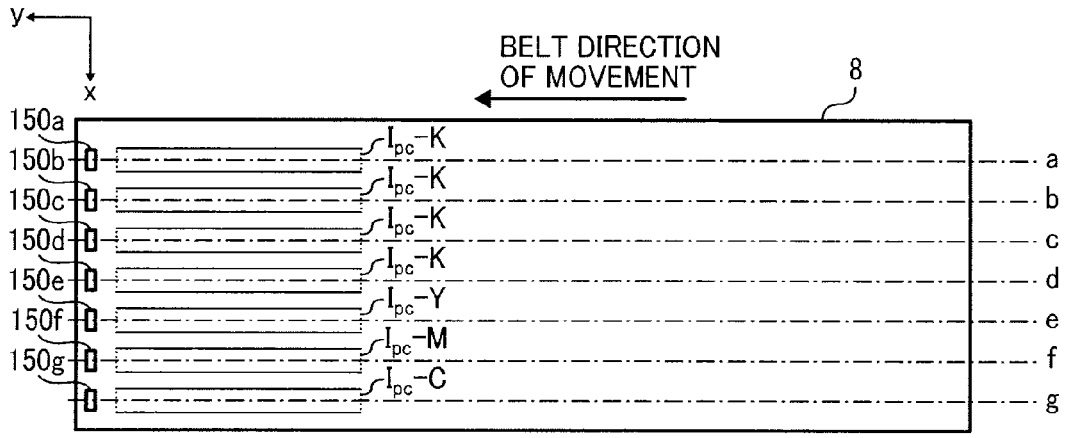
FIG. 44 is a diagram illustrating periodic shift detecting pattern images for each color formed on the intermediate transferring belt of the image forming apparatus as the fifth embodiment of the present invention

While method for optical characteristic measuring process is almost the same as the image forming apparatus in the fourth embodiment, it is different to partition scanning feasible area in the main scanning direction into six areas from the fourth embodiment. In FIG. 44, the width direction of the belt corresponds to the main scanning direction on the photoconductor (rotation axis direction). The layout position of the first optical sensor 150*a* in the width direction of the belt (a in FIG. 44) corresponds to boundary area between area outer than the first partition area (i=1) to one end of the belt and the first partition area. The layout position of the second optical sensor 105*b* in the width direction of the belt (b in FIG. 44) corresponds to boundary area between the first partition area and the second partition area (i=2). The layout position of the third optical sensor 105*c* in the width direction of the belt (c in FIG. 44) corresponds to boundary area between the second partition area and the third partition area (i=3). The layout position of the fourth optical sensor 105*d* in the width direction of the belt (d in FIG. 44) corresponds to boundary area between the third partition area and the fourth partition area (i=4). The layout position of the fifth optical sensor 105*e* in the width direction of the belt (e in FIG. 44) corresponds to boundary area between the fourth partition area and the fifth partition area (i=5). The layout position of the sixth optical sensor 105*f* in the width direction of the belt (f in FIG. 44) corresponds to boundary area between the fifth partition area and the sixth partition area (i=6). The layout position of the seventh optical sensor 150*g* in the width direction of the belt (g in FIG. 44) corresponds to boundary area between the sixth partition area and area outer than the sixth partition area to the other end of the belt.

Figure 42:
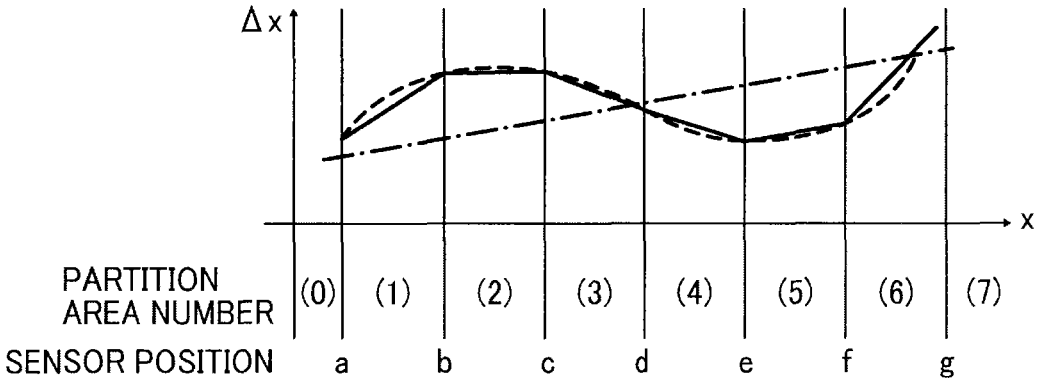
FIG. 42 is a chart illustrating a relationship among the first optical characteristic, divided areas, and approximate lines as an embodiment of the present invention.
Figure 43:
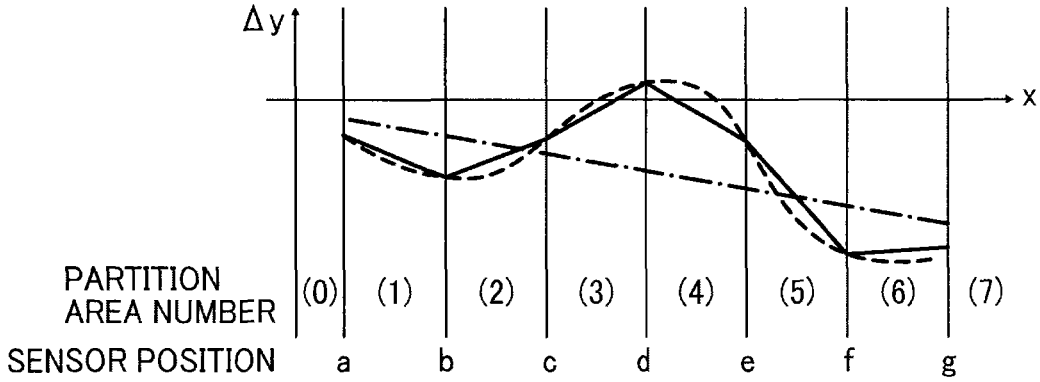
FIG. 43 is a chart illustrating a relationship among the second optical characteristic, divided areas, and approximate lines as an embodiment of the present invention.

Approximate line expressions $f'(x_j)$ and $g'(x_j)$ of functions f(x) and g(x) are calculated based on the analyzing result of test chart image for from the first partition area to the sixth partition area in the same way as the fourth embodiment. Subsequently, after obtaining approximate lines for first optical characteristic function f(x) in each partition area as shown in FIG. 42 and for second optical characteristic function g(x) in each partition area as shown in FIG. 43, those approximate lines are stored in the deviation amount storing unit 204.

While the method to calculate various deviation amounts only for C color misalignment against K is described below, M deviation amount against K and Y deviation amount against K can also be calculated in the same manner.

In FIG. 37, the area between the center position of the first optical sensor 150*a* in the width direction of the belt (a) and the center position of the second optical sensor 150*b* in the width direction of the belt (b) corresponds to the first partition area on the surface of the photoconductor. Hereinafter, the distance between the first optical sensor 150*a* and the second optical sensor 150*b* in the width direction of the belt is referred to as ab distance $L_{ab}$.

The deviation amount calculating unit 212 calculates C skew difference d1(c) in the first partition area by using following equation:

$$d_{1(c)}=(L_{ck_b}-L_{ck_a})\div L_{ab}$$

In the equation above, $L_{ck_b}$ is CK distance $L_{ck}$ in the misalignment detecting pattern image $I_{pp}$ detected by the second optical sensor 150*b*. $L_{ck_a}$ is CK distance $L_{ck}$ in the misalignment detecting pattern image $I_{pp}$ detected by the first optical sensor 150*a*.

Also, the deviation amount calculating unit 212 calculates C registration difference in the sub-scanning direction in the first partition area $f_{1(c)}$ by using following equation:

$$f_{1(c)}=(L_{ck_a}-L_{1ref})\times K$$

In the equation above, $L_{1ref}$ is first standard distance as design value of CK distance $L_{ck}$. Also, K is coefficient that converts distance unit [mm] into pixel unit [dot].

Also, the deviation amount calculating unit 212 calculates C magnification error deviation in the main scanning direction $a_{1(c)}$ by using following equation:

$$a_{1(c)}=\{(L_{cc_b}-L_{kk_b})-(L_{cc_a}-L_{kk_a})\}\div L_{ab}$$

In the equation above, $L_{cc_b}$ is CC distance $L_{cc}$ in the misalignment detecting pattern image $I_{pp}$ detected by the second optical sensor 150*b*. $L_{kk_b}$ is KK distance $L_{kk}$ in the misalignment detecting pattern image $I_{pp}$ detected by the second optical sensor 150*b*. $L_{cc_a}$ is CC distance $L_{cc}$ in the misalignment detecting pattern image $I_{pp}$ detected by the first optical sensor 150*a*. $L_{kk_a}$ is KK distance $L_{kk}$ in the misalignment detecting pattern image $I_{pp}$ detected by the first optical sensor 150*a*.

Also, the deviation amount calculating unit 212 calculates C registration difference in the main scanning direction in the first partition area $c_{1(c)}$ by using following equation:

$$c_{1(c)}=L_{kk_a}\times K$$

It should be noted that correcting offset is arbitrarily executed so that continuity at boundary of partition areas can be kept. Assuming that skew zero is zero and magnification error deviation in the main scanning direction is 1 (a'=0) for matrix A at area outer to one end in the main scanning direction than the first partition area and area outer to the other end in the main scanning direction than the sixth partition area, registration difference both in the main scanning direction and sub-scanning direction is obtained so that approximate line can be continued at neighboring areas.

While only the case for the first partition area is described above, various deviation amount for from the second partition area to the seventh partition area can be calculated in the same way as described above. Periodic position shift can be calculated based on periodic position shift variation curve stored in the corrected values storing unit 220 in the same way as described above.

The image data correcting unit 203 calculates magnification error deviation $a_i'$, registration difference in the main scanning direction $c_i$, skew difference $d_i$, and registration difference in the sub-scanning direction $f_i$ for each partition area in the same way as the image forming apparatus of the fourth embodiment. In this kind of configuration, even if optical parts that change first optical characteristic and second optical characteristic in accordance with temperature change, various deviation amounts can be detected with high precision for a long period of time.

In periodic position shift measuring process, the image forming apparatus of this embodiment forms seven periodic shift detecting pattern images in the width direction of the belt as shown in FIG. 44. Test images of those periodic shift detecting pattern images are detected by the seven optical sensors (150*a*-150*g*). Four out of seven patterns are Y periodic shift detecting pattern image $I_{pc}$-Y, M periodic shift detecting pattern image $I_{pc}$-M, C periodic shift detecting pattern image $I_{pc}$-C, and K periodic shift detecting pattern image $I_{pc}$-K. Executing time of periodic position shift measuring process can be shortened by detecting test image of periodic shift detecting pattern image $I_{pc}$ in parallel for all colors.

In FIG. 45, four K periodic shift detecting pattern image $I_{pc}$-K are formed for criterial color K, and average of four detecting results is calculated as an example. By contrast, two patterns can be formed for each of three colors and only one pattern can be formed for the rest color in another aspect.

Sixth Embodiment

The image forming apparatus of this embodiment is configured in the same way as the second embodiment except driving Y, M, C, and K photoconductors 1Y, 1M, 1C, and 1K by individual motors. Since each of four photoconductors 1Y, 1M, 1C, and 1K drives independently, phase difference of each periodic position shift variation curve changes with time significantly. Therefore, rotating position detecting sensors 309Y, 309M, 309C, and 309K are set for all photoconductor gears 302Y, 302M, 302C, and 302 K respectively.

After starting rotating four photoconductors 1Y, 1M, 1C, and 1K and stabilizing rotating velocity in color mode, phase difference of each periodic position shift variation curve for photoconductors 1Y, 1M, 1C and 1K is kept in constant relationship. Therefore, first off, in correcting Y, M, C, and K color separation image data, the image data correcting unit 203 specifies phase difference of each periodic position shift variation curve for all photoconductors 1Y, 1M, 1C and 1K based on detecting result on standard posture timing. Subsequently, based on the phase difference, the controller estimates rotation angle posture at the time of starting optical writing the first line precisely for each of photoconductor 1Y, 1M, 1C and 1K, and specifies periodic position deviation amount for each pixel in the sub-scanning direction.

Seventh Embodiment

Periodic positional error described above is caused by eccentricity of photoconductors, and, in that eccentricity, central axis and rotation axis of photoconductor drum are misaligned in parallel with each other. This eccentricity is hereinafter referred to as parallel eccentricity. Regarding eccentricity of photoconductors, inclination eccentricity also exists other than parallel eccentricity.

Figure 46:
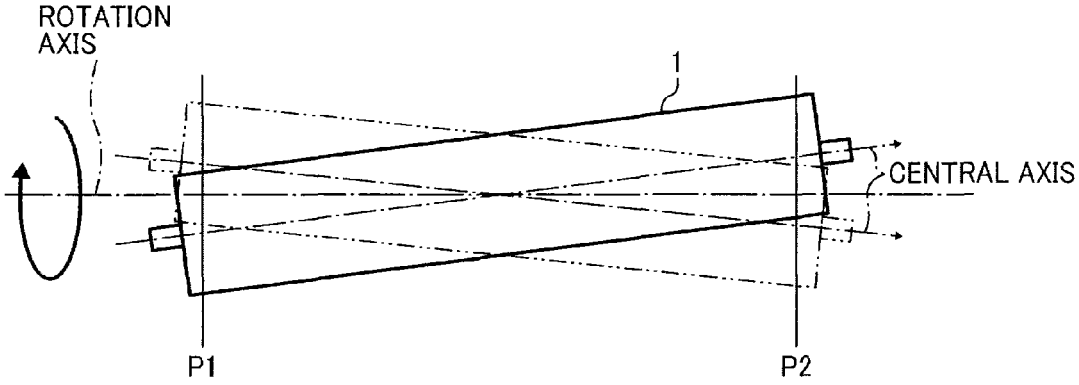
FIG. 46 is a diagram illustrating explanation for inclination eccentricity.

FIG. 46 is a diagram illustrating explanation for inclination eccentricity. In FIG. 46, dashed line shows rotation axis of a photoconductor 1, and chain line shows central axis of the photoconductor 1. As shown in FIG. 46, the photoconductor 1 rotates centering around the rotation axis with inclining its central axis against the rotation axis. In FIG. 46, a first point P1 is a point located at one end in the central axis direction of the photoconductor, and a second point P2 is a point located at the other end in the central axis direction of the photoconductor.

Figure 47:
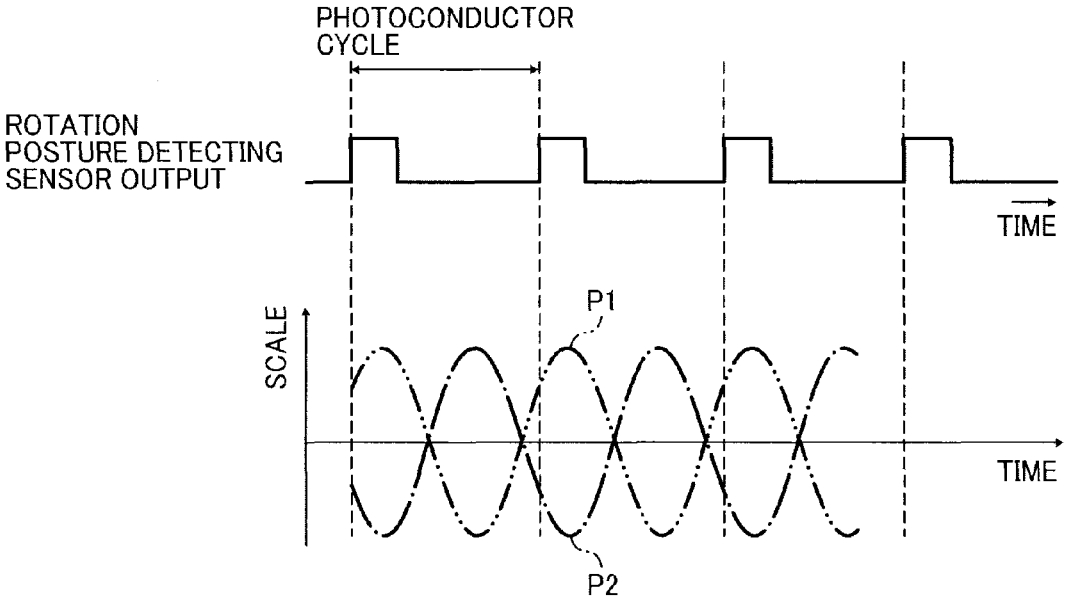
FIG. 47 is a diagram illustrating phase difference between periodic position shift variation curve at a first point P1 and periodic position shift variation curve at a second point P2.

As shown in FIG. 47, if the photoconductor 1 has inclination eccentricity, phase difference between periodic position shift variation curve at the first point P1 and periodic position shift variation curve at the second point P2 is generated. Also, around the center in the central axis direction of the photoconductor 1, not only the phase difference is generated but also amplitude of positional shift variation curve is different from amplitude of positional shift variation curve at other positions.

Therefore, in the image forming apparatus in the seventh embodiment, area in the rotation axis direction of the photoconductor 1 is divided into a plurality of areas, and magnification error in the sub-scanning direction e is measured in each of the divided areas. Regarding measuring method of the magnification error in the sub-scanning direction e, three periodic shift detecting pattern images $I_{pc}$, a periodic shift detecting pattern image $I_{pc}$ detected by the first optical sensor 150*a*, a periodic shift detecting pattern image $I_{pc}$ detected by the second optical sensor 150*b*, and a periodic shift detecting pattern image $I_{pc}$ detected by the third optical sensor 150*c*, are formed for each color instead of forming periodic shift detecting pattern image $I_{pc}$ for each color as shown in FIG. 21. Magnifying error in the sub-scanning direction e in area at one end in the rotation axis direction of the photoconductor 1, magnification error in the sub-scanning direction e in area at the center in the rotation axis direction of the photoconductor 1, and magnification error in the sub-scanning direction e in area at the other end in the rotation axis direction of the photoconductor 1 are calculated based on results of detecting those three periodic shift detecting pattern image $I_{pc}$ for each color. The calculating method of magnification error in the sub-scanning direction e has been described above.

Those three magnification error in the sub-scanning direction e calculated for each color are stored in the deviation amount storing unit 204. Subsequently, color separating image data is corrected separately based on three magnifying error in the sub-scanning direction e for each color stored in the deviation amount storing unit 204 in area at one end in the rotation axis direction of the photoconductor 1, at the center in the rotation axis direction of the photoconductor 1, and the other end in the rotation axis direction of the photoconductor 1. It should be noted that area in the rotation axis direction of the photoconductor 1 can be divided into areas more than three to implement periodic position shift correcting with high precision.

Figure 48:
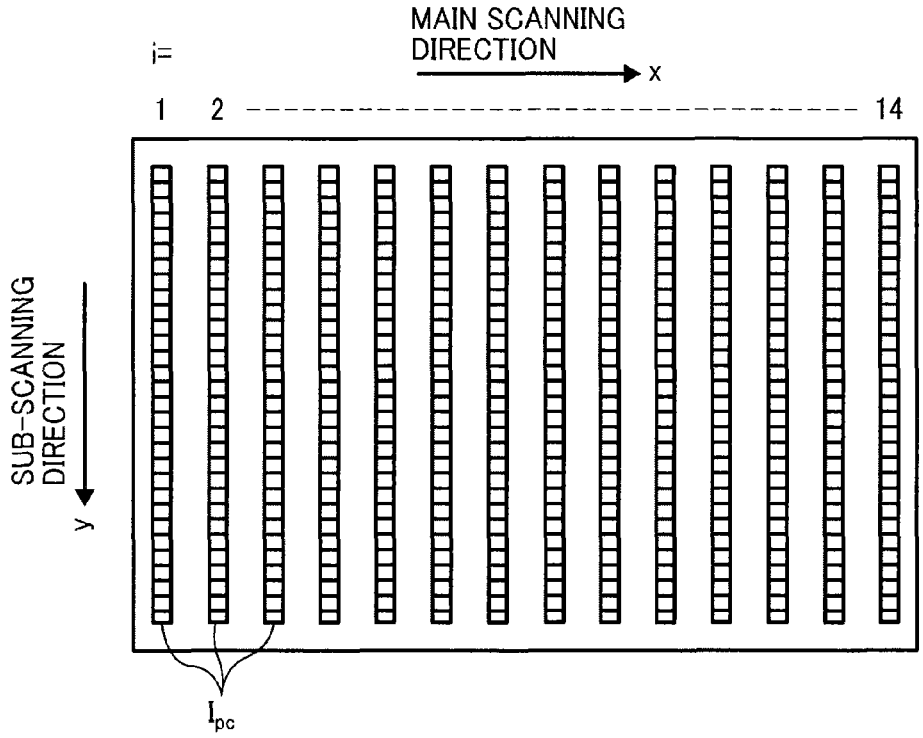
FIG. 48 is a diagram illustrating a periodic shift detecting pattern image $I_{pc}$.

In that case, in order to avoid driving up costs due to setting up many optical sensors, periodic shift detecting pattern image $I_{pc}$ corresponding to each divided areas can be scanned by a scanner instead of detecting them by individual optical sensor. For example, area in the rotation axis direction of photoconductor is divided into 14 areas, and 14 periodic shift detecting pattern images that that corresponds to those 14 areas individually are formed as shown in FIG. 48. Subsequently, after printing those periodic shift detecting pattern images $I_{pc}$ on recording sheet, magnification error in the sub-scanning direction e that corresponds to each of periodic shift detecting pattern images $I_{pc}$ is calculated based on the results of scanning by the scanner. This process is executed for each color.

In forming misalignment detecting pattern image, the image data correcting unit 203 reads magnifying scale e that corresponds to each of 14 divided areas from the deviation amount storing unit 204. Also, regarding skew difference d, registration difference f, whole magnification error shift a, and registration difference c, common values in 14 divided areas (i=1 to 14) is read from the deviation amount storing unit 204. Subsequently, coordinate conversion of image data is executed based on those results. The method to execute coordinate conversion is the same way as in the eighth embodiment described later, so its explanation is omitted here.

Eighth Embodiment

The image forming apparatus in the eighth embodiment is configured as same as the fourth embodiment except following description. In the image forming apparatus in the eighth embodiment, periodic position shift due to inclination eccentricity of photoconductor is brought under control as same as the image forming apparatus in the seventh embodiment. In order to do that, area in the rotation axis direction of photoconductor is divided into 14 areas, and color separation image data is corrected by using individual magnification error e.

Figure 49:
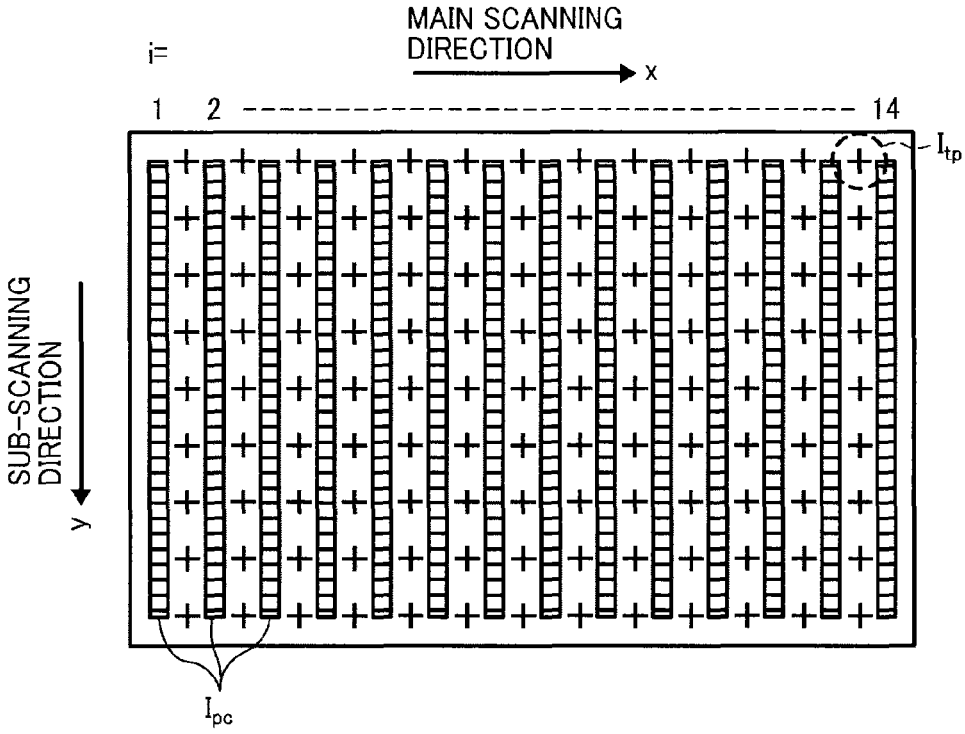
FIG. 49 is a diagram illustrating a test chart image formed by an image forming apparatus of the eighth embodiment.

Regarding test chart image, instead of the test chart image shown in FIG. 36, test chart image shown in FIG. 49 is formed for each color. Test chart image that includes 14 test pattern images $I_{tp}$ corresponding to each of 14 divided areas is formed for each color.

Matrix for converting color shift is calculated by the following equation instead of equation 6:

$$A_i = \begin{pmatrix} a_i' & 0 & c_i \\ d_i & e_i & f_i \\ 0 & 0 & 1 \end{pmatrix} \quad \text{[Equation 7]}$$

In equation 7, $e_i$ shows magnification error at divided area corresponding to number i. That is, matrix $A_i$ is calculated for each of divided areas. In forming misalignment detecting pattern image $I_{pp}$, first, coordinate conversion is executed on color separation image data of position shift detecting pattern at the first divided area based on value of magnification error $e_i$ that corresponds to the first divided area (i=1) read from the deviation amount storing unit 204. Similar coordinate conversion is executed from the second divided area (i=2) to the fourteenth divided area (i=14).

It should be noted that periodic shift detecting pattern $I_{pc}$ can be formed in the state without color shift in optical system (offset difference in the sub-scanning direction and skew difference) in order to measure scale error in the sub-scanning direction e, more precisely. In this case, first optical characteristic and second optical characteristic is measured based on the result of scanning the test chart image shown in FIG. 49 by a scanner. Subsequently, various difference amounts (skew difference d, registration difference f, whole magnification error shift a, and registration difference c) are measured by forming misalignment detecting pattern image shown in FIG. 5. Lastly, periodic shift detecting pattern image $I_{pc}$ is formed executing coordinate conversion on color separation image data for forming the periodic shift detecting pattern image $I_{pc}$ based on various difference amounts such as first optical characteristic and second optical characteristic. It should be noted that various calculation is executed substituting 1 for magnification error in the sub-scanning direction e, in the coordinate conversion described above.

The embodiments described above are examples, and the invention includes specific effects for each of following aspects.

[Aspect A]

The image forming apparatus includes an image information acquiring unit that acquires image information (e.g., the image path switching unit 202), a plurality of latent image carriers that rotate and hold latent images on their surface (e.g., photoconductors 1Y, 1M, 1C, and 1K), a plurality of latent image writing units that write latent image on a plurality of latent image carriers respectively (e.g., the optical writing unit 7), a plurality of developing units that develop latent image on a plurality of latent image carriers respectively (e.g., the developing units 5Y, 5M, 5C, and 5K), an endless moving member that moves its surface endlessly going through opposed positions against a plurality of latent image carriers sequentially (e.g., the intermediate transferring belt 8), a transferring unit that superimposes visible images developed on a plurality of latent image carriers respectively on the surface of the endless moving member and transfers the superimposed visible images to a recording sheet or superimposes the visible images on a recording sheet held on the surface of the endless moving member (e.g., the transferring unit 15), a data storing unit that stores deviation amount data that shows superimposing deviation of the visible images on the surface of the endless moving member or the recording sheet (e.g., the deviation amount storing unit 204), an image detecting unit that detects images formed on the surface of the endless moving member (e.g., the first optical sensor, the second optical sensor, and the third optical sensor), and a controller that executes a latent image writing process that writes latent images on the plurality of latent image carriers, respectively, and controlling the driving of the latent image writing unit based on the corrected image information after executing an image information correcting process that corrects image information acquired by the image information acquiring unit based on deviation amount data stored in the data storing unit to reduce superimposing deviation for latent images to be written on the plurality of latent image carriers, and executes deviation amount data updating process that updates the deviation amount data stored in the data storing unit at a predefined timing based on the result detected by detecting a position detecting image by the image detecting unit after forming a position shift detecting pattern by transferring a predefined position detecting image formed on the surface of the plurality of latent image carriers respectively to the surface of the endless moving member (e.g., the control units 201-220). The image forming apparatus stores periodic fluctuation characteristic data that shows fluctuation characteristic of latent image writing position shift in the direction of movement of the surface of the latent image carrier generated in a single rotation cycle of the latent image carrier at a predefined latent image writing position in the circumferential direction on the surface of the latent image carrier for a plurality of latent image carriers respectively, executes a rotation posture determining process that predetermines rotation posture at writing at the time of starting writing latent image for a plurality of latent image carriers, respectively, and executes an image information correcting process based on the determined rotation posture at writing for a plurality of latent image carriers, respectively, and the deviation amount data and the periodic fluctuation characteristic data stored in the data storing unit.

Aspect A has an effect that reduces color misalignment due to factors such as skew difference, registration difference, and periodic positional error generated on each of the plurality of latent image carriers by correcting image information.

In Aspect A, under the condition in which the plurality of latent image carriers rotate at a stable velocity, the relationship between coordinate of each pixel in the latent image on the surface of latent image carrier in the direction of movement of the surface of the latent image carrier and periodic position error at respective coordinates is settled on surfaces of all latent image carriers when timing of starting writing latent image is determined. For example, a configuration that starts writing latent image in order of the first latent image carrier, the second latent image carrier, the third latent image carrier, and the fourth latent image carrier is adopted in accordance with the layout, and the plus peak point on the sine curve-like periodic position shift variation curve of the first latent image carrier is determined as the timing of starting writing latent image on the first latent image carrier. The periodic position shift curve shows change over time of periodic position error at the writing position of latent image on the surface of the latent image carrier, so writing process on the first pixel row in the direction of movement on the surface of the latent image carrier is executed at the plus peak point of periodic position error at the writing point of latent image. Therefore, the periodic position error of the first pixel row in the direction of movement on the surface of the latent image carrier is nearly equal to the plus peak point of periodic position error. Also, the periodic position error of the second pixel row in the direction of movement on the surface of the latent image carrier is nearly equal to the value shifted rotation angle of latent image carrier for one pixel from the plus peak point of periodic position error. Accordingly, the relationship between coordinates of respective pixels on the latent image in the direction of movement of the latent image carrier on the first latent image carrier and periodic position error is settled.

The timing of starting writing latent image on the second latent image carrier is predetermined time later from starting writing latent image on the first latent image carrier. And the predetermined time is determined by the layout, so the predetermined time remains constant. Also, the first latent image carrier and the second latent image carrier rotate with the constant phase difference as long as each of them rotates stably at the same linear velocity. Accordingly, rotational angle posture of the second latent image carrier at the time of starting writing latent image on the second latent image carrier is settled when the timing of starting writing latent image on the first latent image carrier is determined. For example, writing latent image on the second latent image carrier is started after one revolution period of latent image carrier after starting writing latent image on the first latent image carrier, and the second latent image carrier rotates with +10 degrees phase difference against the first latent image carrier. Also, the plus peak point on the periodic position shift variation curve of the first latent image carrier is determined as the timing of starting writing latent image on the first latent image carrier. In this case, the rotational angle posture of the second latent image carrier at the time of starting writing latent image on the second latent image carrier is shifted +10 degrees from the plus peak point of the periodic position shift variation curve. Therefore, coordinates of respective pixels on the latent image in the direction of movement of the latent image carrier on the second latent image carrier and periodic position error at respective coordinates are also settled when the timing of starting writing latent image on the first latent image carrier is determined.

Likewise, coordinates of respective pixels on the latent image on the third latent image carrier and the fourth latent image carrier and periodic position error at respective coordinates are also settled when the timing of starting writing latent image on the first latent image carrier is determined. Accordingly, coordinates of respective pixels on the latent image in the direction of movement of the latent image carrier on the entire latent image carriers and periodic position error at respective coordinates are settled when the timing of starting writing latent image on the first latent image carrier is determined.

Therefore, the controller predefines writing time rotation posture as rotation angle posture at the time of starting writing latent image for a plurality of latent image carriers respectively by determining the timing of starting writing latent image in the image information correcting process. For example, if one driving source drives all the latent image carriers, each latent image carrier rotates at predefined rotation phase difference since each latent image carrier rotates in synchronization with each other. Accordingly, writing time rotation posture of respective latent image carriers can be determined so that the predefined rotation phase difference is satisfied since writing time rotation posture of respective latent image carriers has predefined rotation phase difference reciprocally. By contrast, if one driving source drives each latent image carrier, rotation phase difference of each latent image carrier changes with time depending on response of each driving source. However, rotation phase difference is kept constantly until stopping driving after rotating velocity of each latent image carrier is stabilized. Therefore, writing time rotation posture of respective latent image carriers can be determined so that rotation phase difference measured by encoder equipped with respective latent image carriers is satisfied after rotating velocity of each latent image carrier is stabilized.

Accordingly, the relationship between coordinates of respective pixels on the latent image on each latent image carrier and periodic position error at respective coordinates are settled by predetermining writing time rotation posture of each latent image carrier in the image information correcting process in prior to the latent image writing process. Subsequently, both superimposing shift due to skew shift and registration shift and superimposing shift of visible image due to periodic position error generated on latent image carriers respectively can be reduced by correcting image information based on shift amount data stored in the data storing unit and periodic position error specified for coordinates respectively.

[Aspect B]

In Aspect B, the image forming apparatus of Aspect A further includes a single driving unit that drives the plurality of latent image carriers and a rotation posture detector that detects changes in rotation angle posture for the plurality of latent image carriers, respectively, and the controller starts writing latent images on the plurality of latent image carriers upon determining that the plurality of latent image carriers assume a predefined rotation angle posture respectively in the latent image writing process after defining the predefined rotation angle posture as the writing rotation posture corresponding to the plurality of latent image carriers respectively in the rotation posture determining process. Aspect B has an effect that can determine writing rotation posture for each of the plurality of latent image carriers without detecting rotation posture of the plurality of latent image carriers by the rotation posture detector.

[Aspect C]

In Aspect C (e.g., the first embodiment), the image forming apparatus of Aspect A further includes a rotation behavior grasping unit that grasps behavior of varying rotation angle posture for the plurality of latent image carriers respectively, and the controller determines writing rotation posture for the plurality of latent image carriers respectively based on the grasped result by the rotation behavior grasping unit in the rotation posture determining process. Aspect C has an effect that can determine appropriate writing rotation posture for each of the plurality of latent image carriers by grasping rotating phase difference when the plurality of latent image carriers rotate in equal linear velocity stably based on the grasped result by the rotation behavior grasping unit even if each of the plurality of latent image carriers is driven by different driving source with each other.

[Aspect D]

In Aspect D (e.g., the seventh embodiment and the eighth embodiment), in one of the image forming apparatus of Aspect A-C, the controller stores a plurality of periodic variation characteristic data that corresponds to a plurality of divided areas in the rotation axis direction of the latent image carrier for the plurality of latent image carries respectively, and corrects the image information based on the periodic variation characteristic data corresponding to the divided area and deviation amount data for the plurality of divided areas respectively. Aspect D has an effect that can reduce periodic position shift due to inclination eccentricity of latent image carriers as described above.

[Aspect E]

In Aspect E (e.g., the second embodiment and the third embodiment), in one of the image forming apparatus of Aspect A-D, the controller executes periodic variation characteristic data building process that builds the periodic variation characteristic data based on the timing of detecting test images by the image detecting unit at the timing of satisfying predefined condition after forming periodic variation detecting pattern image that includes a plurality of test images laid out at predefined pitch in the circumferential direction of the latent image carrier on the surface of the latent image carrier and transferring the periodic variation detecting pattern image to the surface of the endless moving member for the plurality of latent image carriers respectively.

[Aspect F]

In Aspect F (e.g., the fourth embodiment), one of the image forming apparatus of Aspect A-E further comprises a plurality of photoconductors as the plurality of latent image carriers and an optical writing unit that optical writes electrostatic latent image on the photoconductors as the latent image writing unit, and the controller has the data storing unit store first optical characteristic data as characteristic data of optical writing position error in the rotation axis direction in coordinate system in the rotation axis direction of the photoconductor due to optical characteristic of optical parts in the optical writing unit, and corrects image information acquired by the image information acquiring unit based on the deviation amount data, the periodic variation characteristic data, and the first optical characteristic data stored in the data storing unit in the image information correcting process. Aspect F has an effect that can reduce superimposing misalignment due to optical writing position error caused by the first optical characteristic.

[Aspect G]

In Aspect G (e.g., the fourth embodiment), one of the image forming apparatus of Aspect A-F further comprises a plurality of photoconductors as the plurality of latent image carriers and an optical writing unit that optical writes electrostatic latent image on the photoconductors as the latent image writing unit, and the controller has the data storing unit store second optical characteristic data as characteristic data of optical writing position error in the rotation axis direction in coordinate system in the rotation axis direction of the photoconductor due to optical characteristic of optical parts in the optical writing unit, and corrects image information acquired by the image information acquiring unit based on the deviation amount data, the periodic variation characteristic data, and the second optical characteristic data stored in the data storing unit in the image information correcting process. Aspect G has an effect that can reduce superimposing misalignment due to optical writing position error caused by the second optical characteristic.

[Aspect H]

In Aspect H (e.g., the main embodiment), one of the image forming apparatus of Aspect A-G further comprises a fixing unit that fixes visible image on recording sheet after going through the transferring unit and a duplex unit that resend the recording sheet with reversing the recording sheet in order to transfer and fix visible image on the back side of the recording sheet whose front side has already transferred and fixed visible image, and the controller has the data storing unit store reduction ratio data of the recording sheet that goes through the fixing unit, and corrects image information corresponding to the back side based on the reduction ratio data in addition to the deviation amount data and the periodic variation characteristic data stored in the data storing unit in the image information correcting process. Aspect H has an effect that can reduce error of image magnification between the front side and the back side due to shrinkage of the recording sheet.

[Aspect I]

In Aspect I (e.g., the third embodiment), in the image forming apparatus of Aspect E, the plurality of image detecting units are laid out along with the surface of the endless moving member in the direction perpendicular to the endless direction of movement of the surface, and the controller forms a plurality of periodic variation detecting pattern images detected by the image detecting units for the plurality of latent image carriers respectively, and builds the periodic variation characteristic data based on the smoothing result of detecting timing of each test image in the periodic variation detecting pattern images. Aspect I has an effect that can reduce error in detecting position due to interfusion of noise into the image detecting unit and can detect periodic position shift amount with high-precision.

[Aspect J]

In Aspect J (e.g., FIG. 36), the image forming apparatus of Aspect E further includes an image scanning unit that scans image transferred on the recording sheet, and the controller builds the periodic variation characteristic data based on scanned result of the periodic variation detecting pattern image transferred on the recording sheet in the periodic variation characteristic data building process instead of detecting test images of the periodic variation detecting pattern image by the image detecting unit. Aspect J has an effect that can reduce detection error of periodic position shift due to variation of surface moving velocity of endless moving member.

[Aspect K]

In Aspect K (e.g., the fifth embodiment), in the image forming apparatus of Aspect E, a plurality of image detecting units equal to or more than the number of the latent image carriers are laid out along with the surface of the endless moving member in the direction perpendicular to the endless direction of movement of the surface, and the controller transfers the periodic variation detecting pattern image formed on the plurality of latent image carriers respectively and laid out in the direction perpendicular to the endless direction of movement of the surface, and detects test images of the periodic variation detecting pattern images concurrently. Aspect K has an effect that can shorten executing time of periodic position shift measuring process by detecting test images in the periodic variation detecting pattern image for all of the latent image carriers in parallel.

[Aspect L]

In Aspect L, the image forming apparatus of Aspect E further includes a plurality of photoconductors as the plurality of latent image carriers and an optical writing unit that optical writes electrostatic latent image on the photoconductors as the latent image writing unit, and the controller has the data storing unit store first optical characteristic data as characteristic data of optical writing position error in the rotation axis direction in coordinate system in the rotation axis direction of the photoconductor due to optical characteristic of optical parts in the optical writing unit and second optical characteristic data as characteristic data of optical writing position error in the surface direction of movement of the photoconductor in the coordinate system due to the optical characteristic, corrects image information acquired by the image information acquiring unit based on the deviation amount data, the periodic variation characteristic data, the first optical characteristic data, and the second optical characteristic data stored in the data storing unit in the image information correcting process, and forms the periodic variation detecting pattern while correcting image information for forming the periodic variation detecting pattern based on the deviation amount data, the periodic variation characteristic data, the first optical characteristic data, and the second optical characteristic data. Aspect L has an effect that can form periodic variation detecting pattern with almost no position shift due to factor different from periodic position error and can detect periodic variation characteristic easily.

Numerous additional modifications and variations are possible in light of the above teachings. It is therefore to be understood that, within the scope of the appended claims, the disclosure of this patent specification may be practiced otherwise than as specifically described herein.

As can be appreciated by those skilled in the computer arts, this invention may be implemented as convenient using a conventional general-purpose digital computer programmed according to the teachings of the present specification. Appropriate software coding can readily be prepared by skilled programmers based on the teachings of the present disclosure, as will be apparent to those skilled in the software arts. The present invention may also be implemented by the preparation of application-specific integrated circuits or by interconnecting an appropriate network of conventional component circuits, as will be readily apparent to those skilled in the relevant art.

What is claimed is:

1. An image forming apparatus, comprising:

an image information acquiring unit to acquire image information;

a plurality of latent image carriers to carry latent images on their rotating surfaces;

a latent image writing unit to write latent images on the plurality of latent image carriers, respectively;

a plurality of developing units to develop latent images on the plurality of latent image carriers, respectively;

an endless moving member to move its surface endlessly to go through opposite positions against the plurality of latent image carriers sequentially;

a transferring unit to transfer developed visible images on the plurality of latent image carriers respectively to a recording sheet either after superimposing the visible images on the surface of the endless moving member or on the recording sheet held on the surface of the endless moving member;

a data storing unit to store deviation amount data that indicates superimposing deviation of visible images on the surface of the endless moving member or the recording sheet;

an image detecting unit to detect an image formed on the surface of the endless moving member; and a controller to execute a latent image writing process on the plurality of latent image carriers, respectively, by controlling driving of the latent image writing unit based on corrected image information after executing an image information correcting process that corrects image information acquired by the image information acquiring unit based on the deviation amount data stored in the data storing unit to reduce superimposing deviation of latent images written on the plurality of latent image carriers, respectively, to write latent images, to obtain misalignment detecting pattern images by transferring predefined position detecting images formed on the plurality of latent image carriers, respectively, to the surface of the endless moving member, and to update the deviation amount data stored in the data storing unit at a predefined timing based on a timing of detecting the position detecting images by the image detecting unit;

wherein the controller has the data storing unit store periodic variation characteristic data that indicates variation characteristic of latent image writing position shift in the surface direction of movement of the latent image carrier generated at one round cycle of the latent image carrier at a predefined latent image writing position in the circumferential direction of the surface of the latent image carrier for each of the plurality of latent image carriers, execute a writing rotation posture determining process that sets a writing rotation posture as a rotation angle posture upon starting writing latent images on the plurality of latent image carriers, respectively, in the image information correcting process, and correct the image information based on the writing rotation posture determined for the plurality of latent image carriers, respectively, and the deviation amount data and the periodic variation characteristic data stored in the data storing unit.

2. The image forming apparatus according to claim 1, further comprising:

a single driving unit to drive the plurality of latent image carriers; and a rotation posture detector to detect changes in rotation angle posture for the plurality of latent image carriers, respectively;

wherein the controller starts writing latent images on the plurality of latent image carriers upon determining that the plurality of latent image carriers assume a predefined rotation angle posture respectively in the latent image writing process after defining the predefined rotation angle posture as the writing rotation posture corresponding to the plurality of latent image carriers respectively in the rotation posture determining process.

3. The image forming apparatus according to claim 1, further comprising a rotation posture detector to detect changes in rotation angle posture for the plurality of latent image carriers, respectively, herein the controller determines writing rotation posture for the plurality of latent image carriers, respectively, based on the result obtained by the rotation posture detector in the rotation posture determining process.

4. The image forming apparatus according to claim 1, wherein the controller stores a plurality of periodic variation characteristic data that corresponds to a plurality of divided areas in the rotation axis direction of the latent image carrier for the plurality of latent image carries, respectively, and corrects the image information based on the periodic variation characteristic data corresponding to the divided area and deviation amount data for the plurality of divided areas, respectively.

5. The image forming apparatus according to claim 1, further comprising:

a plurality of photoconductors as the plurality of latent image carriers; and an optical writing unit to optical write electrostatic latent image on the photoconductors as the latent image writing unit, wherein the controller has the data storing unit store first optical characteristic data as characteristic data of optical writing position error in the rotation axis direction in a coordinate system in the rotation axis direction of the photoconductor due to optical characteristics of optical parts in the optical writing unit, and corrects image information acquired by the image information acquiring unit based on the deviation amount data, the periodic variation characteristic data, and the first optical characteristic data stored in the data storing unit in the image information correcting process.

6. The image forming apparatus according to claim 1, further comprising:

a plurality of photoconductors as the plurality of latent image carriers; and an optical writing unit to optical write electrostatic latent image on the photoconductors as the latent image writing unit, wherein the controller has the data storing unit store second optical characteristic data as characteristic data of optical writing position error in the surface direction of movement of the photoconductor in coordinate system in the rotation axis direction of the photoconductor due to optical characteristic of optical parts in the optical writing unit, and corrects image information acquired by the image information acquiring unit based on the deviation amount data, the periodic variation characteristic data, and the second optical characteristic data stored in the data storing unit in the image information correcting process.

7. The image forming apparatus according to claim 1, further comprising:

a fixing unit to fix visible images on a recording sheet exiting the transferring unit; and a duplex unit to reverse and resend the recording sheet to transfer and fix a visible image on the back side of the recording sheet whose front side has already transferred and fixed the visible image, wherein the controller has the data storing unit store reduction ratio data of the recording sheet that goes through the fixing unit, and corrects image information corresponding to the back side based on the reduction ratio data in addition to the deviation amount data and the periodic variation characteristic data stored in the data storing unit in the image information correcting process.

8. The image forming apparatus according to claim 1, wherein the controller executes a periodic variation characteristic data building process that builds the periodic variation characteristic data based on the timing of detecting test images by the image detecting unit upon satisfying predefined conditions after forming a periodic variation detecting pattern image that includes a plurality of test images laid out at a predefined pitch in the circumferential direction of the latent image carrier on the surface of the latent image carrier and transferring the periodic variation detecting pattern image to the surface of the endless moving member for the plurality of latent image carriers, respectively.

9. The image forming apparatus according to claim 8, wherein the plurality of image detecting units are laid out along with the surface of the endless moving member in the direction perpendicular to the endless direction of movement of the surface, and the controller forms a plurality of periodic variation detecting pattern images detected by the image detecting units for the plurality of latent image carriers respectively, and builds the periodic variation characteristic data based on the smoothing result of detecting timing of each test image in the periodic variation detecting pattern images.

10. The image forming apparatus according to claim 8, further comprising an image scanning unit to scan image transferred on the recording sheet, wherein the controller builds the periodic variation characteristic data based on scanned result of the periodic variation detecting pattern image transferred on the recording sheet in the periodic variation characteristic data building process instead of detecting test images of the periodic variation detecting pattern image by the image detecting unit.

11. The image forming apparatus according to claim 8, wherein a plurality of image detecting units equal to or more than the number of the latent image carriers are laid out along with the surface of the endless moving member in the direction perpendicular to the endless direction of movement of the surface, and the controller transfers the periodic variation detecting pattern image formed on the plurality of latent image carriers respectively and laid out in the direction perpendicular to the endless direction of movement of the surface, and detects test images of the periodic variation detecting pattern images concurrently.

12. The image forming apparatus according to claim 8, further comprising:

a plurality of photoconductors as the plurality of latent image carriers; and an optical writing unit to optical write electrostatic latent image on the photoconductors as the latent image writing unit, wherein the controller has the data storing unit store first optical characteristic data as characteristic data of optical writing position error in the rotation axis direction in coordinate system in the rotation axis direction of the photoconductor due to optical characteristic of optical parts in the optical writing unit and second optical characteristic data as characteristic data of optical writing position error in the surface direction of movement of the photoconductor in the coordinate system due to the optical characteristic, corrects image information acquired by the image information acquiring unit based on the deviation amount data, the periodic variation characteristic data, the first optical characteristic data, and the second optical characteristic data stored in the data storing unit in the image information correcting process, and forms the periodic variation detecting pattern while correcting image information for forming the periodic variation detecting pattern based on the deviation amount data, the periodic variation characteristic data, the first optical characteristic data, and the second optical characteristic data.

13. A method of forming images, comprising the steps of:

acquiring image information by an image information acquiring unit;

carrying a latent image on rotating surface of a latent image carrier;

writing latent images on a plurality of latent image carriers respectively;

developing latent images on a plurality of latent image carriers respectively;

moving a surface of an endless moving member endlessly to go through opposite positions against the plurality of latent image carriers sequentially;

transferring visible images developed on the plurality of latent image carriers, respectively, to a recording sheet either after superimposing the visible images on the surface of the endless moving member or on the recording sheet held on the surface of the endless moving member;

storing deviation amount data that indicates superimposing deviation of visible images on the surface of the endless moving member or the recording sheet in a data storing unit;

detecting image formed on the surface of the endless moving member by an image detecting unit;

correcting image information acquired by the image information acquiring unit based on the deviation amount data stored in the data storing unit to reduce superimposing deviation of latent images written on the plurality of latent image carriers, respectively;

writing latent images on the plurality of latent image carriers, respectively, based on the corrected image information;

obtaining misalignment detecting pattern images by transferring predefined position detecting image formed on the plurality of latent image carriers respectively to the surface of the endless moving member;

updating the deviation amount data stored in the data storing unit based on the timing of detecting the position detecting images by the image detecting unit;

storing the periodic variation characteristic data that indicates variation characteristic of latent image writing position shift in the surface direction of movement of the latent image carrier generated at one round cycle of the latent image carrier at a predefined latent image writing position in the circumferential direction of the surface of the latent image carrier in the data storing unit;

setting a writing rotation posture as a rotation angle posture upon starting writing latent images on the plurality of latent image carriers, respectively; and correcting the image information based on the writing rotation posture determined for the plurality of latent image carriers respectively and the deviation amount data and the periodic variation characteristic data stored in the data storing unit in the image information correcting step.

14. A non-transitory computer-readable storage medium storing a program that, when executed by a computer, causes the computer to implement a method of forming images, the method comprising the steps of:

acquiring image information by an image information acquiring unit;

carrying a latent image on rotating surface of a latent image carrier;

writing latent images on a plurality of latent image carriers, respectively;

developing latent images on a plurality of latent image carriers, respectively;

moving a surface of an endless moving member endlessly to go through opposite positions against the plurality of latent image carriers sequentially;

transferring visible images developed on the plurality of latent image carriers, respectively, to a recording sheet either after superimposing the visible images on the surface of the endless moving member or on the recording sheet held on the surface of the endless moving member;

storing deviation amount data that indicates superimposing deviation of visible images on the surface of the endless moving member or the recording sheet in a data storing unit;

detecting image formed on the surface of the endless moving member by an image detecting unit;

correcting image information acquired by the image information acquiring unit based on the deviation amount data stored in the data storing unit to reduce superimposing deviation of latent images written on the plurality of latent image carriers, respectively;

writing latent images on the plurality of latent image carriers, respectively, based on the corrected image information;

obtaining misalignment detecting pattern images by transferring predefined position detecting image formed on the plurality of latent image carriers, respectively, to the surface of the endless moving member;

updating the deviation amount data stored in the data storing unit based on the timing of detecting the position detecting images by the image detecting unit;

storing the periodic variation characteristic data that indicates variation characteristic of latent image writing position shift in the surface direction of movement of the latent image carrier generated at one round cycle of the latent image carrier at a predefined latent image writing position in the circumferential direction of the surface of the latent image carrier in the data storing unit;

setting a writing rotation posture as a rotation angle posture upon starting writing latent images on the plurality of latent image carriers, respectively; and correcting the image information based on the writing rotation posture determined for the plurality of latent image carriers, respectively, and the deviation amount data and the periodic variation characteristic data stored in the data storing unit in the image information correcting step.

* * * * *